US005361607A

United States Patent [19]

Mitsumoto et al.

[11] Patent Number: 5,361,607

[45] Date of Patent: Nov. 8, 1994

[54] KNITTED FABRIC INTEGRALLY KNITTED WITH AN ADDITIONAL POCKET AND THE METHOD OF INTEGRALLY KNITTING THEM

[75] Inventors: Shigenobu Mitsumoto; Masao Okuno, both of Wakayama, Japan

[73] Assignee: Shima Seiki Mfg., Ltd., Wakayama, Japan

[21] Appl. No.: 173,725

[22] Filed: Dec. 27, 1993

Related U.S. Application Data

[63] Continuation of Ser. No. 866,715, Apr. 10, 1992, abandoned.

[30] Foreign Application Priority Data

Apr. 10, 1991 [JP] Japan ..... 3-106682

[51] Int. Cl.[5] ..... D04B 7/00; D04B 9/54

[52] U.S. Cl. ..... 66/69; 66/173

[58] Field of Search ..... 66/69, 173, 189, 196, 66/197, 171, 176, 170, 175, 172 R, 198, 64

[56] References Cited

U.S. PATENT DOCUMENTS

| | | | |
|---|---|---|---|
| 212,580 | 2/1879 | Wechsler | 66/176 |
| 1,072,640 | 9/1913 | Nydegger | 66/171 |
| 1,572,434 | 2/1926 | Kaiser | 66/171 |
| 3,602,914 | 9/1971 | Castello | 66/196 X |
| 3,668,896 | 6/1972 | Betts et al. | 66/176 |
| 3,668,898 | 6/1972 | Betts et al. | 66/176 |
| 4,038,699 | 8/1977 | Burn | 66/189 |
| 4,040,275 | 8/1977 | Castello | 66/64 |

FOREIGN PATENT DOCUMENTS

| | | | |
|---|---|---|---|
| 301511 | 5/1914 | Germany | 66/171 |

*Primary Examiner*—Clifford D. Crowder
*Assistant Examiner*—Larry D. Worrell, Jr.
*Attorney, Agent, or Firm*—Edwin E. Greigg; Ronald E. Greigg

[57] ABSTRACT

A method of forming a knitted body part of a knitted wear which includes knitting an integral pocket while knitting the body portion. A flat knitting machine with two pair of needle beds in a vertical direction is used. As soon as the body portion is knitted up to a predetermined position, the knitting machine is operated to branch out specific loops engaged with those knitting needles in a region corresponding to the predetermined width of a pocket.

11 Claims, 78 Drawing Sheets

V a front stitch tuck a missed front stitch tuck feeder feeder knitting of a front stitch knitting of a back stitch an empty needle knit miss overlaying a front stitch to an empty needle knit miss a miss split knit transferring of a loop, F to B transferring of a loop, B to F overlaying a front stitch to another front stitch an empty knit

FIG. 3

KNITTED FABRIC INTEGRALLY KNITTED WITH AN ADDITIONAL POCKET AND THE METHOD OF INTEGRALLY KNITTING THEM

This is a continuation of copending application(s) Ser. No. 07/866,715 filed on Apr. 10, 1992, abandoned.

BACKGROUND OF THE INVENTION

The present invention relates to a method of integrally composing a knitted fabric integrated with an additional pocket by operating a flat knitting machine to integrally form an additional pocket in the course of executing those processes for composing a body part of a knitted wear like a sweater or a cardigan for example.

Conventionally, when providing an additional pocket on the body part of a knitted wear, initially, a knitter prepares a pocket-shaped knitted fabric, and then forms a pocket by combining the prepared pocket-shaped knitted fabric with the knitted base fabric at a desired location by applying a sewing process.

Normally, the periphery of a knitted fabric prepared for composing a pocket is manually sewn on the body part of a knitted wear. Nevertheless, peripheral portions of the knitted fabric prepared for composing a pocket is easily twined and incurs much inconvenience to handle it, and yet, easily incurs deformation. Because of these reasons, conventionally, it takes much time and consumes much labor to properly sew the prepared knitted fabric before forming a pocket on the desired knitted wear. In other words, these conventional processes significantly lower productivity.

In particular, when forming a pocket with a knitted fabric bearing patterns, it is quite difficult for the sewer to correctly match patterns between the knitted base fabric and the sewn pocket, and therefore, the above-cited symptoms obviously appear as a critical problem to solve.

To solve those problems cited above, the Applicant of the invention previously proposed a method of composing such a knitted fabric added with a pocket, where the proposed method comprises those steps described below. Initially, a knitted fabric available for the front and rear body parts is knitted up. When the knitting line arrives at a predetermined region for the provision of a pocket, a certain number of loops engaged with those knitting needles corresponding to the pocket-forming region are locally branched in order to form the bottom of a pocket, and then the front part of the pocket is knitted as of the condition in which side edges of the front-side pocket fabric knitted upward from the bottom of the pocket are integrally knitted with the front fabric, and in addition, a region knitted in the rib form is designated for the upper position of the pocket by continuously being formed in succesion to the front body part.

On the other hand, basically, in order to properly form a predetermined design and exert its own function, aperture of a pocket provided for a knitted wear needs to be reinforced by means of a rib-knitting for example. However, when composing such a knitted fabric combined with a specifically knitted fabric available for composing a pocket according to the method previously proposed by the Applicant of the invention, the exterior of the pocket-forming knitted fabric consists of the right-side composition, whereas the knitted base fabric available for the body part concealed inside of the pocket-forming knitted fabric solely consists of the lining composition.

In consequence, the knitted base fabric concealed inside of the right-side knitted fabric designated for a pocket making up part of a complete knit wear added with a pocket turns into the lining composition. As a result, when a consumer wears a knit consisting of the knitted fabric cited above, the knit visually exposes the region that turned into the lining composition along the upper aperture of the pocket. This in turn generates a uncomfortable looking of the knit itself to merely result in a degraded commerical value.

Furthermore, when the knitted base fabric concealed inside of the right-side knitted fabric of the pocket turns into the lining composition as mentioned above, the lining composition itself recesses, and as a result, the right-side knitted fabric making up the pocket falls in the recessed domain. This in turn nullifies a voluminous appearance characteristic of the added pocket itself.

Therefore, the invention has been achieved to fully solve those technical problems cited above. The object of the invention is to provide a novel method of composing a knit integrated with an additional pocket filled with a voluminous appearance without lowering productivity at all.

SUMMARY OF THE INVENTION

To securely achieve the above objects, the invention provides a novel method of knitting a fabric provided with a pocket.

In order to knit a base fabric provided with a pocket by a flat knitting machine which is furnished with two pairs of needle beds, the method embodied by the invention characteristically comprises those sequential steps including the following:

First, when the knitting procedure comes to a position at which a pocket-forming fabric is to be started and formed, loops which are held on a number of knitting needles of a first needle bed, the number of the knitting needles being corresponding to the width of a pocket, are made to be held also on knitting needles of a second needle bed.

Then, a base fabric is knitted by the knitting needles of the first needle bed and a pocket-forming fabric is knitted by the knitting needles of the second needle bed.

Further, during knitting the fabric provided with a pocket, the left side and right side of the pocket-forming fabric are connected with the base fabric.

In this case, when one of the two pairs of needle beds is operated to knit the base fabric and the other needle beds are operated to knit the pocket-forming fabric, a knitting structure of the pocket-forming fabric and a knitting structure of the base fabric which is overlapped with the pocket-forming fabric can be the same structure.

In another case, if the flat knitting machine is provided with a pair of needle beds, when knitting comes to a position at which a pocket-forming fabric is to be started and formed, loops which are held on every other knitting needle of a first needle bed are shifted to knitting needles of a second needle bed. Then, a pocket-forming fabric is knitted by vacant needles of the first needle bed. As a result, a knitting structure of the pocket-forming fabric and a knitting structure of the base fabric which is overlapped with the pocket-forming fabric can be the same structure.

BRIEF DESCRIPTION OF THE DRAWINGS

FIG. 3 presents a list of symbols explanatory of knit composing courses;

DETAILED DESCRIPTION OF THE PREFERRED EMBODIMENTS

The First Embodiment

Referring now to the accompanying drawings, the method of integrally knitting a base knit with a pocket-composing knit fabric according to the invention is described below.

Figure 1:
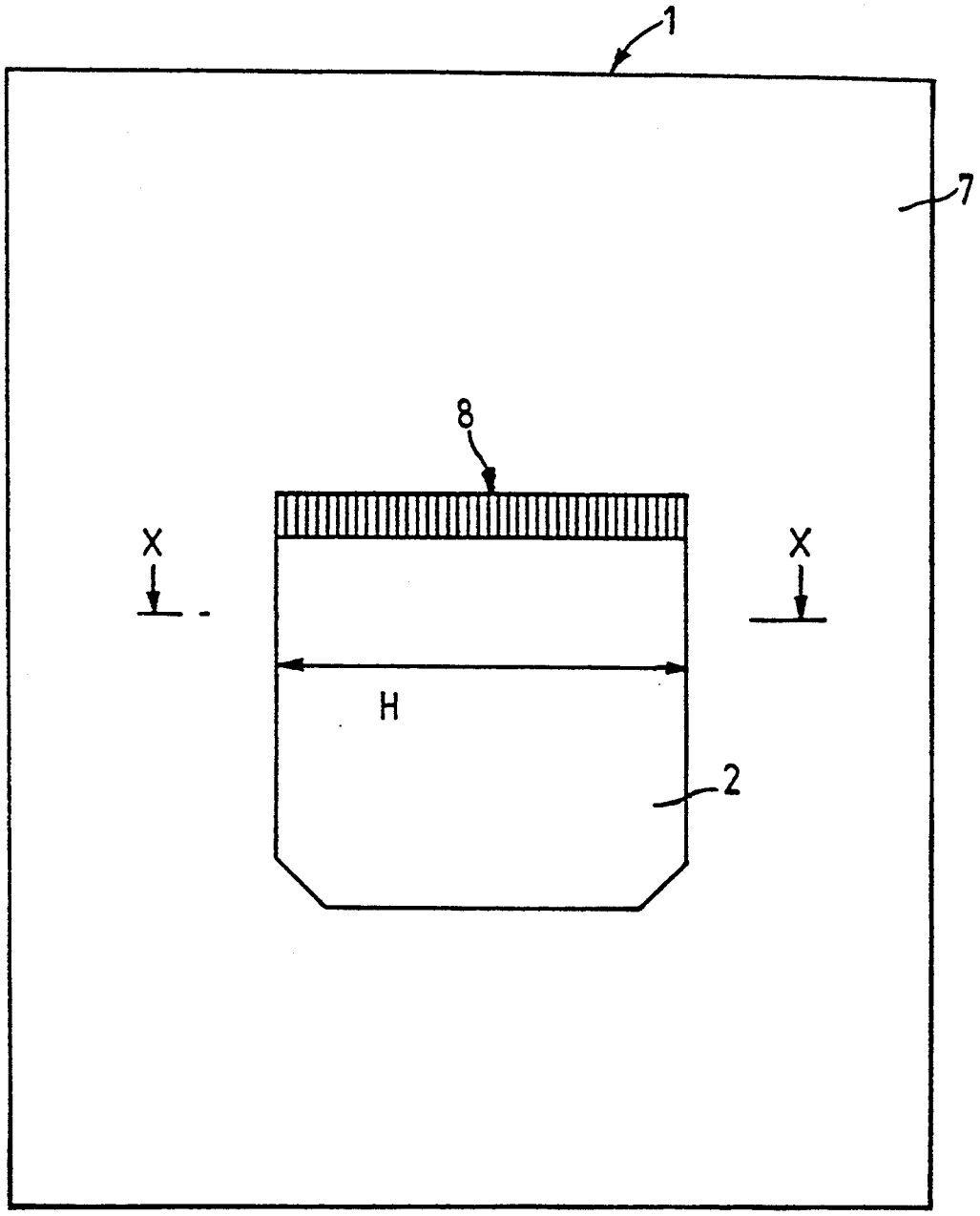
FIG. 1 schematically designates the front view of a knitted fabric available for composing part of a knit wear added with a pocket.

The first embodiment of the invention forms an additional pocket on local domain 1 of a knitted fabric which is supposed to be turned into a cardigan like the one shown in FIG. 1 for example. To implement the knitting operation, a flat knitting machine is made available, which is characteristically furnished with the conventionally called "four-piece needle beds" comprising two pairs of needle beds, where each pair of needle beds storing a number of knitting needles are disposed in opposition from each other in the "/\" like formation by way of causing each knitting needle to slidably move back and forth. These two pairs of needle beds are respectively disposed in the up and down locations.

Figure 2:
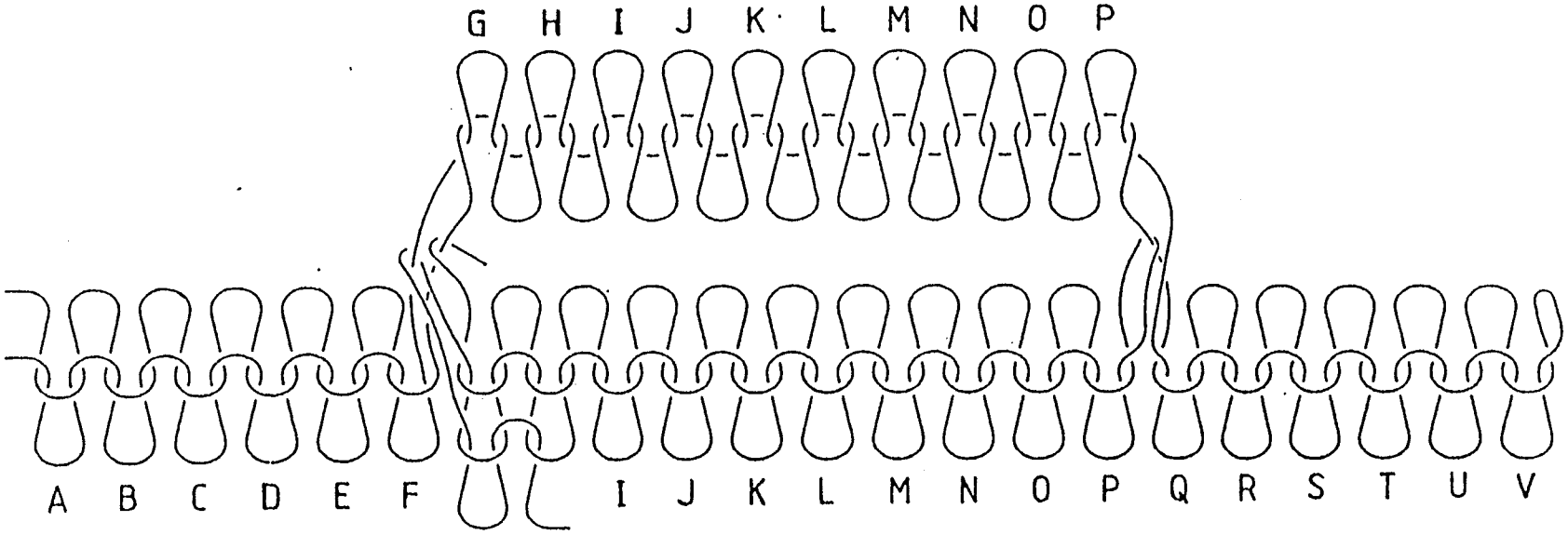
FIG. 2 is a cross-sectional view of the knitted fabric shown in FIG. 1 taken on line X through X.

FIG. 2 is a cross-sectional view of the knitted fabric taken on line X through X. FIG. 3 presents a chart explanatory of those symbols for designating knit composing courses shown in FIG. 4 on.

Figure 4:
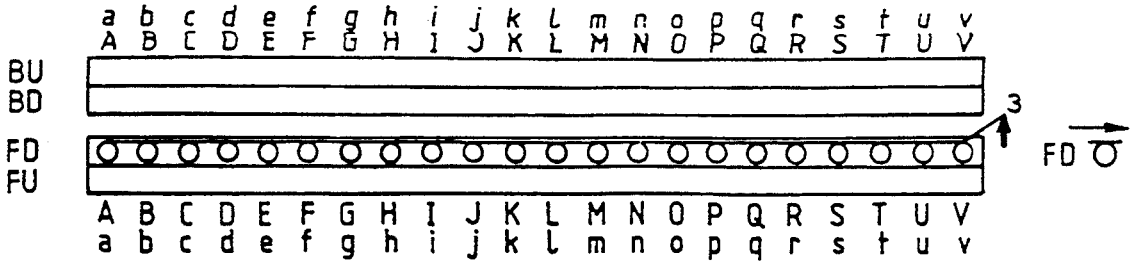
FIG. 4 through FIG. 88 are respectively explanatory of knit composing courses available for integrally forming a pocket with a body part according to the first embodiment of the invention.

The reference character FU shown to the left of the knitting courses in the accompanying drawings including FIG. 4 on designates a needle bed which is disposed on the top side of the front position. The reference character FD designates a needle bed which is disposed on the bottom side of the front position. The reference numeral BU designates a needle bed which is disposed on the top side of the rear position. The reference numeral BD designates a needle bed which is disposed on the bottom side of the rear position. Those arrowed directions shown to the right of the knitting courses indicate the loop knitting direction, in other words, the feeder moving direction. Functional operation of the flat knitting machine executing the method embodied by the invention is described below.

First, a feeder 3 is shifted to the right of the knitting course shown in FIG. 4. Next, when the feeder 3 is shifted to the left of the knitting course shown in FIG. 5, knitting yarns are supplied to those knitting needles A through V of the needle bed FD disposed on the bottom side of the front position, thus permitting these needles to form loops in the operated knitting courses.

Figure 5:
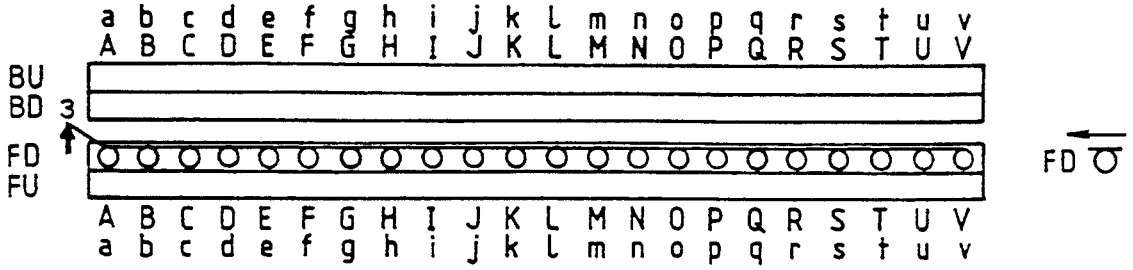

Those sequential knitting processes shown in FIGS. 4 and 5 are repeatedly executed in order to compose a front body knit domain 7 in the upward direction from the bottom.

Figure 6:
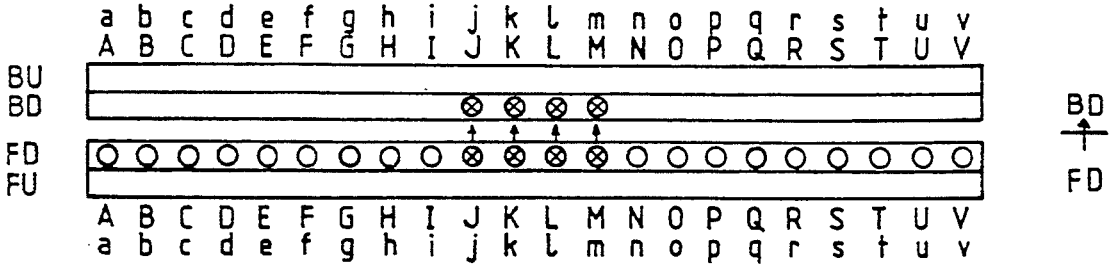

When knitting comes to a position at which the bottom of a pocket is formed, in FIG. 6, loops held on knitting needles J through M of the needle bed FD disposed on the bottom side of the front position are made to be held also on knitting needles J through M of the needle bed BD disposed on the bottom side of the rear position.

Figure 7:
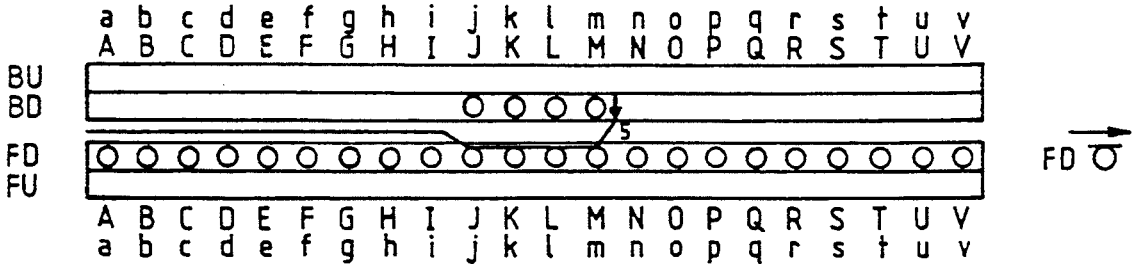
Figure 8:
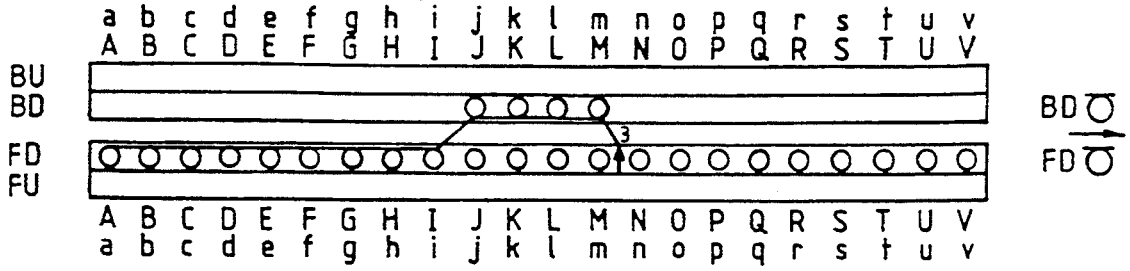

A predetermined number of loops are then formed on the way of a knitting process shown in FIG. 7 by feeding yarns to those knitting needles J through M of the needle bed FD and in FIG. 8, loops are formed on the knitting needles A through I of the needle bed FD and on the knitting needles J through M of the needle bed BD by feeding a yarn from the feeder 3.

Figure 9:
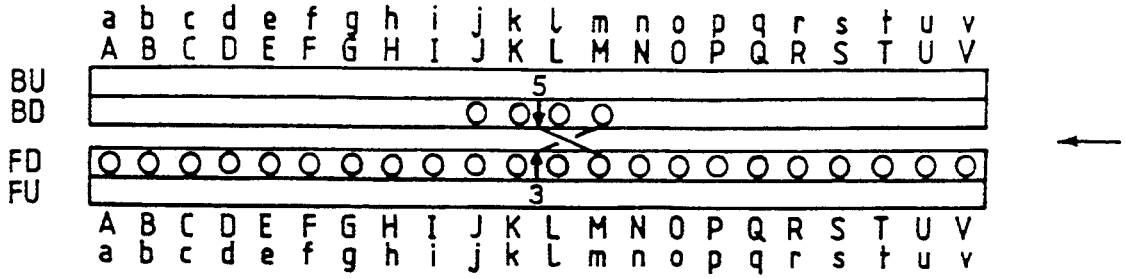
Figure 10:
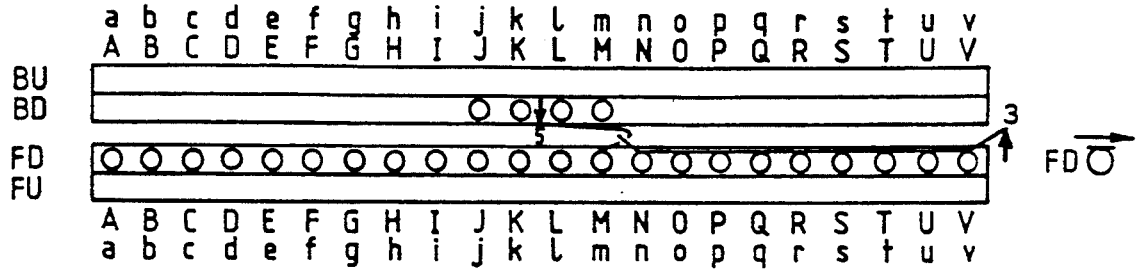
Figure 11:
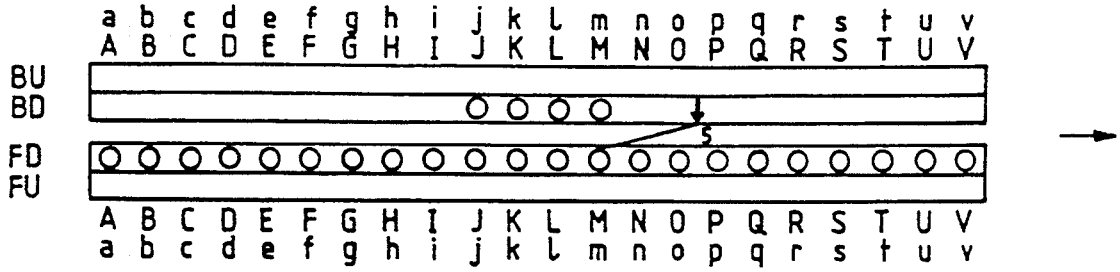

Next, a pair of yarn feeders 3 and 5 are respectively shifted to the left of the knitting course shown in FIG. 9 to cause the supplied yarns to intersect each other. Next, the feeder 3 is shifted to the right of the knitting course shown in FIG. 10, and then the feeder 5 is shifted to the right of the knitting course shown in FIG. 11.

Figure 12:
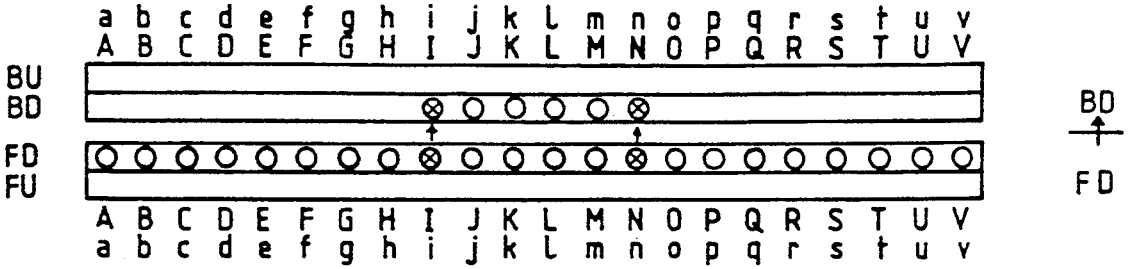

In FIG. 12 loops held on the knitting needles I and the knitting needle H of the needle bed FD disposed on the bottom side of the front position are made to be also held on the knitting needle I and the knitting needle H of the needle bed BD respectively.

Figure 13:
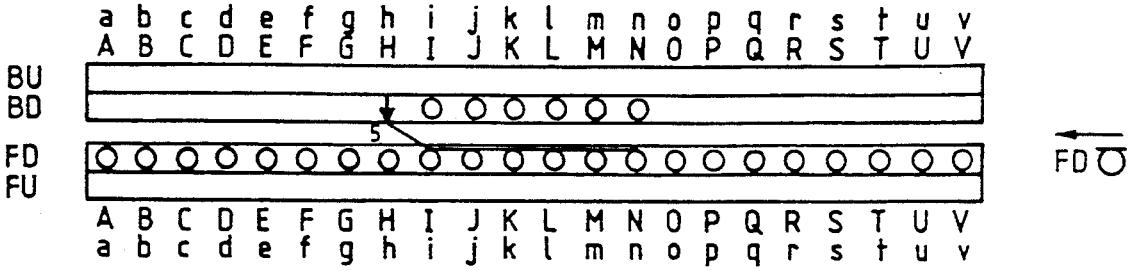
Figure 14:
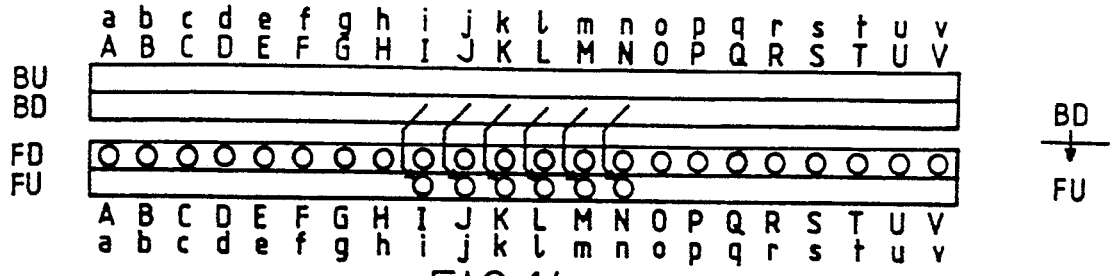

Next, when the knitting course shown in FIG. 13 is activated, a predetermined number of loops are formed by feeding knitting yarns from the feeder 5 to those knitting needles I through N of the needle bed FD. Next, when the knitting course shown in FIG. 14 is activated, those loops engaged with the knitting needles I through N of the needle bed BD are transferred to those corresponding knitting needles i through n of the needle bed FU disposed on the top side of the front front position.

Figure 15:
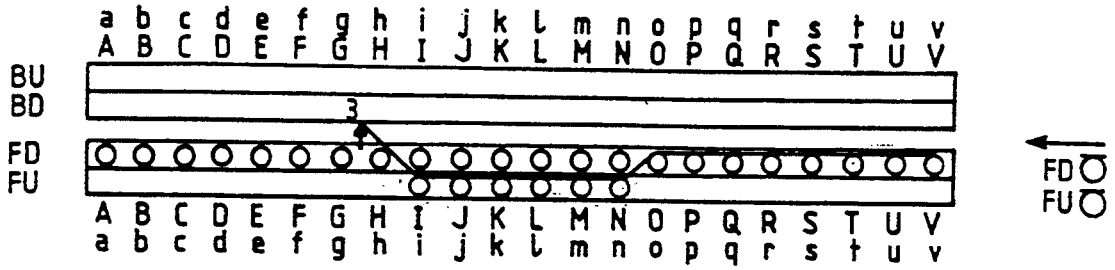
Figure 16:
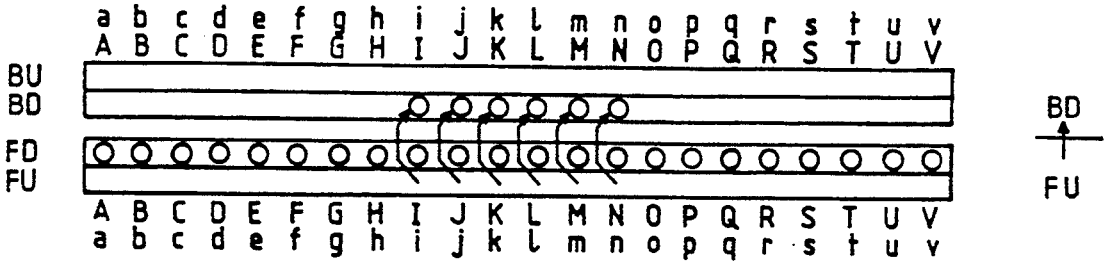

When the following knitting course shown in FIG. 15 is activated, the feeder 3 shifts itself to the left of the knitting course. This causes knitting yarns to be delivered to those knitting needles V through O of the needle bed FD and those knitting needles n through i of the needle bed FU, and as a result, loops are formed. Then, when the knitting course shown in FIG. 16 is activated, those loops engaged with the knitting needles i through n of the needle bed FU are transferred to those knitting needles I through N of the needle bed BD.

Figure 17:
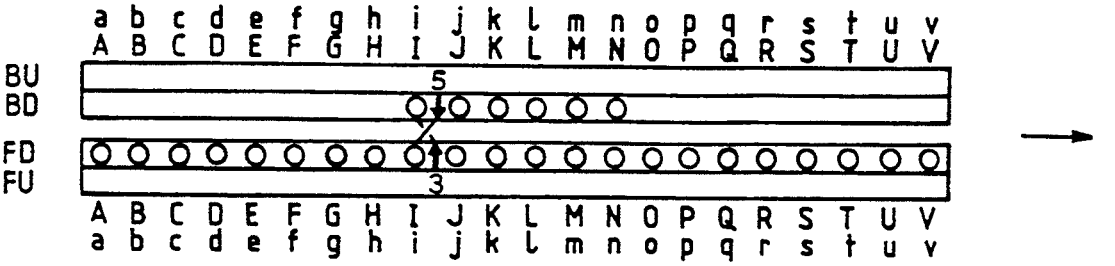
Figure 18:
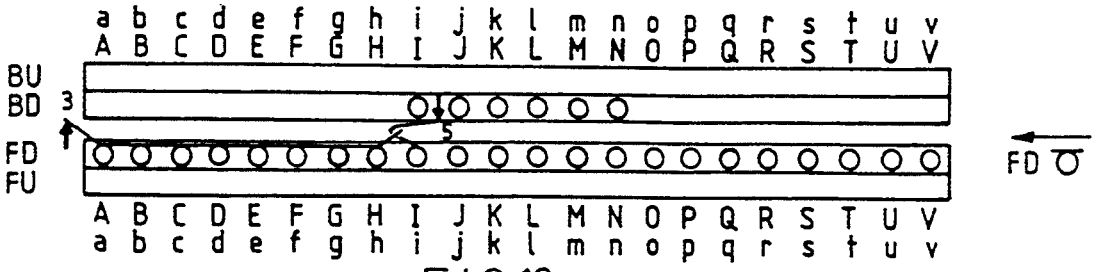
Figure 19:
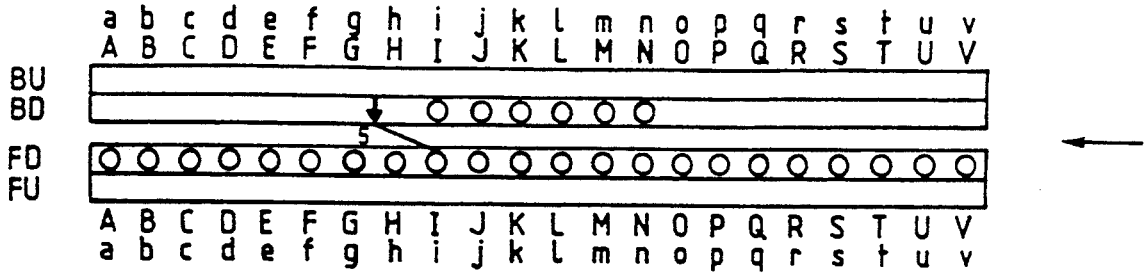
Figure 20:
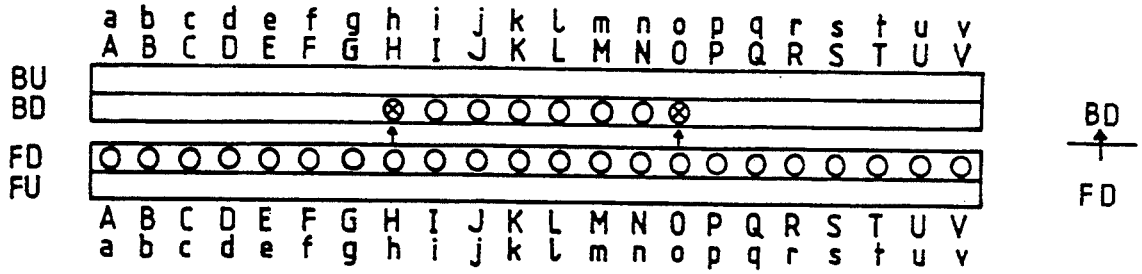
Figure 21:
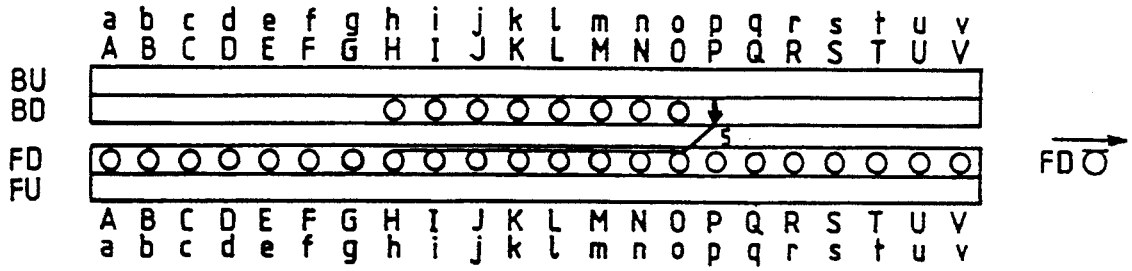
Figure 22:
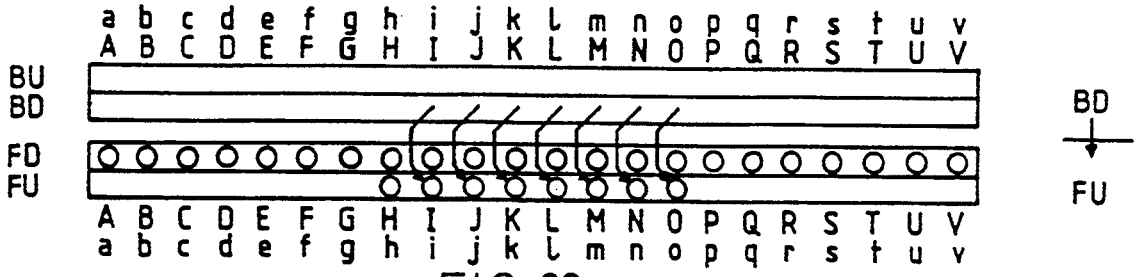

When the following knitting course shown in FIG. 17 is activated, the feeder 3 is transferred from the position shown in FIG. 15 to the right, and likewise, the other feeder 5 is also transferred from the position shown in FIG. 13 to the right to cause knitting yarns supplied to these feeders 3 and 5 to intersect with each other. Next, when the knitting course shown is FIG. 18 is activated, the feeder 3 is shifted to the left to cause those knitting needles H through A of the needle bed FD to respectively form loops. When the knitting course shown in FIG. 19 is activated, the feeder 5 is shifted to the left. Next, when the knitting course shown in FIG. 20 is activated, a "divisional increasing" process is again executed by engaging those loops engaged with the knitting needles H and O of the needle bed FD disposed on the bottom side of the front position after dividing these loops into those knitting needles H and O of the needle bed BD disposed on the bottom side of the rear position. Next, when the knitting course shown in FIG. 21 is activated, the feeder 5 feeds knitting yarns to those knitting needles H through O of the needle bed FD to form loops. Next, when the knitting course shown in FIG. 22 is activated, those loops engaged with the knitting needles H through O of the needle bed BD are respectively transferred to those corresponding knitting needles h through o of the needle bed FU.

Figure 23:
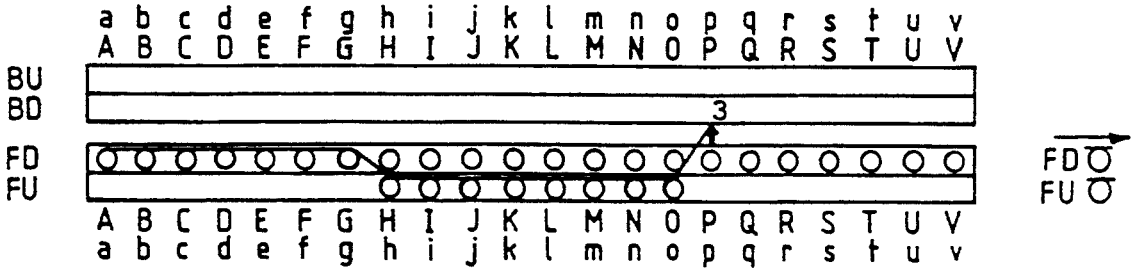
Figure 24:
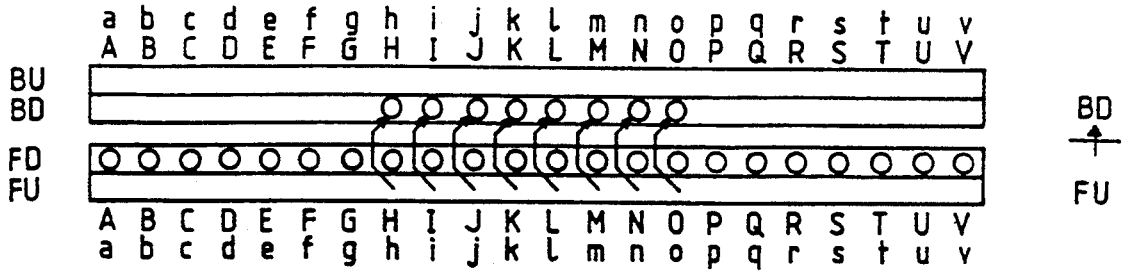

Next, when the knitting course shown in FIG. 23 is activated, the feeder 3 is shifted to the left to cause knitting yarns to respectively be delivered to those knitting needles A through G of the needle bed FD and those knitting needles h through o of the needle bed FU to form loops. Next, when the knitting course shown in FIG. 24 is activated, those loops engaged with the knitting needles h through o of the needle bed FU are respectively transferred to those corresponding knitting needles H through O of the needle bed BD.

Figure 25:
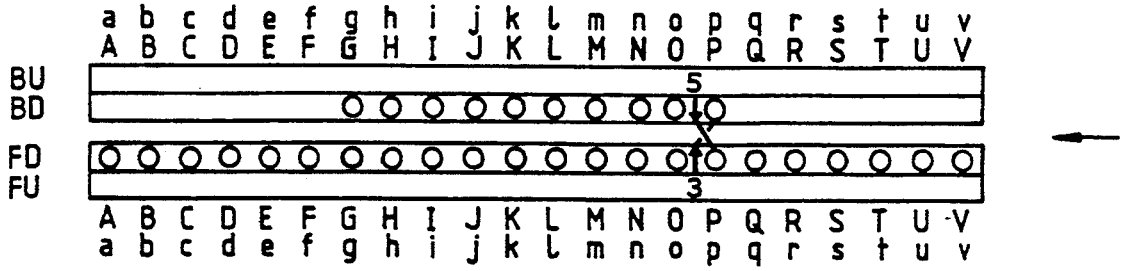
Figure 26:
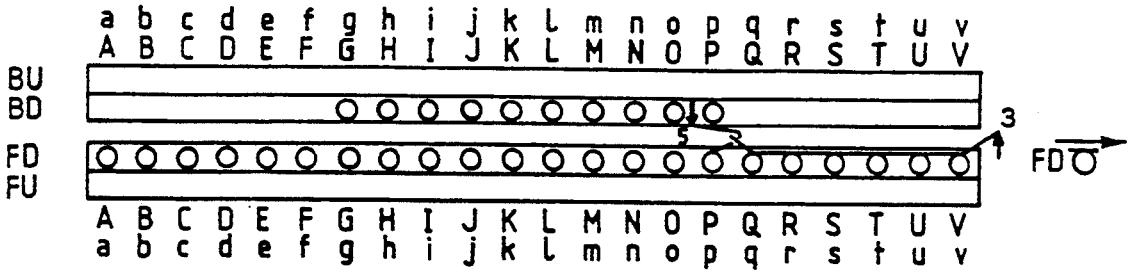
Figure 27:
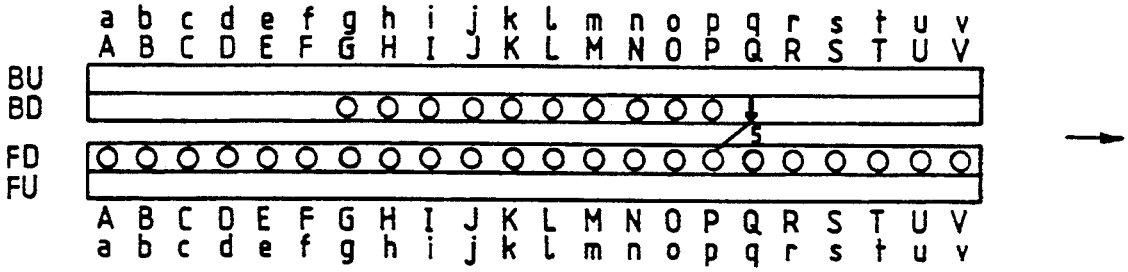

The flat knitting machine related to the invention repeatedly executes those knitting courses shown in FIG. 12 through FIG. 19 and FIG. 20 through FIG. 27 before eventually expanding the width of the pocket 2 to a predetermined range of width H corresponding to the width between the needle G and the needle P of the needle bed BD shown in FIG. 25 for example. While the knitting mode shown in FIG. 25 is present, initially, the feeder 3 is shifted to the left from the state shown in FIG. 23, and likewise, the other feeder 5 is also shifted to the left from the state shown in FIG. 21 to cause knitting yarns engaged with these feeders 3 and 5 to intersect with each other. Next, when the knitting course shown in FIG. 26 is activated, the feeder 3 is shifted to the right to cause those knitting needles Q through V of the needle bed FD to respectively form loops. When the knitting course shown in FIG. 27 is activated, the feeder 5 is shifted to the right.

Figure 28:
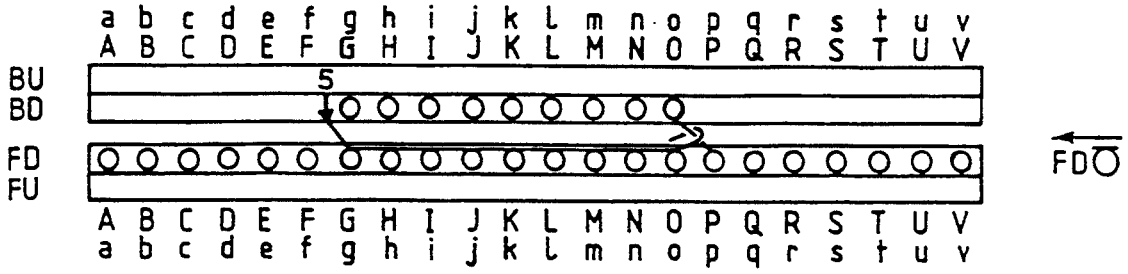
Figure 29:
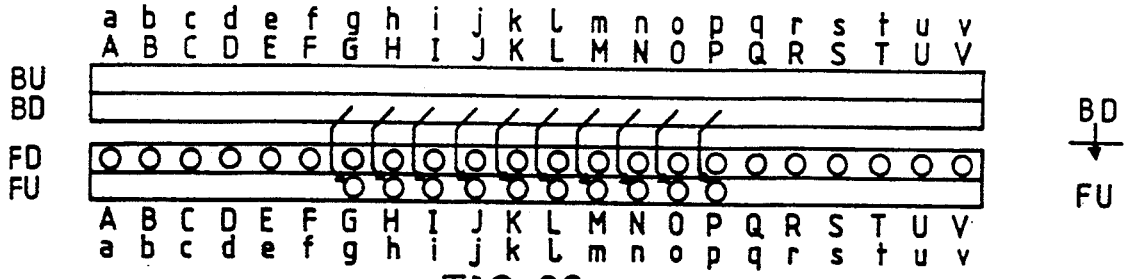
Figure 30:
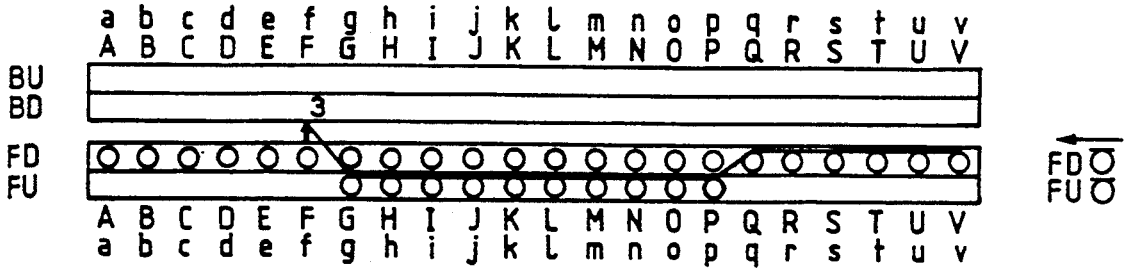

When the knitting course shown in FIG. 28 is activated, the feeder 5 is shifted to the left to feed knitting yarns to those knitting needles P through G of the needle bed FD to feed loops. Next, when the knitting course shown in FIG. 29 is activated, those loops engaged with the knitting needles H through O of the needle bed BD are respectively transferred to those knitting needles g through p of the needle bed FU. When the following knitting course shown in FIG. 30 is activated, the feeder 3 feeds knitting yarns to those knitting needles g through p of the needle bed FU to have them form loops.

Figure 31:
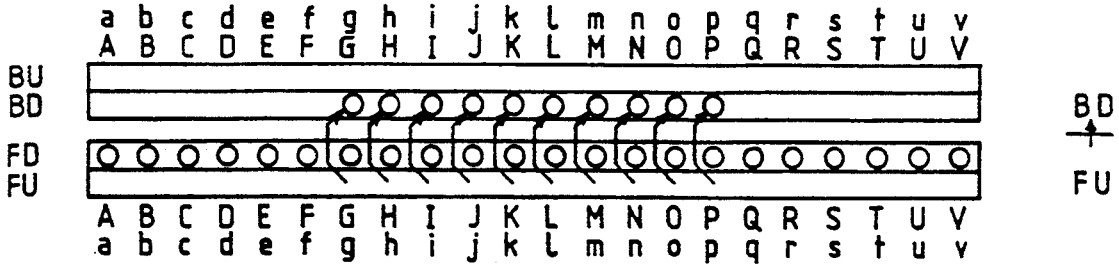
Figure 32:
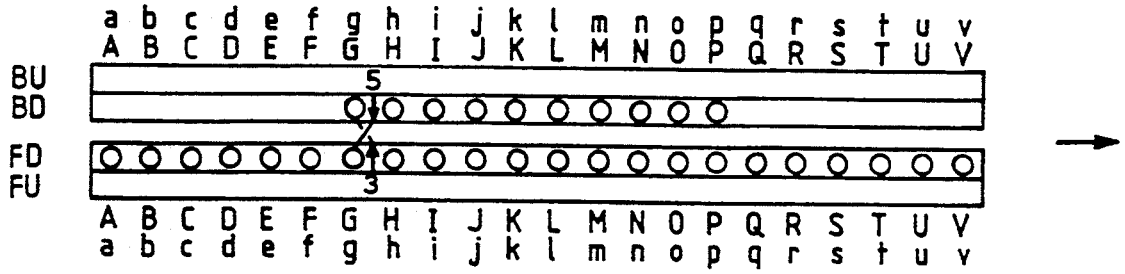
Figure 33:
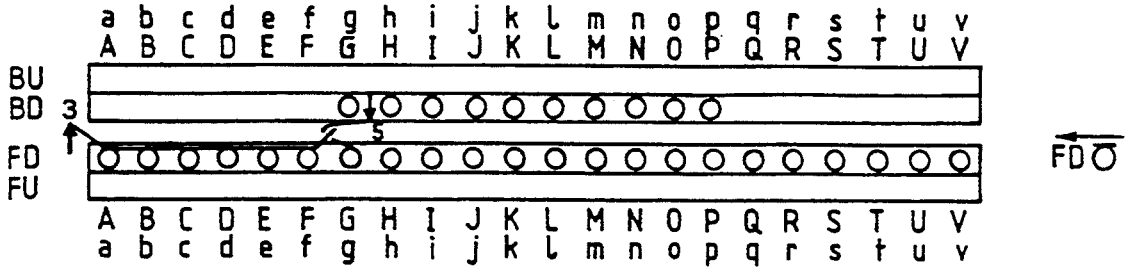
Figure 34:
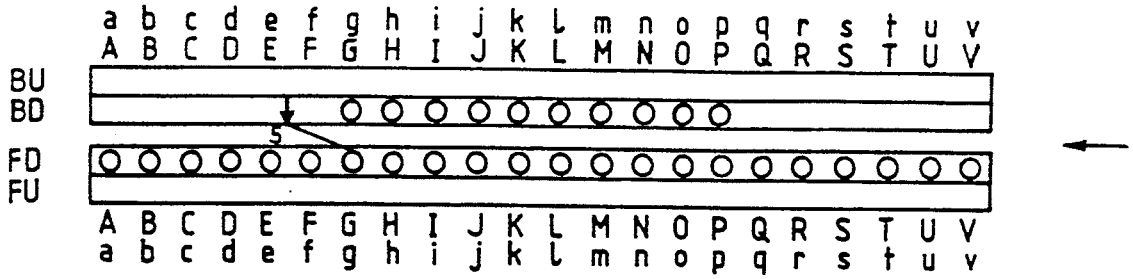

Next, when the knitting course shown in FIG. 31 is activated, those loops formed with yarns fed from the feeder 4 and engaged with those knitting needles g through p of the needle bed FU are respectively transferred to those corresponding knitting needles G through P of the needle bed BD. When the knitting mode shown in FIG. 32 is entered, the feeder 3 is shifted from the state shown in FIG. 30 to the right, and likewise, the feeder 5 is shifted from the state shown in FIG. 28 to the right to cause those yarns fed from these feeders 3 and 5 to intersect each other. When the knitting course shown in FIG. 33 is activated, the feeder 3 is shifted to the left to feed knitting yarns to those knitting needles F through A of the needle bed FD to have them respectively form loops. When the knitting course shown in FIG. 34 is activated, the feeder 5 is shifted to the left.

Figure 35:
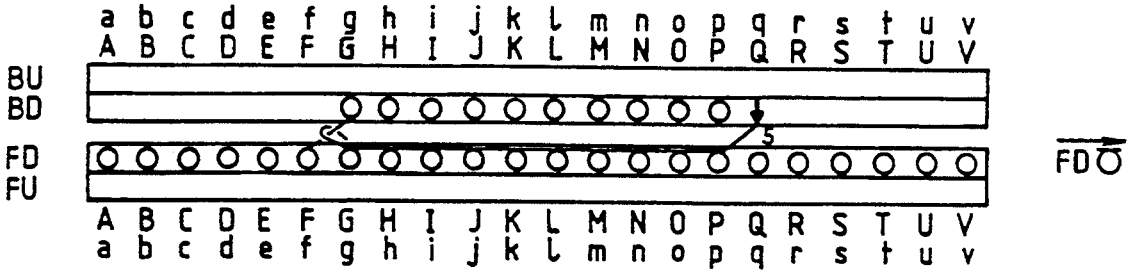
Figure 36:
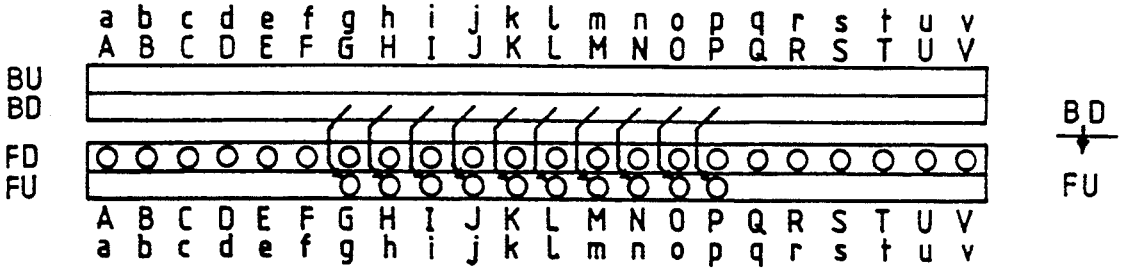
Figure 37:
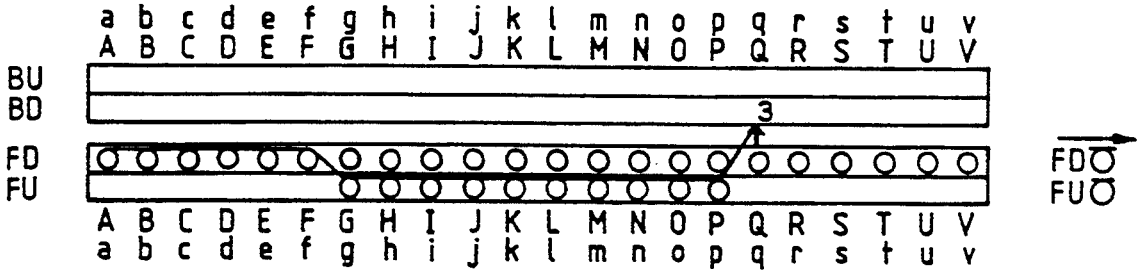
Figure 38:
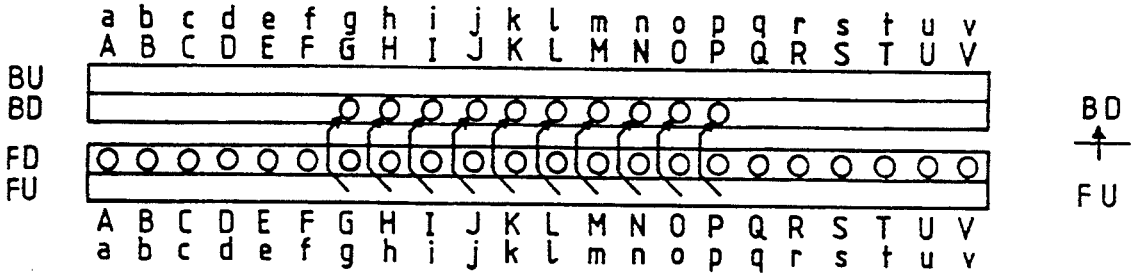
Figure 39:
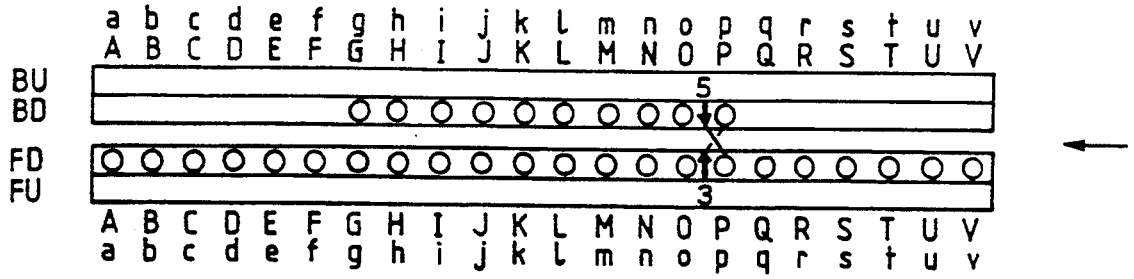
Figure 40:
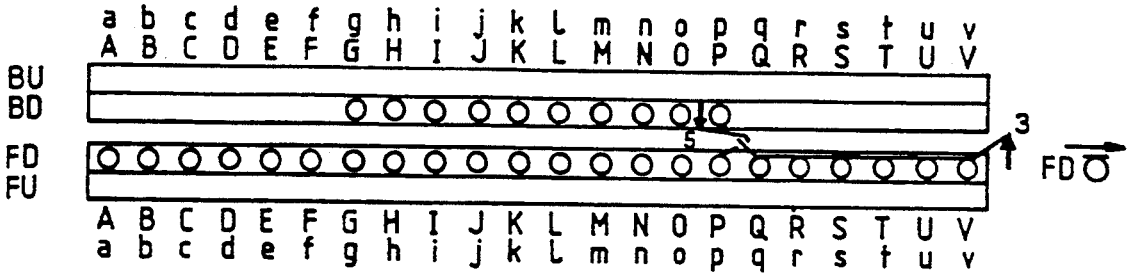
Figure 41:
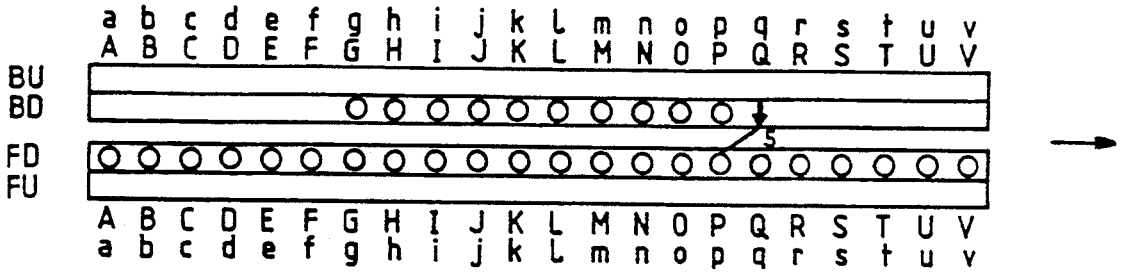

Next, when the knitting course shown in FIG. 38 is activated, those loops engaged with the knitting needles g through p are respectively transferred to those knitting needles G through P of the needle bed BD. When the knitting course shown in FIG. 39 is activated, the feeder 3 is shifted from the state shown in FIG. 37 to the left, and likewise, the other feeder 5 is also shifted from the state shown in FIG. 35 to the left to cause those yarns fed from these feeders 3 and 5 to intersect each other. Next, when the knitting course shown in FIG. 4 is activated, the feeder 3 is shifted to the right to feed knitting yarns to those knitting needles Q through V of the needle bed FD to have them respectively form loops. When the knitting course shown in FIG. 40 is activated, the feeder 5 is shifted to the right.

Figure 42:
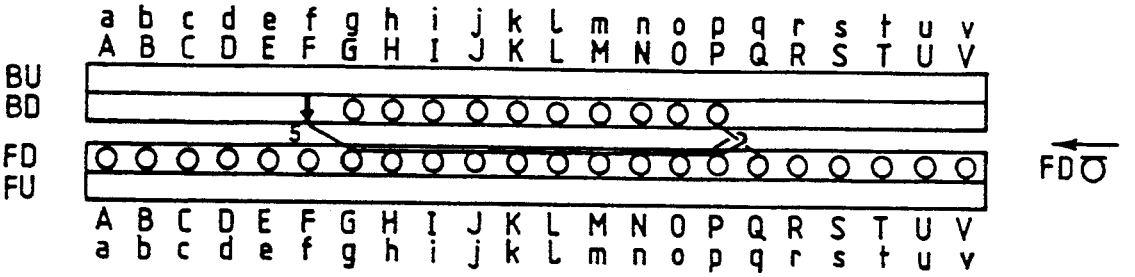
Figure 43:
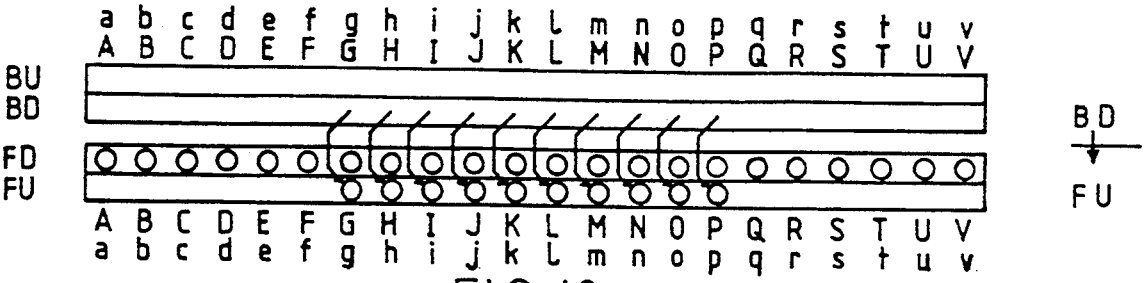

Next, when the knitting course shown in FIG. 42 is activated, the feeder 5 is shifted to the left to feed knitting yarns to those knitting needles P through G of the needle bed FD to have them respectively form loops. Next, when the knitting course shown in FIG. 43 is activated, those loops engaged with the knitting needles G through P of the needle bed BD are respectively transferred to those knitting needles q through p of the needle bed FU. Next, when the knitting course shown in FIG. 44 is activated, the feeder 3 feeds knitting yarns to the knitting needles g through p of the needle bed FU to have them respectively form loops.

Figure 45:
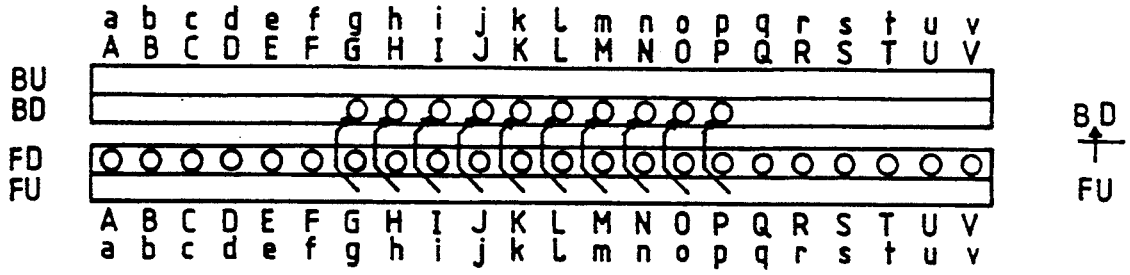

Next, when the knitting course shown in FIG. 45 is activated, those loops engaged with the knitting needles g through p of the needle bed FU are respectively transferred to those knitting needles G through P of the needle bed BD.

The flat knitting machine related to the invention repeatedly executes those knitting courses shown in FIG. 32 through FIG. 45 before eventually composing straight portion of a pocket. It should be understood that, as indicated by "Y" and "Z" shown in FIG. 2, lateral edges on both sides are linked with each other in the state in which knitting yarns intersect each other in connection with the front body knit domain 7.

Figure 44:
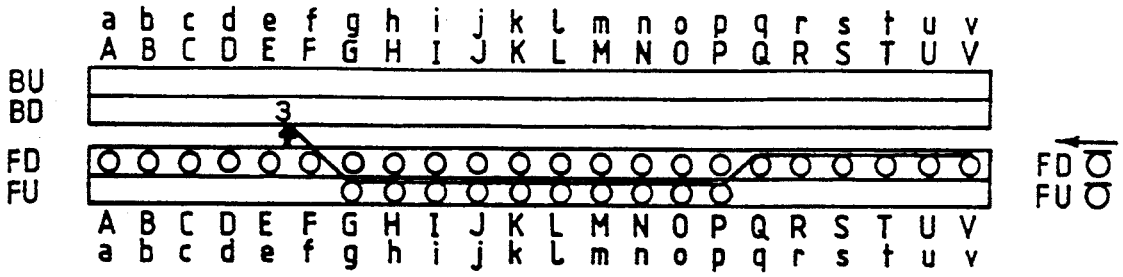
Figure 46:
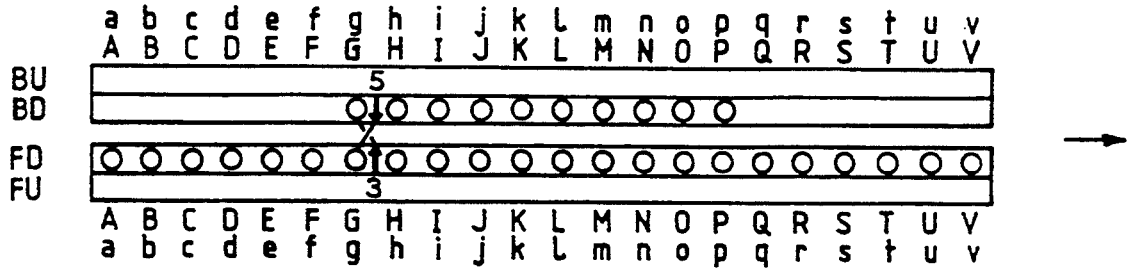
Figure 47:
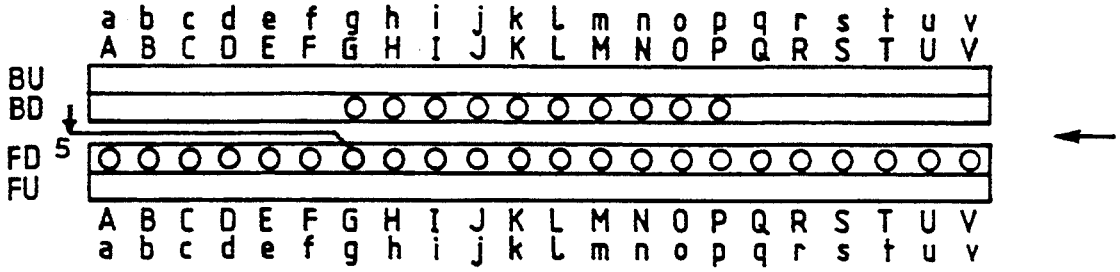
Figure 48:
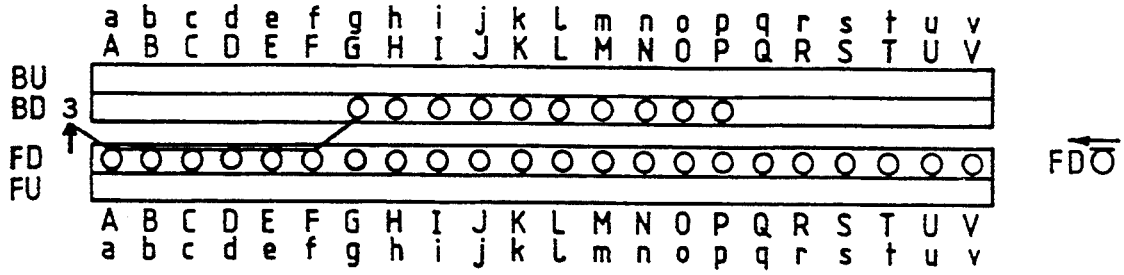

When the knitting mode shown in FIG. 46 is entered, the feeder 3 is shifted from the state shown in FIG. 44 to the right, and then, the feeder 5 is also shifted from the state shown in FIG. 42 to the right to cause knitting yarns fed from these feeders 3 and 5 to intersect each other. Next, when the knitting mode shown in FIG. 47 is entered, the feeder 5 is shifted to the left before externally being placed. In the same way, when the knitting mode shown in FIG. 48 is entered, the other feeder 3 also feeds knitting yarns to the knitting needles F through A of the needle bed FD, and then, while forming loops, the feeder 3 is also placed outside of the knitting course.

Figure 49:
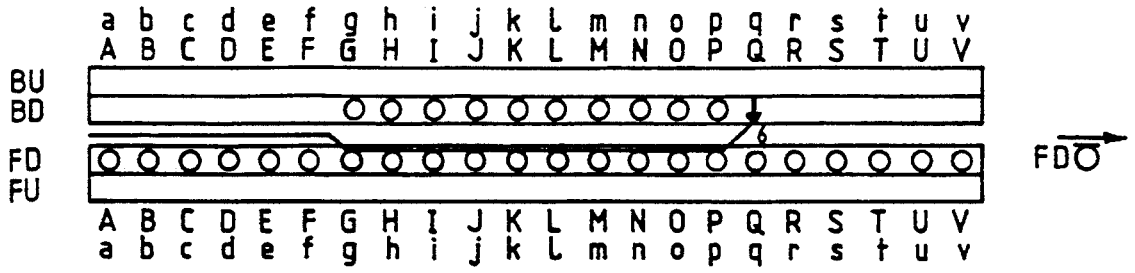

Next, when the knitting course shown in FIG. 49 is activated, another feeder 6 is introduced in order to feed specific yarns for reinforcing the aperture region 8 of the pocket 2, and then loops are respectively formed by those knitting yarns G through P of the needle bed FD with the supplied reinforcing yarns. It should be understood that the formation of the loops with the reinforcing yarns shown in FIG. 49 can be deleted.

FIGS. 50 through 67 respectively designate those knitting courses available for the formation of rib knitting structure respectively composing the aperture 8 of the pocket 2.

Figure 50:
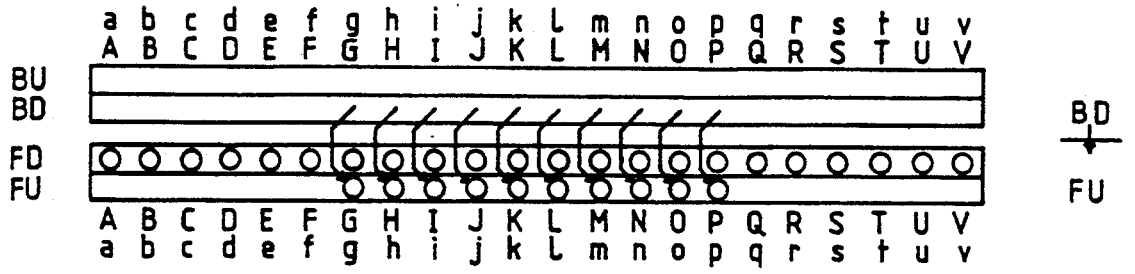
Figure 51:
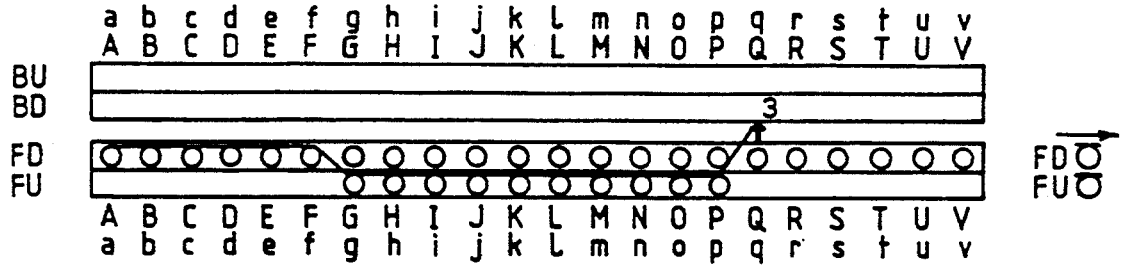

Concretely, when the knitting course shown in FIG. 50 is activated, those loops engaged with the knitting needles G through P of the needle bed BD shown in FIG. 49 are respectively transferred to those knitting needles g through p of the needle bed FU, and then, when the knitting course shown in FIG. 51 is activated, the feeder 3 feeds knitting yarns to those knitting needles A through F of the needle bed FD and those knitting needles g through p of the needle bed FU to have them respectively form loops.

Figure 52:
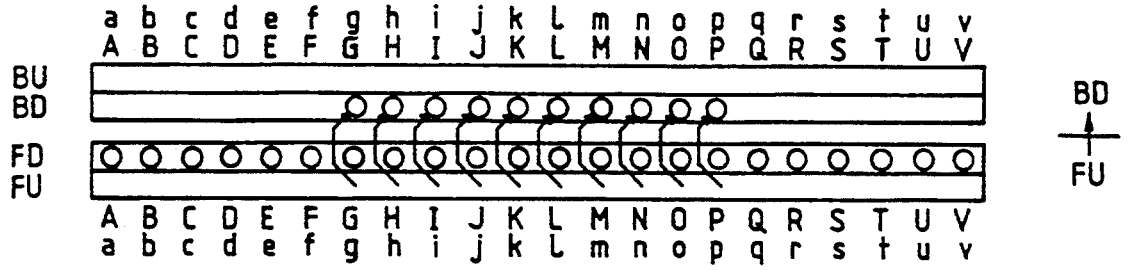
Figure 53:
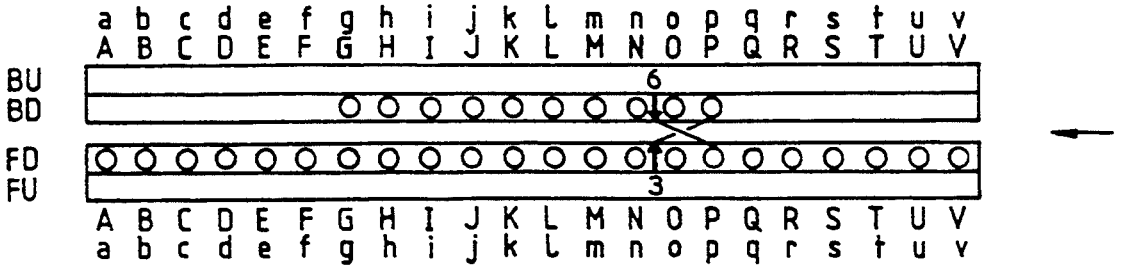

Next, when the knitting course shown in FIG. 52 is activated, those loops engaged with the knitting needles g through p of the needle bed FU are respectively transferred to those knitting needles G through P of the needle bed BD. When the knitting course shown in FIG. 53 is activated, the feeder 3 is shifted from the state shown in FIG. 51 to the left, and then the above-identified feeder 6 is shifted from the state shown in FIG. 49 to the left to cause those yarns fed from respective feeders to intersect each other.

Figure 54:
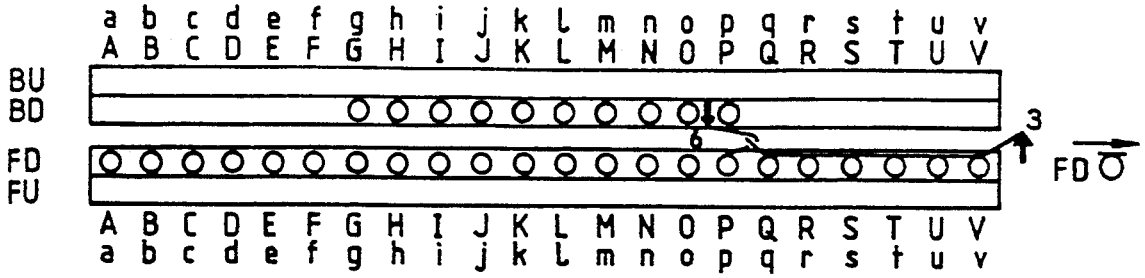
Figure 55:
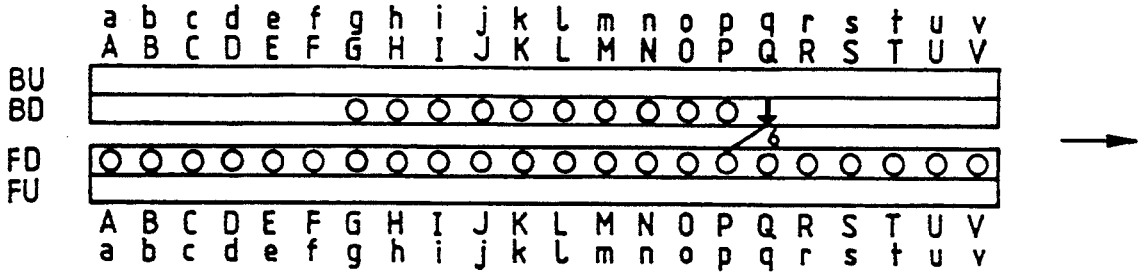
Figure 56:
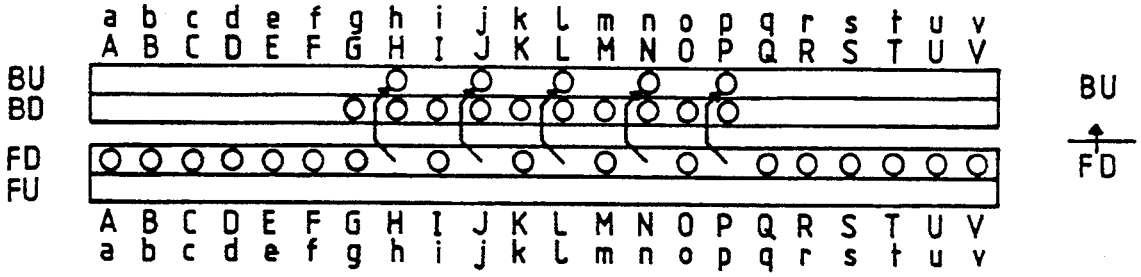
Figure 57:
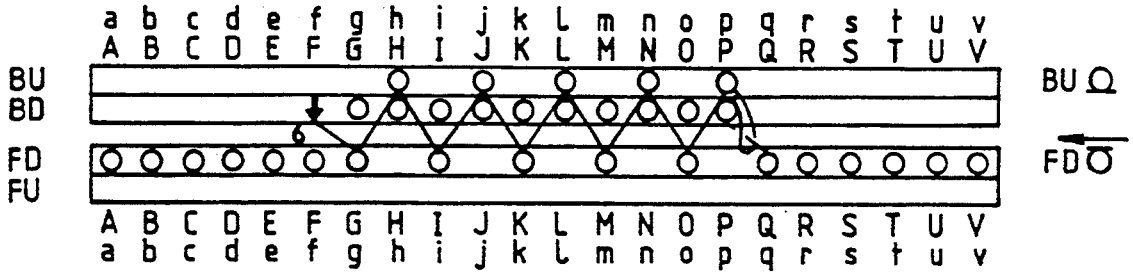

Next, when the knitting course shown in FIG. 54 is activated, the feeder 3 is shifted to the right to feed knitting yarns to those knitting needles Q through V of the needle bed FD to have them respectively form loops. Next, when the knitting course shown in FIG. 55 is activated, the feeder 6 is shifted to the right. Next, when the knitting course shown in FIG. 56 is activated, those loops engaged with those knitting needles H, J, L, N, and P of the needle bed FD solely available for composing the knit for making up a pocket are respectively transferred to those knitting-needles h, j, n, and p pf the needle bed BU. Next, when the knitting course shown in FIG. 57 is activated, the feeder 6 feeds reinforcing yarns to those knitting needles G, I, K, M, and O remaining in the needle bed FD and those knitting needles h, j, n, and p of the needle bed BU to have these needles to respectively form rib-kniting loops.

Figure 58:
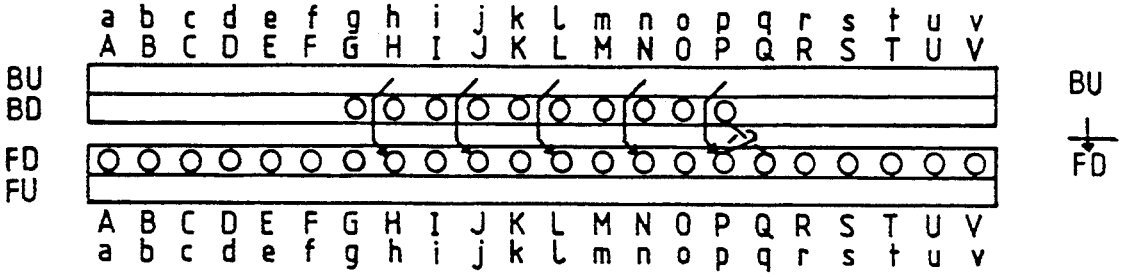
Figure 59:
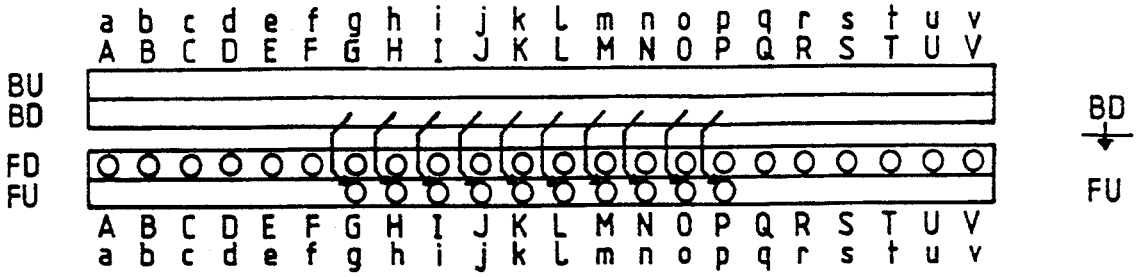
Figure 60:
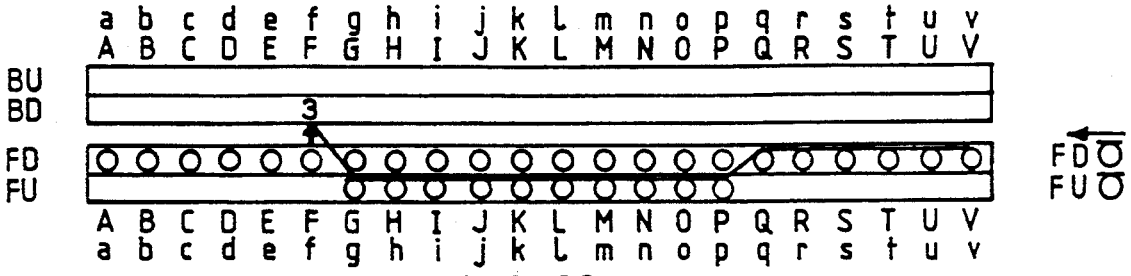

Next, when the knitting course shown in FIG. 58 is activated, those loops engaged with the knitting needles h, j, n, and p of the needle bed BU are respectively transferred to those knitting needles H, J, L, N, and P of the needle bed FD. When the knitting course shown in FIG. 59 is activated, those loops engaged with the knitting needles G through P of the needle bed BD are respectively transferred to those knitting needles g through p of the needle bed FU. Next, when the knitting course shown in FIG. 60 is activated, the feeder 6 feeds reinforcing yarns to those knitting needles g through p of the needle bed FU to have them to respectively form loops.

Figure 61:
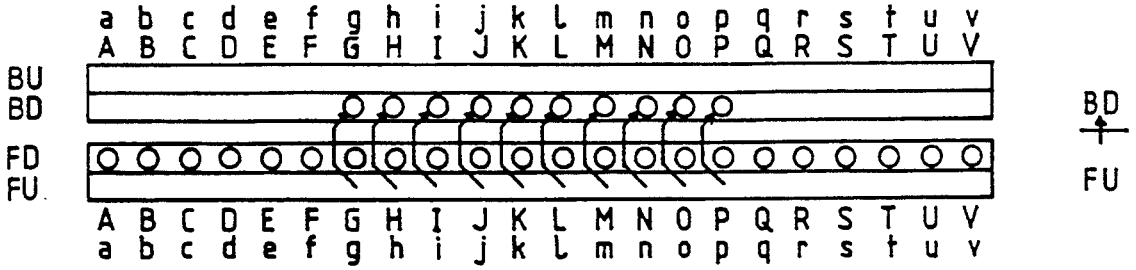
Figure 62:
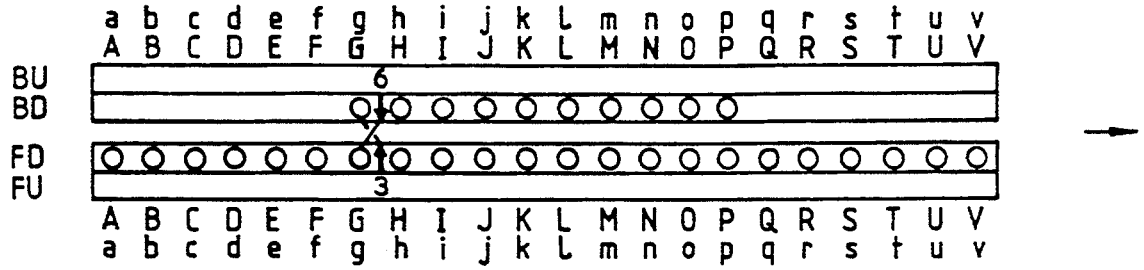

When the knitting course shown in FIG. 61 is activated, those loops engaged with the knitting needles g through p of the needle bed FU are respectively transferred to those knitting needles G through P of the needle bed BD. When the knitting course shown in FIG. 62 is activated, the feeder 3 is shifted from the state shown in FIG. 60 to the right, and then, the feeder 6 is also shifted from the state shown in FIG. 57 to the right to cause knitting yarns fed from these feeders 3 and 6 to intersect each other. Next, when the knitting course shown in FIG. 63 is entered, the feeder 3 feeds knitting yarns to those knitting needles A through F of the needle bed FD to have these needles respectively form loops.

Figure 63:
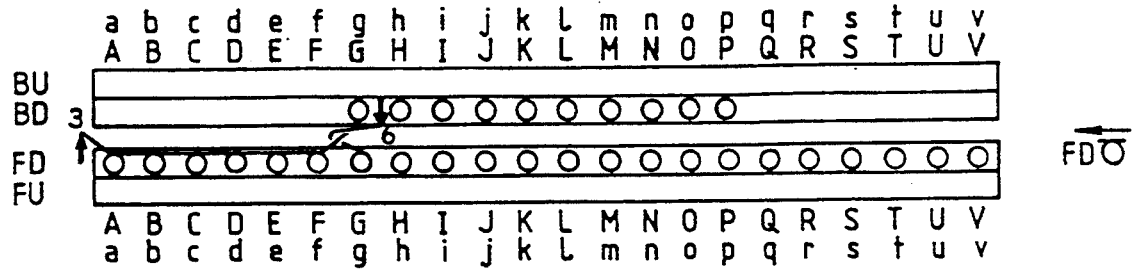
Figure 64:
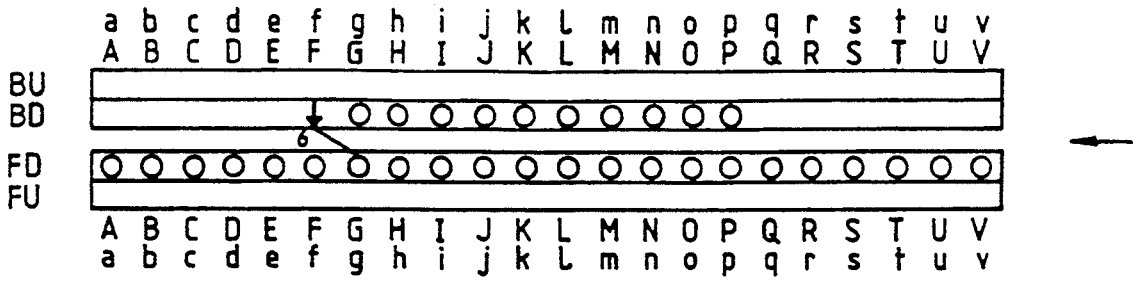
Figure 65:
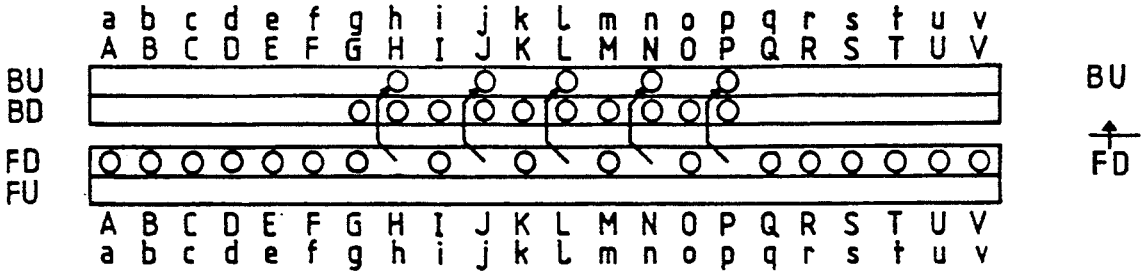

Next, when the knitting course shown in FIG. 64 is activated, the feeder 6 is shifted from the state shown in FIG. 63 to the left. Next, when the knitting course shown in FIG. 65 is activated, those loops engaged with those knitting needles H, J, L, N, and P of the needle bed FD are respectively transferred to those knitting needles h, j, n, and p of the needle bed BU, and then, the feeder 6 feeds reinforcing yarns to those knitting needles G, I, K, M, and O, and those knitting needles h, j, n, and p, of both needle beds FD and BU remained inoperative in the knitting process shown in FIG. 57, thus having these knitting needles to respectively form rib-knitting loops. Next, when the knitting course shown in FIG. 67 is activated, those loops engaged with the knitting needles G through P of the needle bed BD are respectively transferred to those knitting needles g through p of the needle bed FU. As a result of the repeated execution of those knitting processes shown in FIGS. 50 through 67, the flat knitting machine related to the invention securely forms rib-knit of the predetermined length in the periophery of the aperture 8 of the pocket 2.

As shown in FIGS. 58 and 67, edge portions on both sides of the rib-knit in the periphery of the aperture 8 of the pocket 2 are integrally composed in the state in which twined yarns are integrally linked with the body-part knit.

Figure 68:
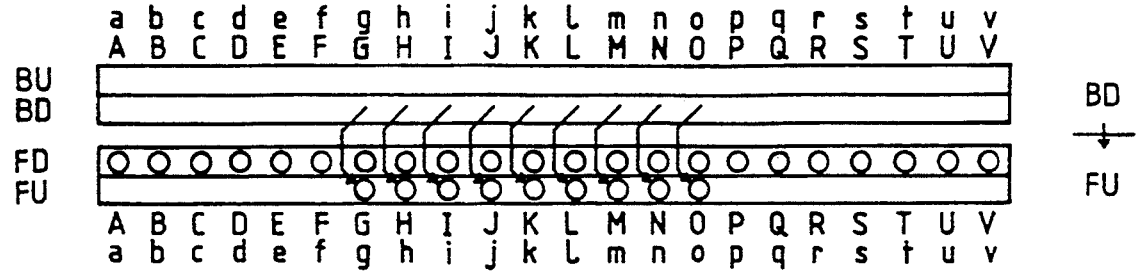
Figure 69:
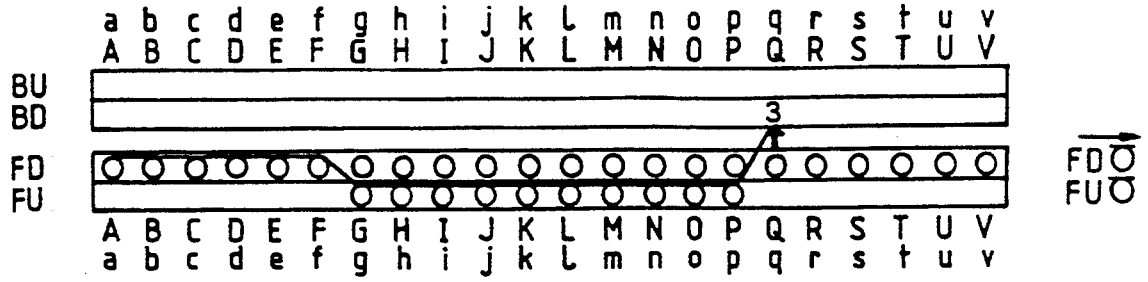

Those figures including FIG. 68 on respectively designate the knitting courses for processing edges of the aperture of the formed pocket. When the knitting mode shown in FIG. 68 is entered, those loops enagged with the knitting needles G through P of the needle bed BD are respectively transferred to those knitting needles g through p of the needle bed FU. Next, when the knitting mode shown in FIG. 69 is entered, the feeder 3 feeds knitting yarns to those knitting needles A through F of the needle bed FD and those knitting needles g through p of the needle bed FU to have these needles respectively form loops.

Figure 70:
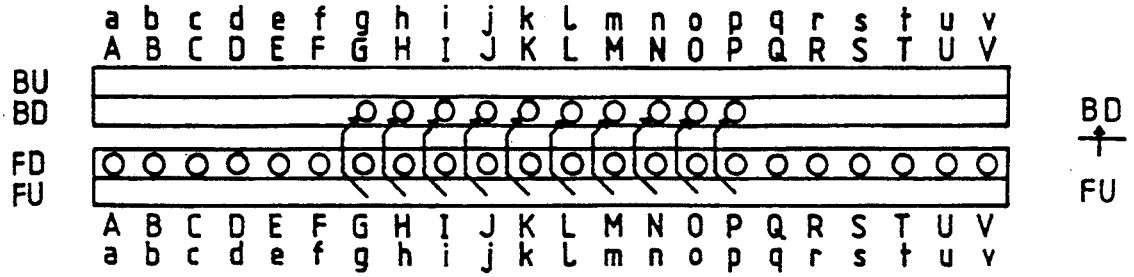
Figure 71:
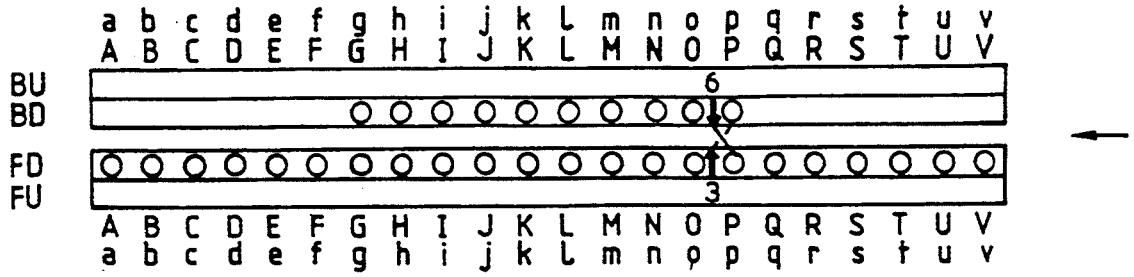
Figure 72:
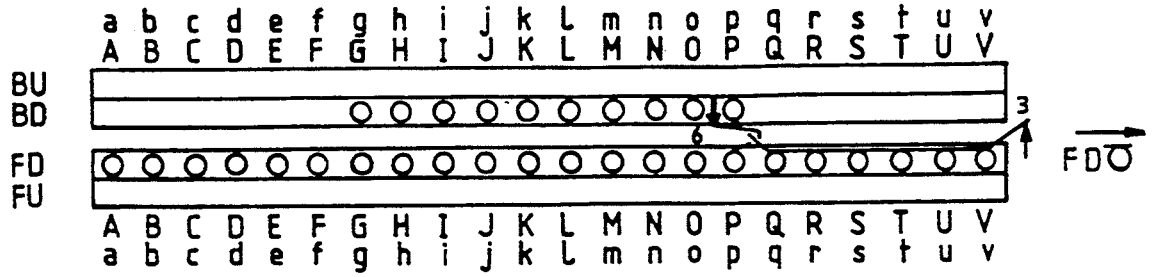

When the knitting course shown in FIG. 70 is activated, those loops engaged with the knitting needles g through p of the needle bed FU are respectively transferred to those knitting needles G through P of the needle bed BD. Next, when the knitting course shown in FIG. 71 is activated, the feeder 3 is shifted from the state shown in FIG. 69 to the left, and then, the feeder 6 is also shifted from the state shown in FIG. 66 to the left to cause those yarns fed from these feeders 3 and 6 to intersect each other. Next, when the knitting course shown in FIG. 72 is activated, the feeder 3 feeds knitting yarns to those knitting needles Q through V of the needle bed FD to have these needles respectively form loops.

Figure 66:
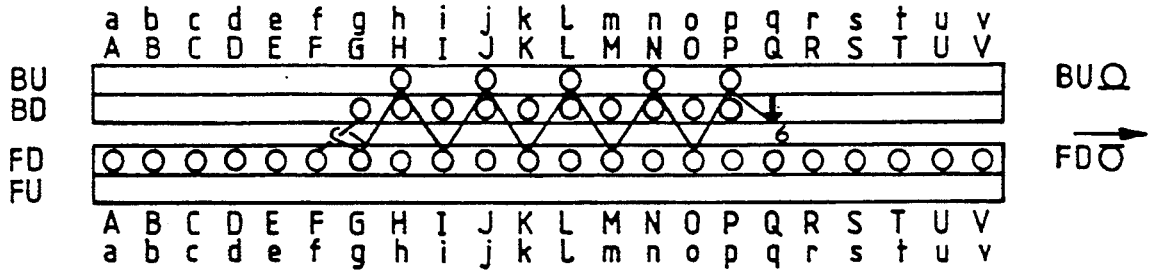
Figure 67:
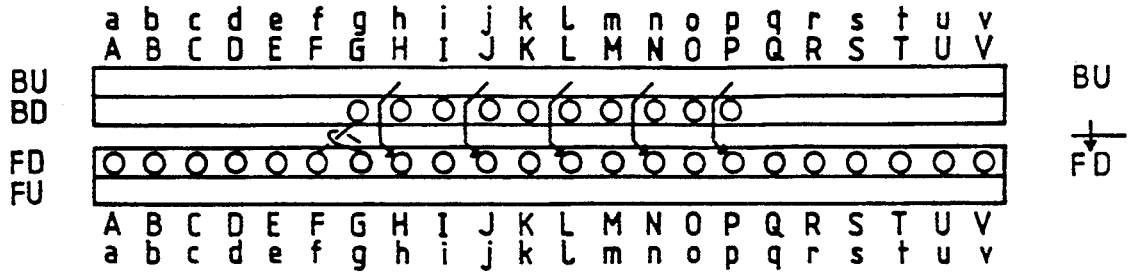
Figure 73:
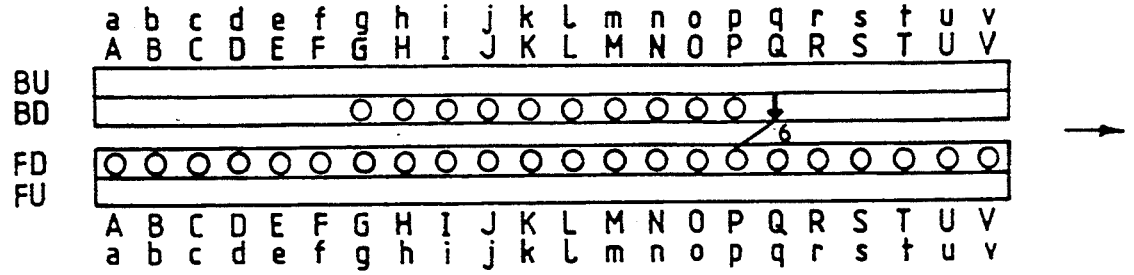
Figure 74:
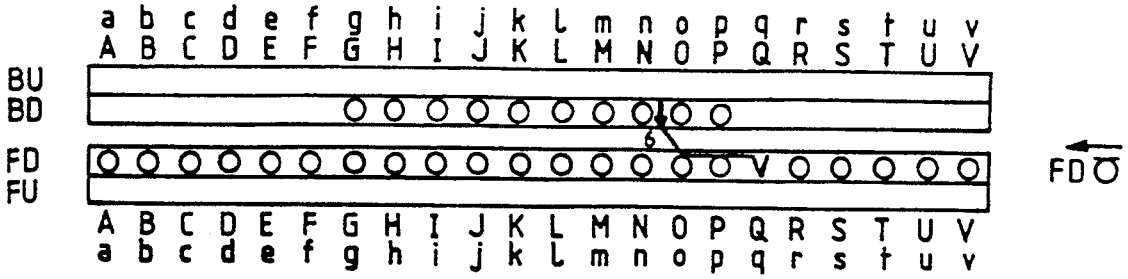
Figure 75:
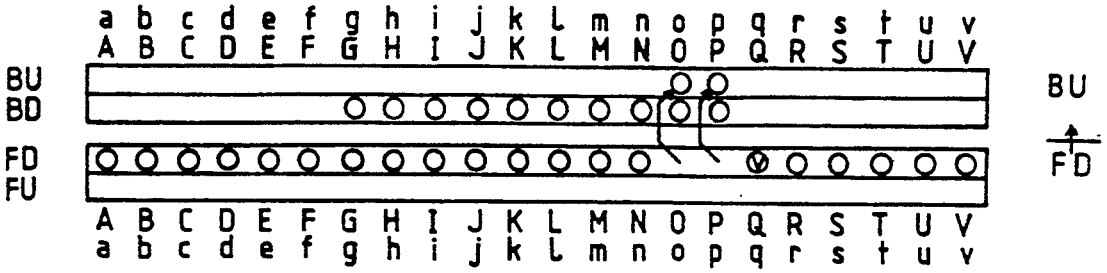

When the knitting course shown in FIG. 73 is activated, the feeder 6 is shifted from the state shown in FIG. 66 to the right. Next, when the knitting course shown in FIG. 74 is activated, the feeder 6 feeds knitting yarns to the knitting needles P and O of the needle bed FD in the state in which the supplied yarns are tacked by means of the needle Q of the needle bed FD, and then causes these needles P and O to respectively form loops before eventually transferring those loops engaged with the needles P and O of the needle bed FD to those knitting needles o and p of the needle bed BU.

Figure 76:
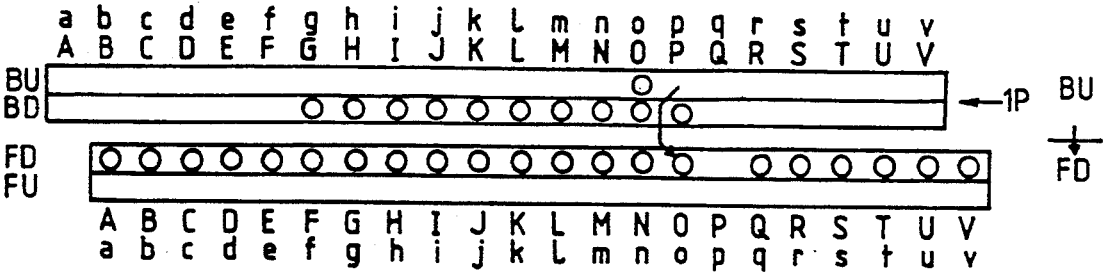
Figure 77:
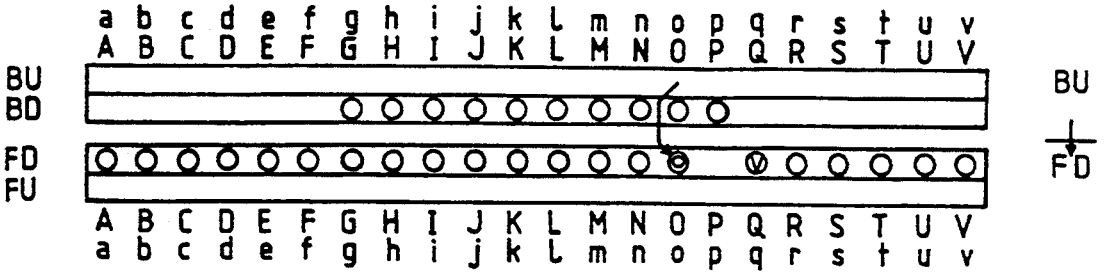

Next, when the knitting course shown in FIG. 76 is activated, those needle beds BU and BD in the rear position are respectively shifted to the left by one pitch, and then; the loop engaged with the knitting needle p of the needle bed BU is transferred to the knitting needle O of the needle bed FD. Next, when the knitting course shown in FIG. 77 is activated, those needle beds BU and BD are respectively shifted to the right to be back to the reference position, and then the loop engaged with the knitting needle o of the needle bed BU is transferred to the knitting needle O of the needle bed FD. In consequence, a pair of loops are engaged with the knitting needle O of the needle bed FD.

Figure 78:
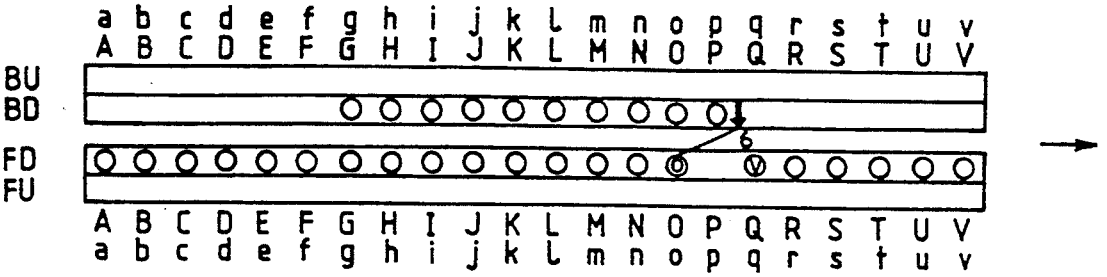
Figure 79:
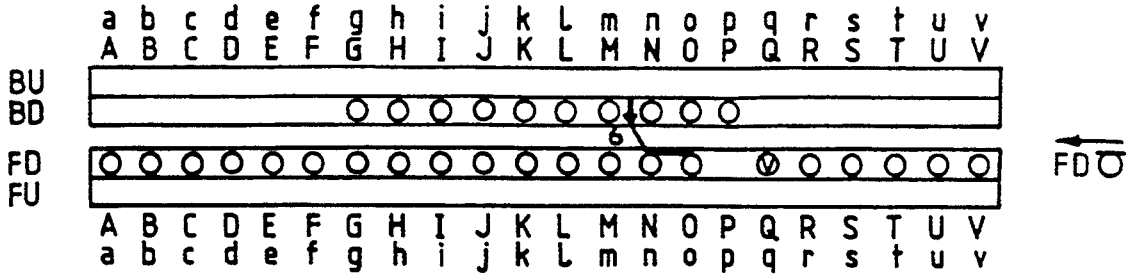

Next, when the knitting course shown in FIG. 78 is activated, the feeder 6 is shifted to the right. When the following knitting course shown in FIG. 79 is activated, the feeder 6 feeds knitting yarns to those knitting needles N and O of the needle bed FD to have them respectively form loops.

Figure 80:
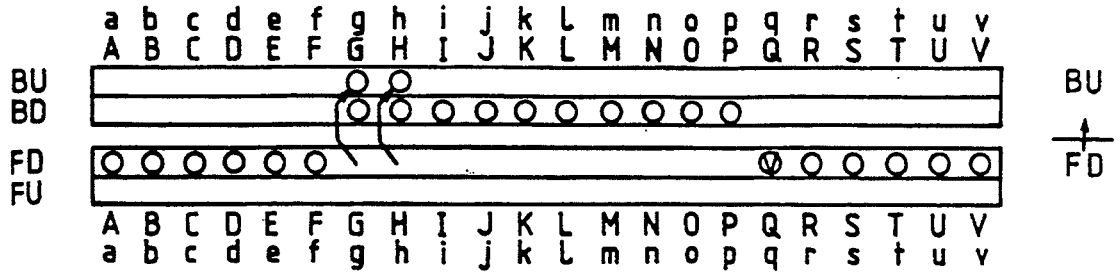
Figure 81:
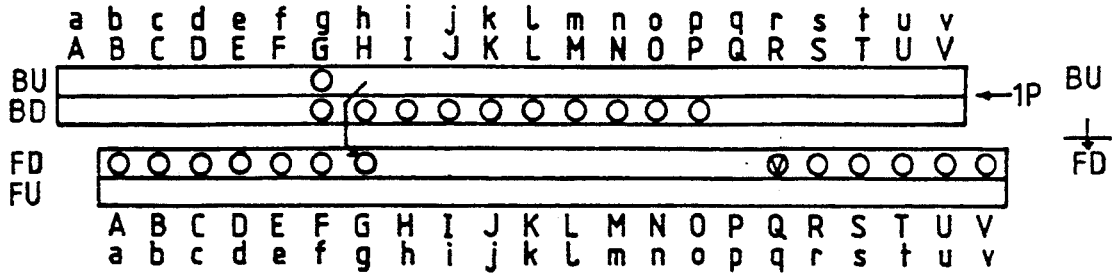
Figure 82:
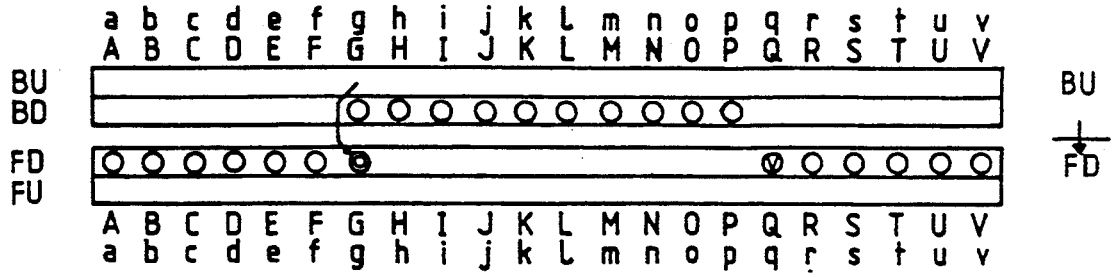

Next, when the knitting course shown in FIG. 80 is activated, those loops engaged with the knitting needles G and H of the needle bed FD are respectively transferred to those knitting needles g and h of the needle bed BU. Next, when the knitting course shown in FIG. 81 is activated, initially, those needle beds BU and BD in the rear position are respectively shifted to the left by one pitch, and then the loop engaged with the knitting needle h of the needle bed BU is transferred to the knitting needle G of the needle bed FD. In consequence, a pair of loops are conjunctionally engaged with the knitting needle G of the needle bed FD.

Figure 83:
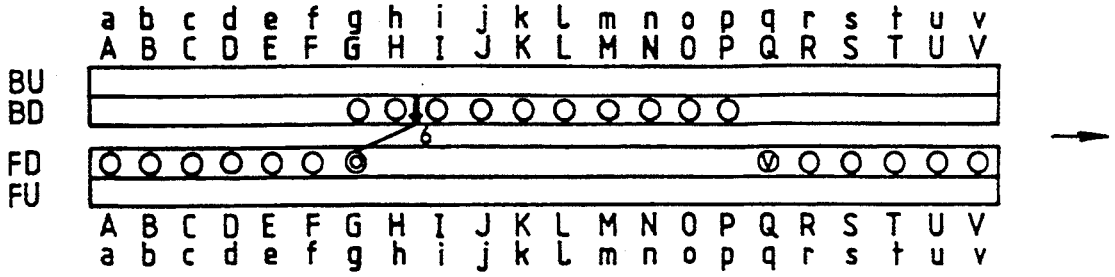
Figure 84:
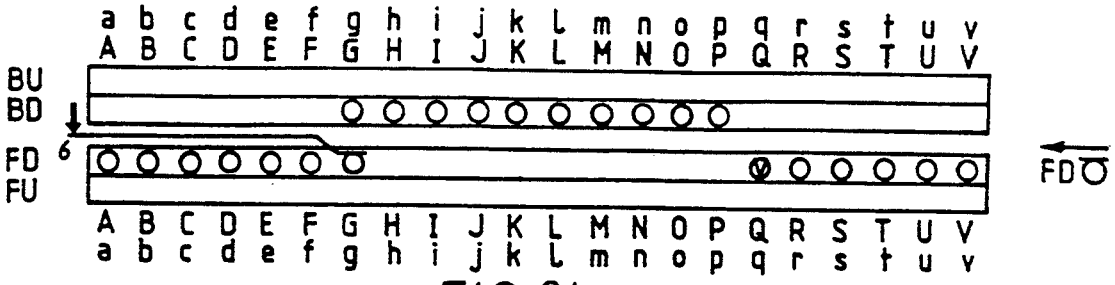

When the following knitting course shown in FIG. 83 is activated, the feeder 6 is shifted to the right once, and then, when the following knitting mode shown in FIG. 84 is entered, the feeder 6 feeds knitting yarn to the needle G of the needle bed FD to form a loop, and then the feeder 6 is shifted to the left before externally being placed.

Figure 85:
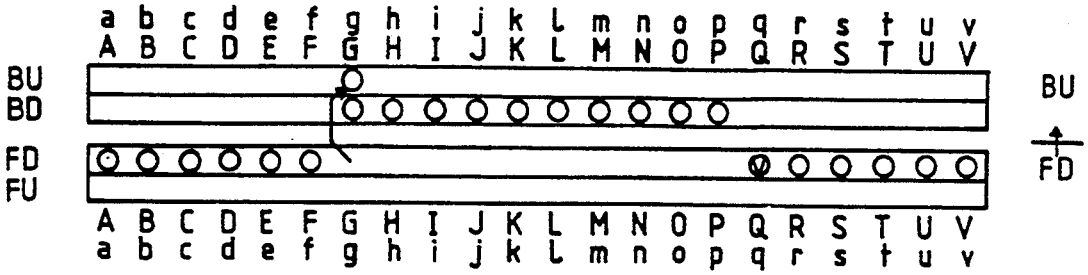
Figure 86:
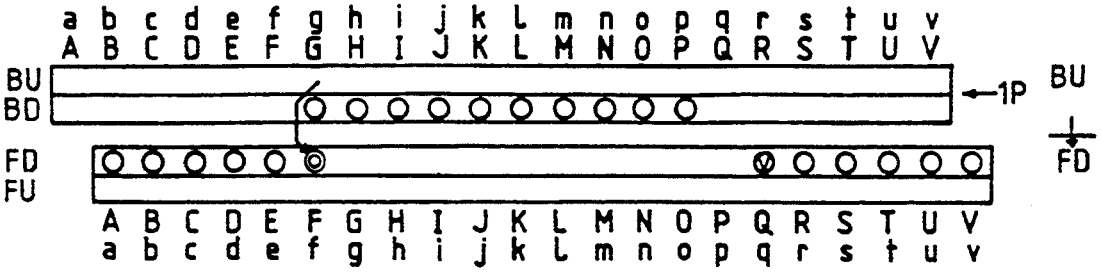

When the knitting course shown in FIG. 85 is activated, the loop engaged with the knitting needle G of the needle bed FD is transferred to the knitting needle g of the needle bed BU. Next, the knitting course shown in in FIG. 86 is activated, in which those needle beds BU and BD in the rear position are respectively shifted to the left by one pitch, and then the loop engaged with the knitting needle g of the needle bed BU is transferred to the knitting needle F of the needle bed FD. In consequence a pair of loops are engaged with the knitting needle F of the needle bed FD.

Figure 87:
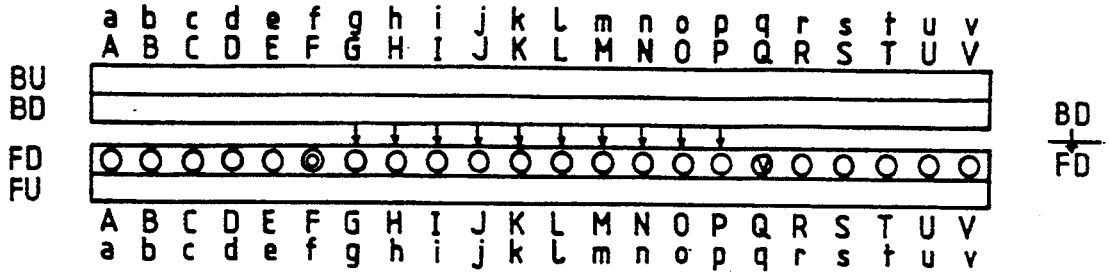
Figure 88:
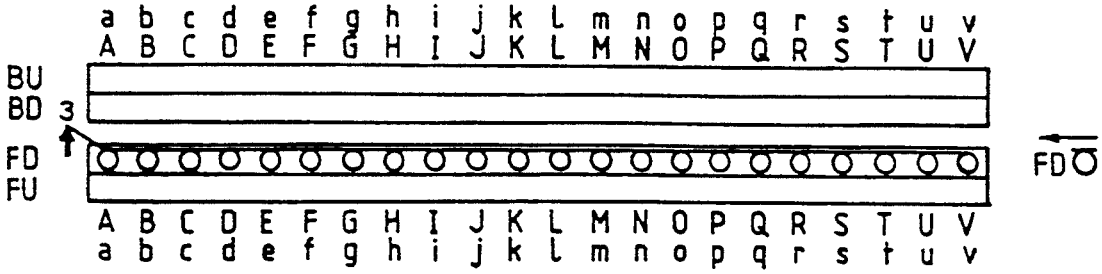

Next, when the knitting course shown in FIG. 87 is activated, those needle beds BU and BD in the rear position are respectively shifted to the right by one pitch. Next, when the knitting course shown in FIG. 88 is activated, the feeder 3 feeds knitting yarns to those knitting needles V through A of the needle bed BD to have them respectively form loops. This in turn permits the rib-knitted yarns along the edges on both sides of the aperture of the pocket to twist up themselves in combination with the body-part knit as shown in those knitting courses shown in FIGS. 57 and 58.

After that, the knitting course in FIG. 88 is repeated to form the front-body knitting portion 7. In this way, the same knit organization as the front-body knitting portion 7 appears on a surface of the pocket 2, thus the pocket provides a voluminous appearance.

The Second Embodiment

As described earlier, the flat knitting machine made available for executing the first embodiment of the invention disposes a plurality of needle beds each storing a number of knitting needles capable of slidably moving back and forth, where these needle beds are disposed in the "/ \" shape formation in opposition from each other in file . The flat knitting machine made available for executing the first embodiment of the invention is conventionally called the "4-piece needle-bed" type. On the other hand, the method of composing a knit wear integrated with an additional type pocket according to the second embodiment of the invention introduces such a fiat knitting machine conventionally called the "2-piece needle bed" type, which is furnished with a pair of needle beds each storing a number of knitting needles capable of slidably moving back and forth on the top surface by disposing these two needle beds in the "/ \" shape formation in opposition from each other. The "2-piece needle bed" type flat knitting machine introduced for executing the second embodiment of the invention properly executes the method of composing a knit wear integrated with an additional type pocket by yielding satisfactory result identical to that achieved by executing the first embodiment described above.

Figure 89:
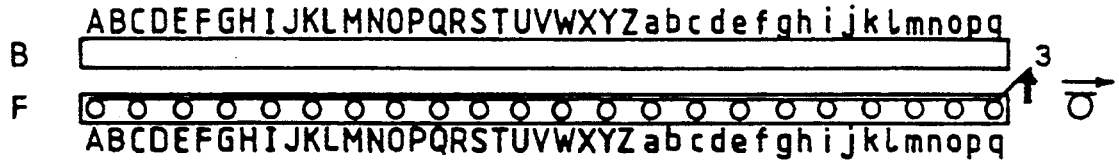
FIG. 89 through FIG. 173 are respectively explanatory of knit composing courses available for integrally forming a pocket with a body part according to the second embodiment of the invention.
Figure 90:
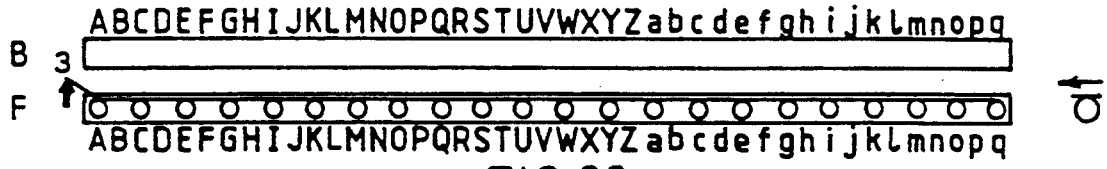
Figure 91:
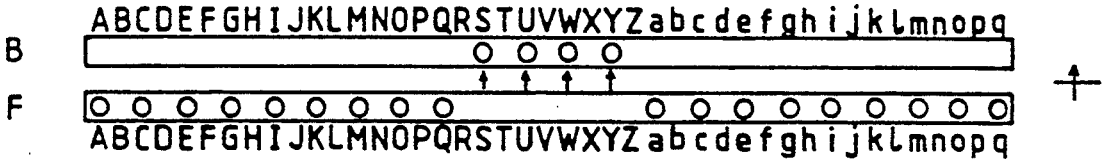
Figure 92:
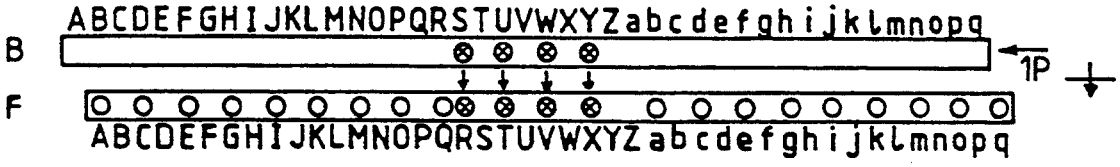
Figure 93:
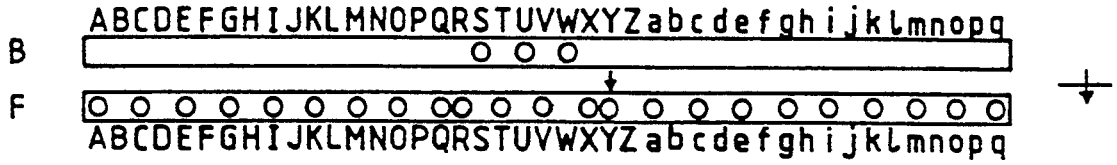
Figure 94:
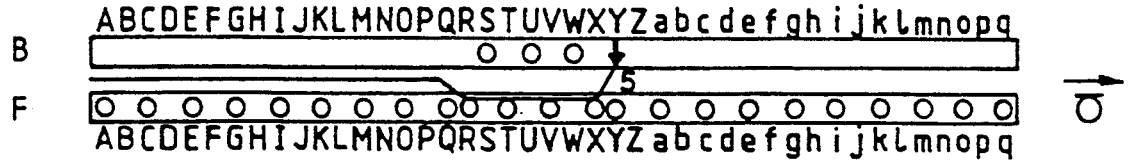
Figure 95:
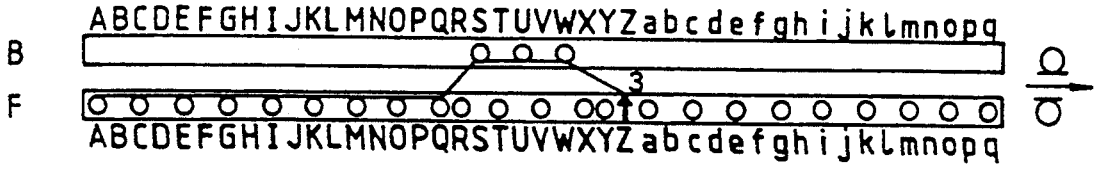
Figure 96:
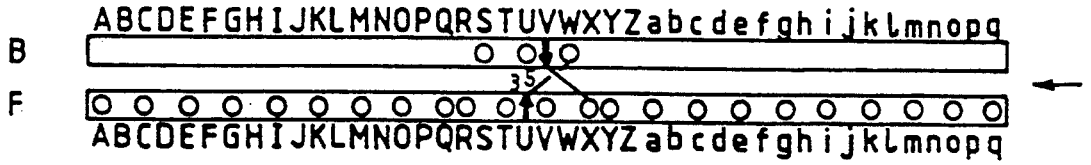
Figure 97:
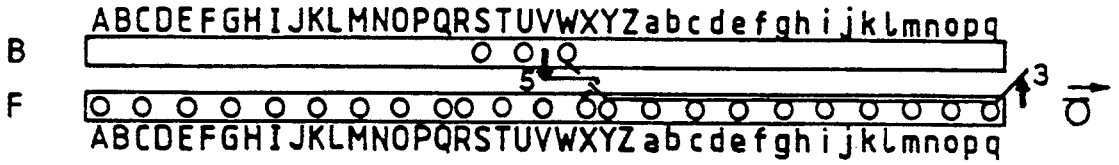
Figure 98:
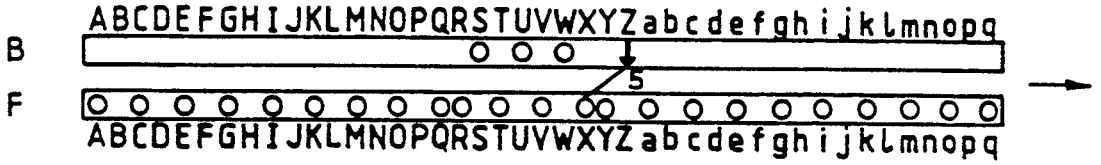
Figure 99:
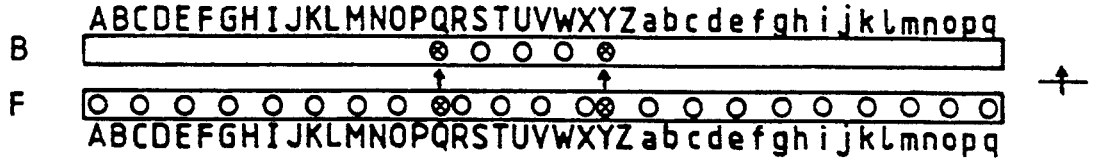
Figure 100:
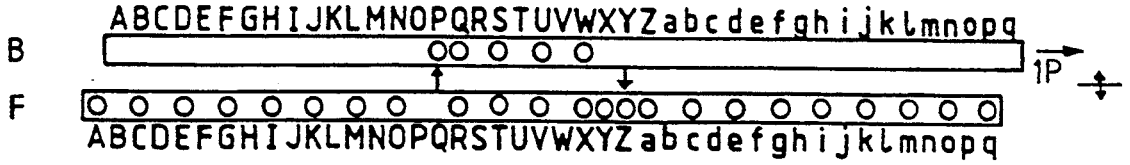
Figure 101:
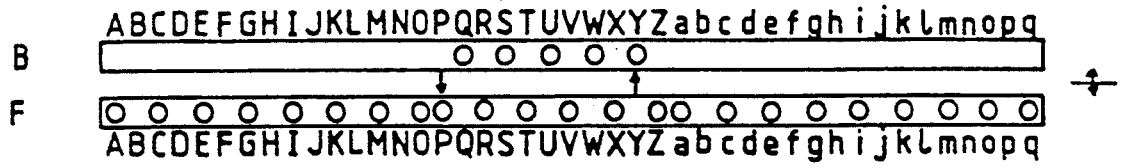
Figure 102:
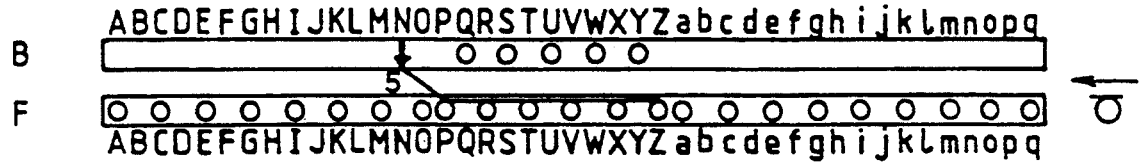
Figure 103:
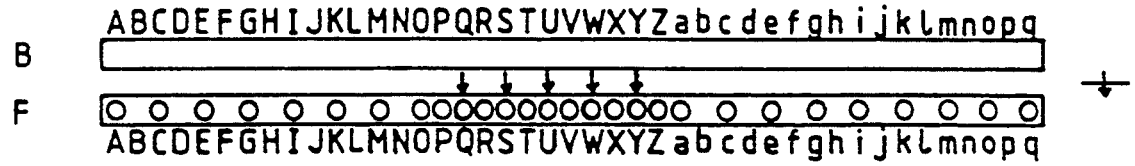
Figure 104:
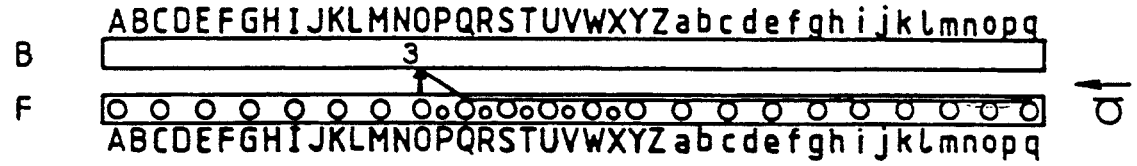
Figure 105:
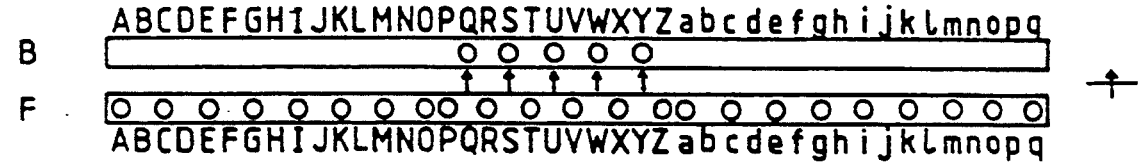
Figure 106:
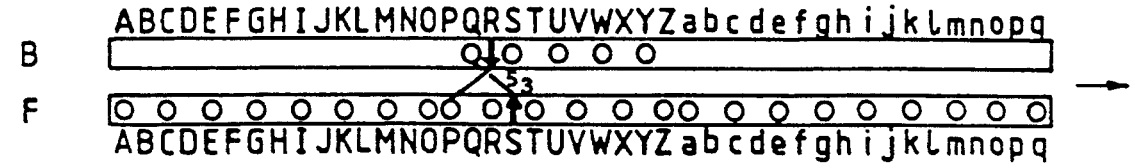
Figure 107:
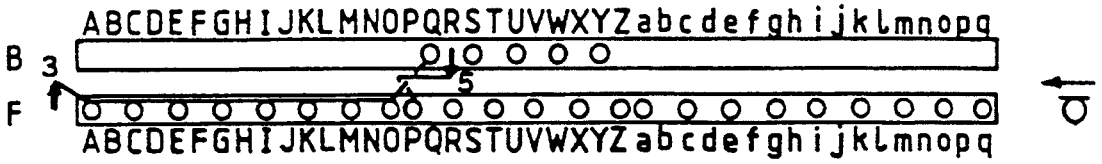
Figure 108:
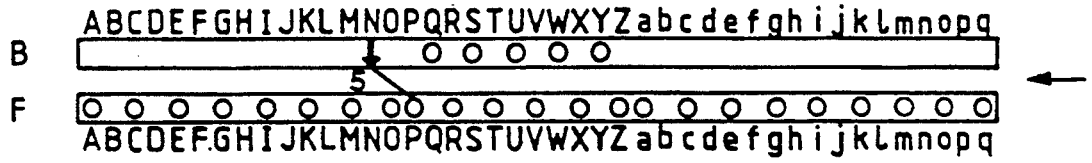
Figure 109:
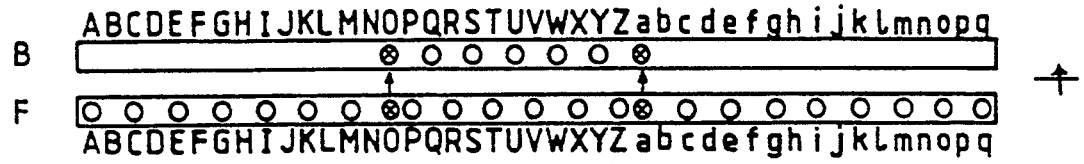
Figure 110:
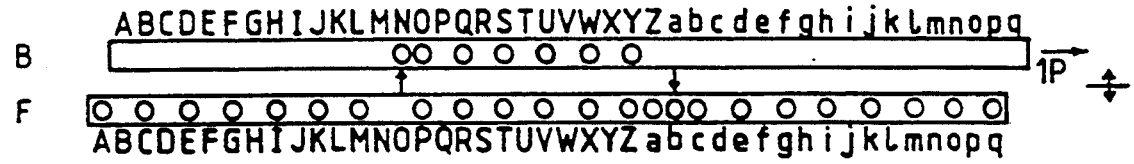
Figure 111:
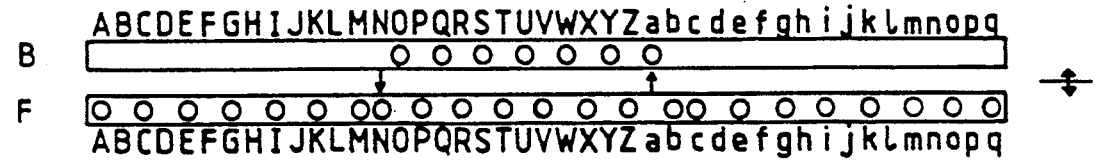
Figure 112:
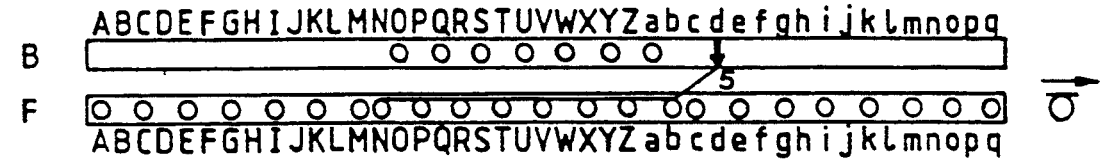
Figure 113:
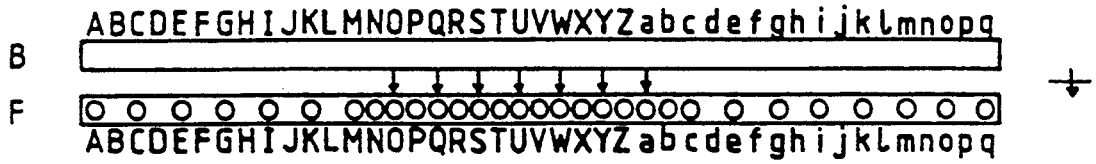
Figure 114:
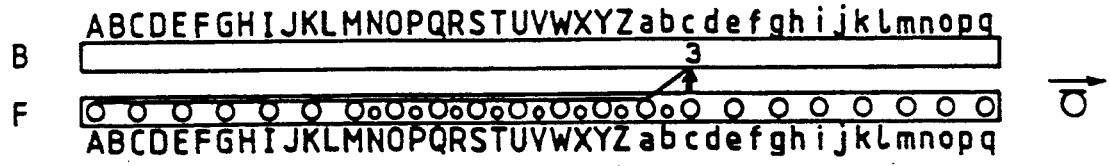
Figure 115:
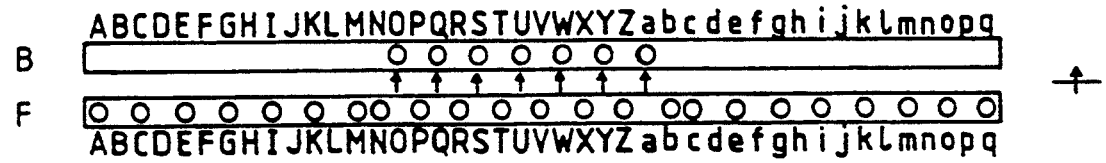
Figure 116:
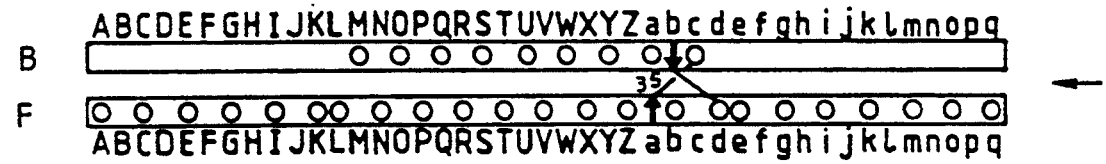
Figure 117:
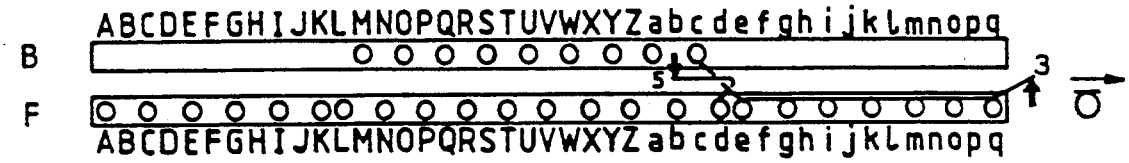
Figure 118:
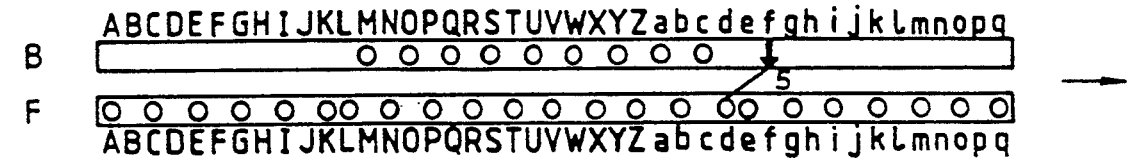
Figure 119:
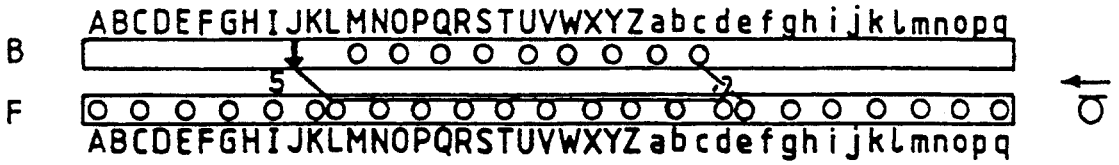
Figure 120:
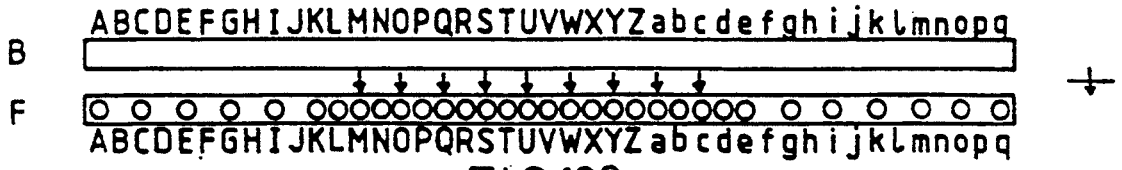
Figure 121:
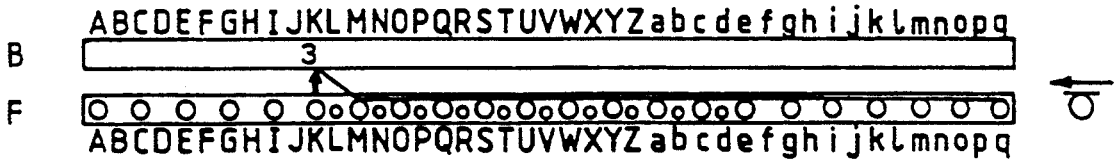
Figure 122:
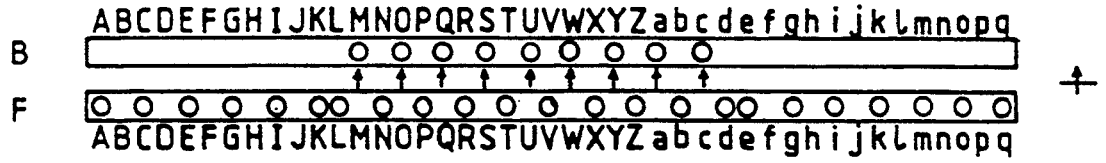
Figure 123:
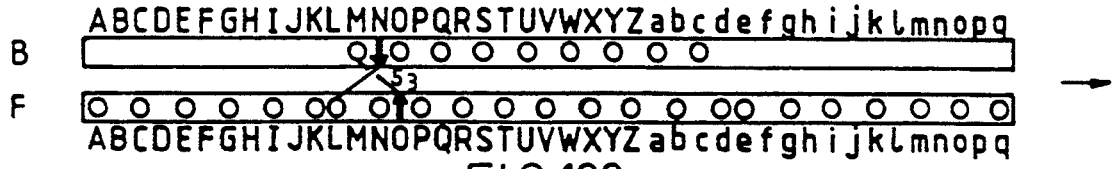
Figure 124:
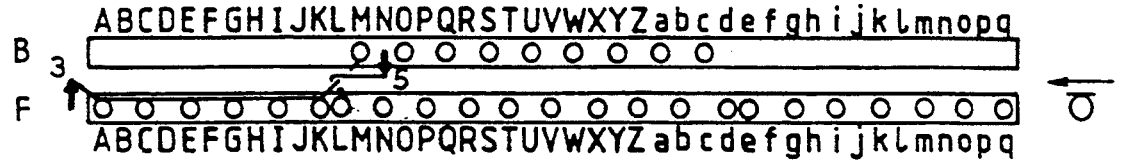
Figure 125:
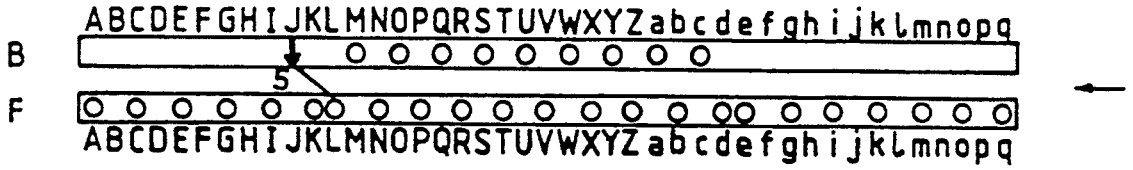
Figure 126:
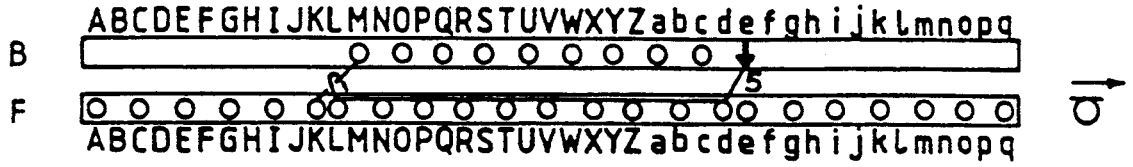
Figure 127:
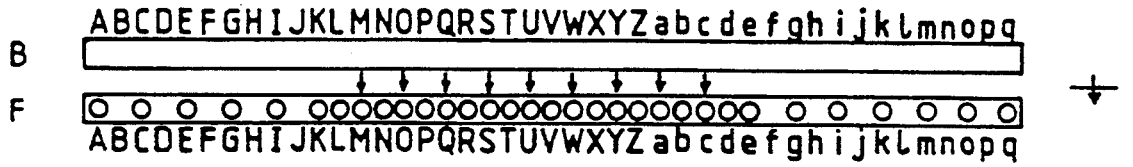
Figure 128:
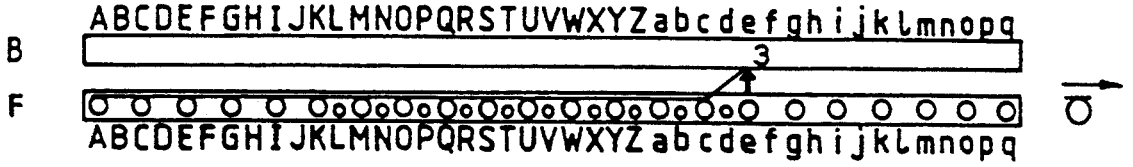
Figure 129:
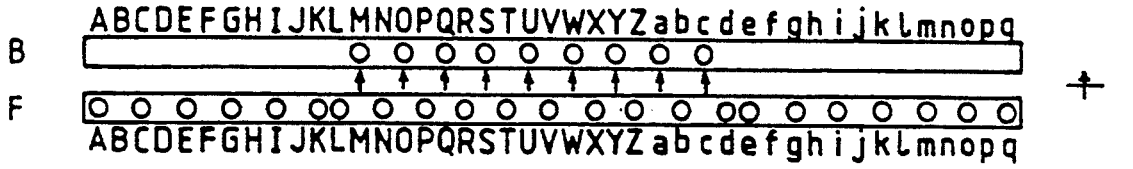
Figure 130:
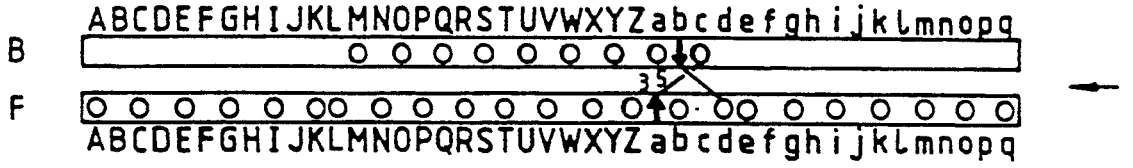
Figure 131:
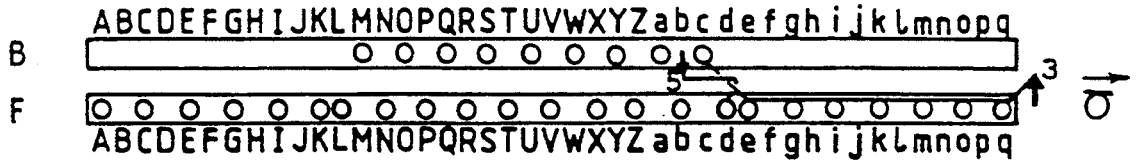
Figure 132:
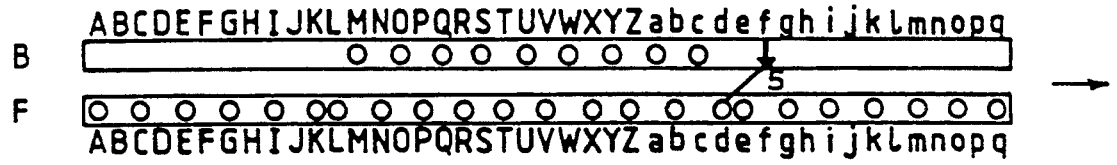
Figure 133:
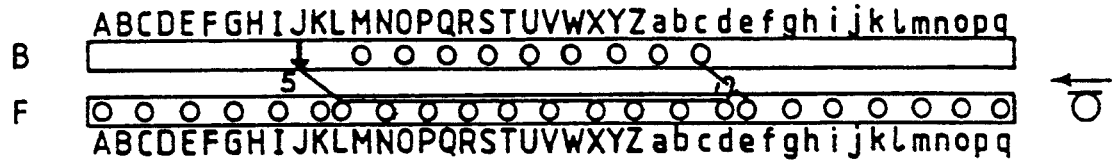
Figure 134:
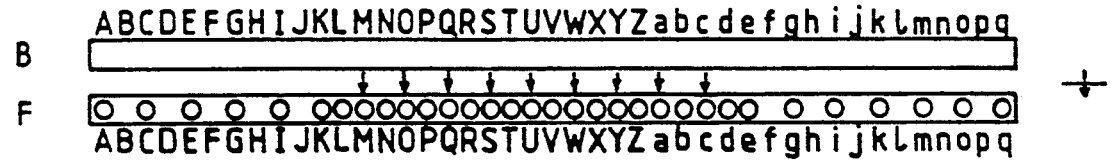
Figure 135:
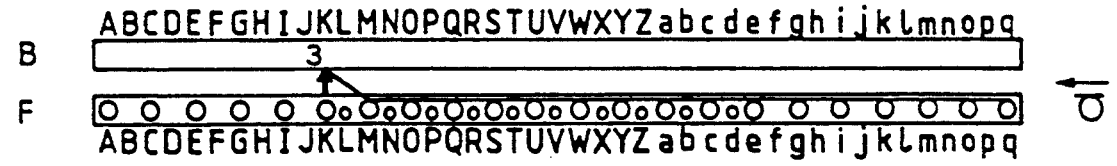
Figure 136:
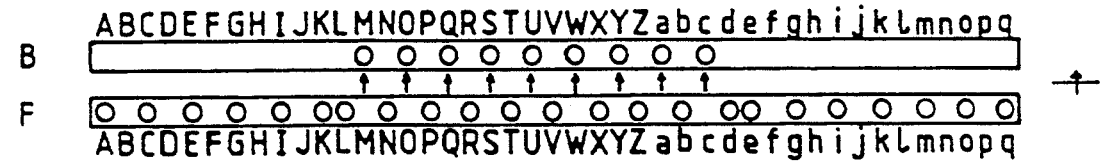
Figure 137:
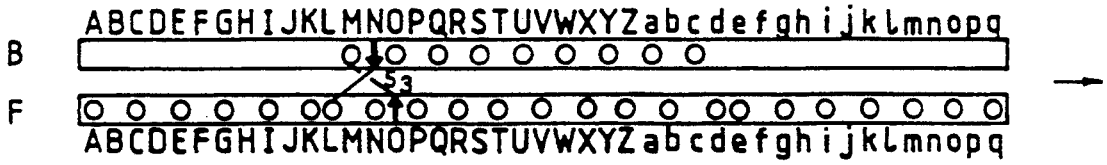
Figure 138:
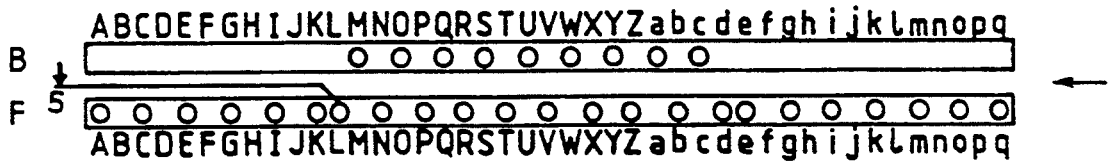
Figure 139:
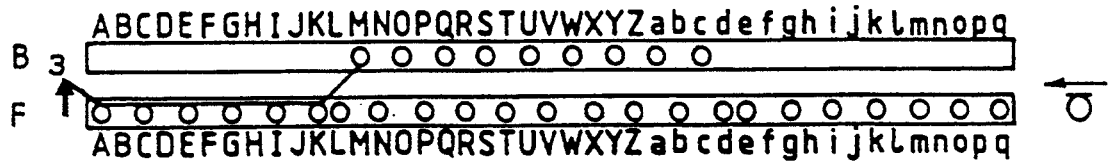
Figure 140:
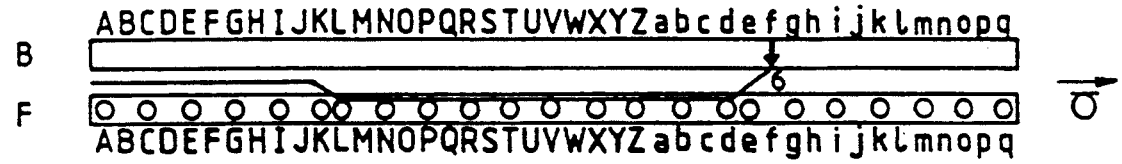
Figure 141:
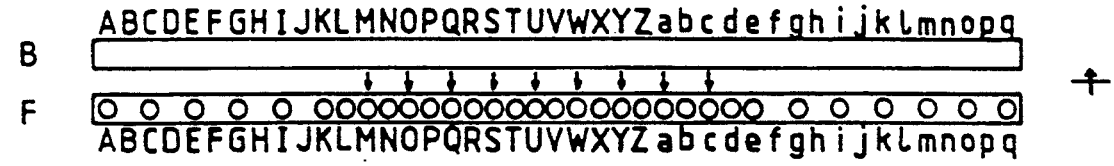
Figure 142:
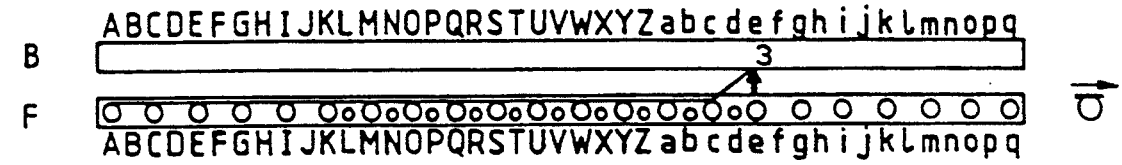
Figure 143:
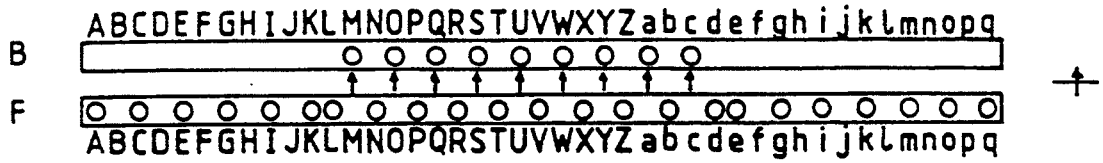
Figure 144:
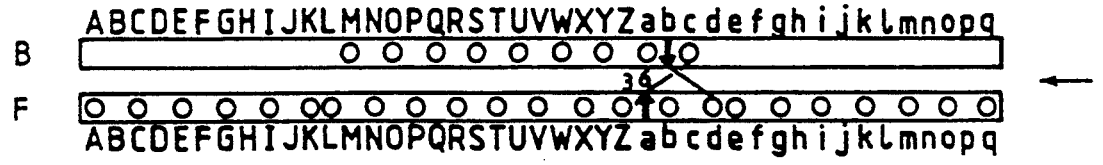
Figure 145:
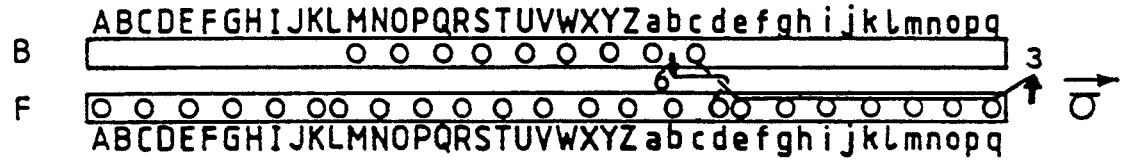
Figure 146:
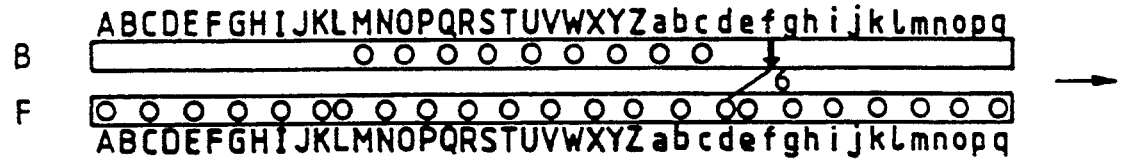
Figure 147:
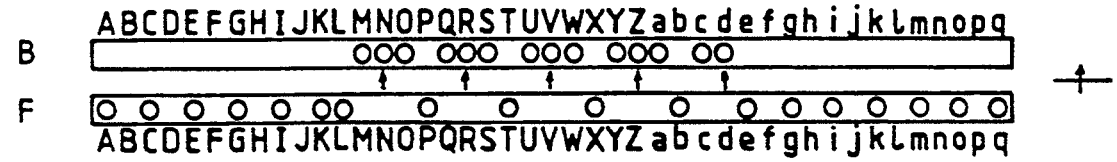
Figure 148:
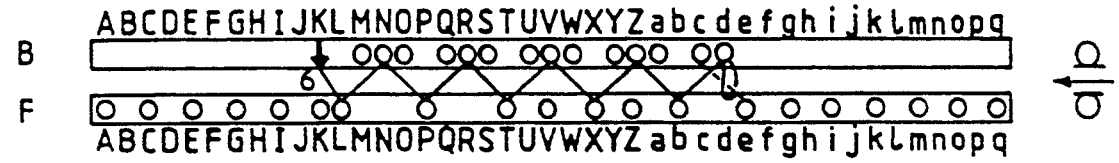
Figure 149:
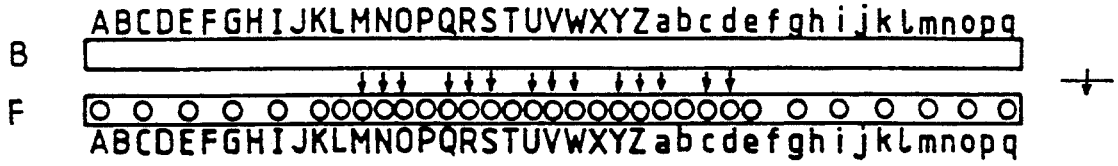
Figure 150:
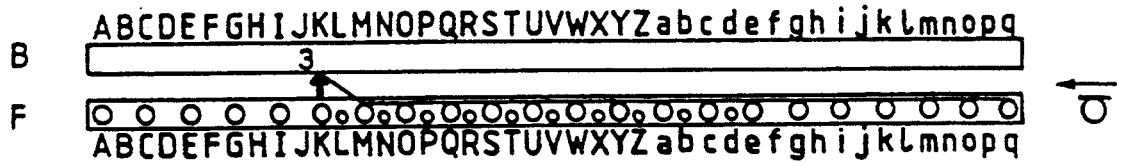
Figure 151:
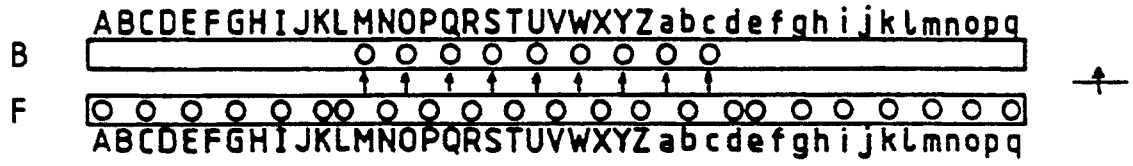
Figure 152:
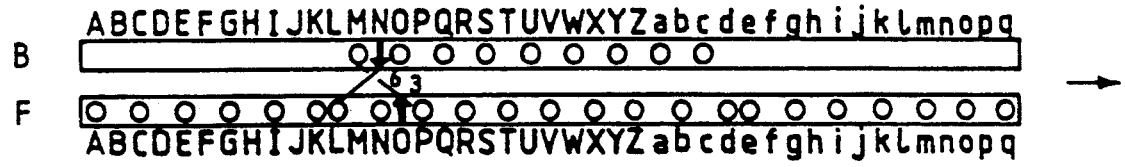
Figure 153:
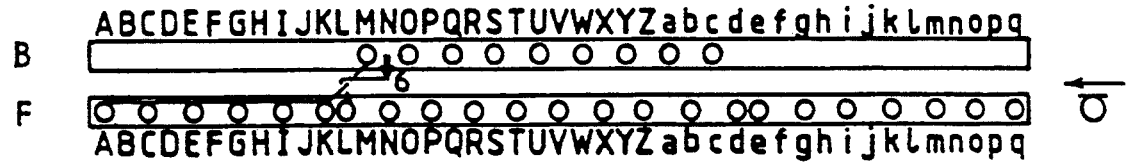
Figure 154:
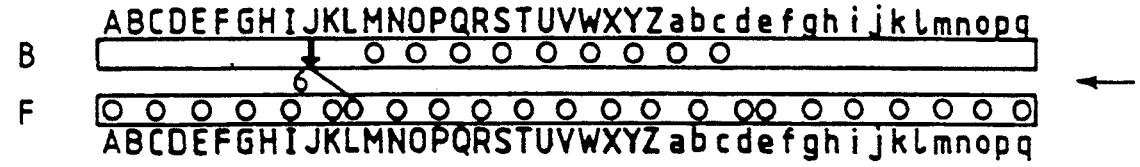
Figure 155:
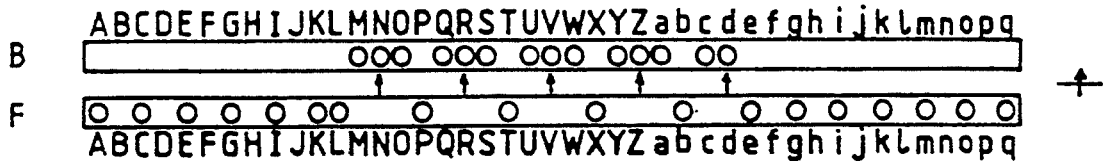
Figure 156:
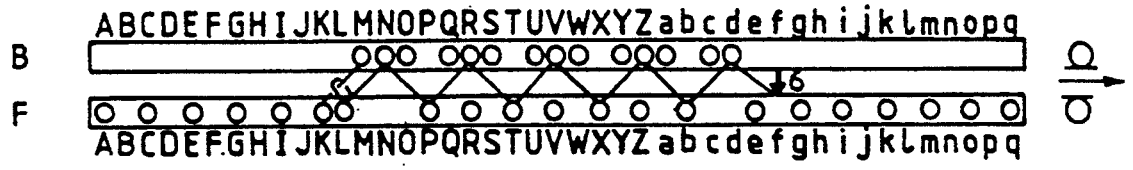
Figure 157:
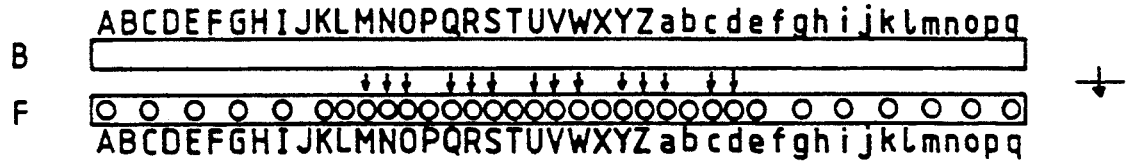
Figure 158:
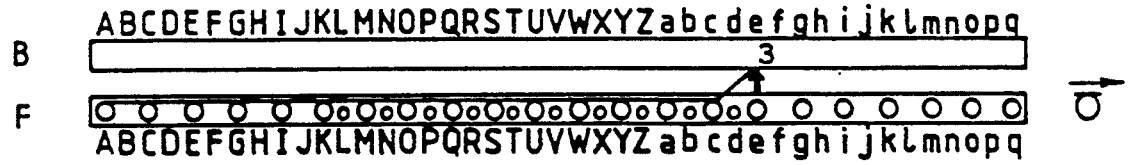
Figure 159:
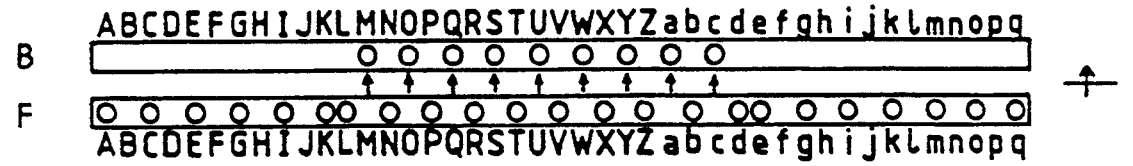
Figure 160:
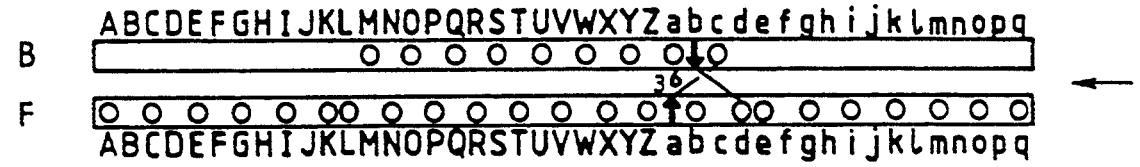
Figure 161:
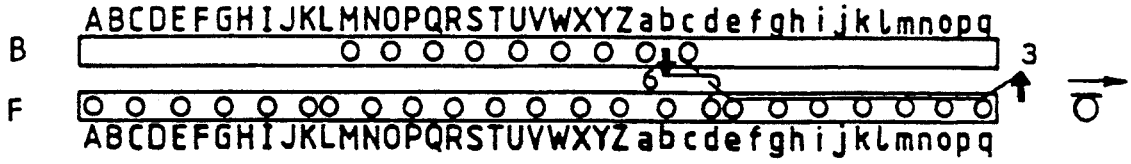
Figure 162:
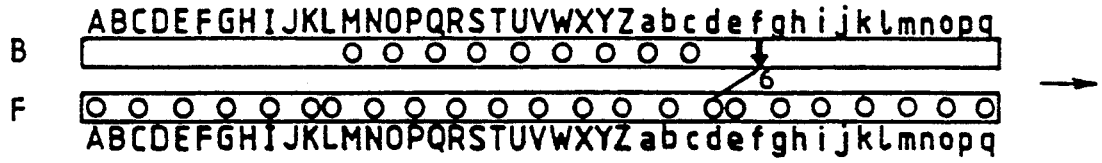
Figure 163:
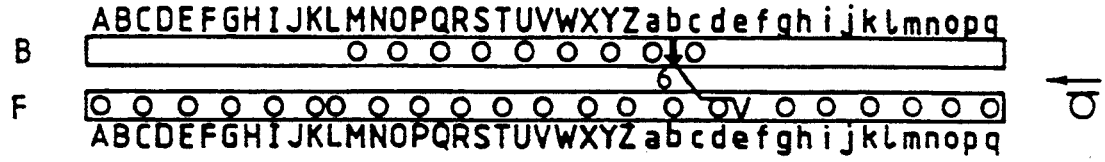
Figure 164:
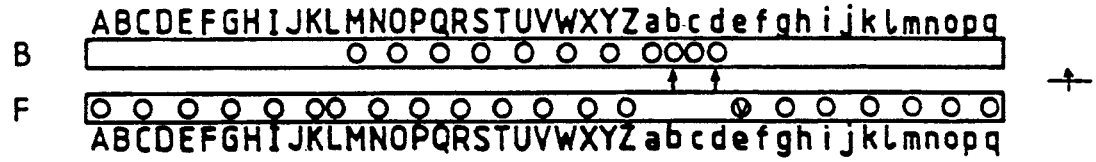
Figure 165:
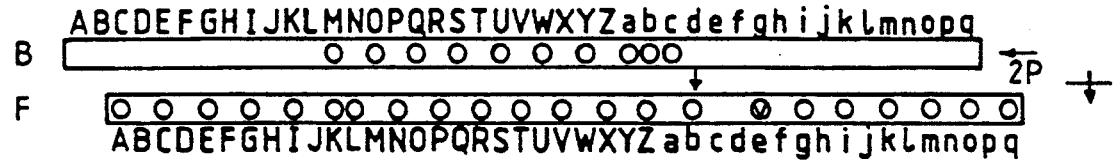
Figure 166:
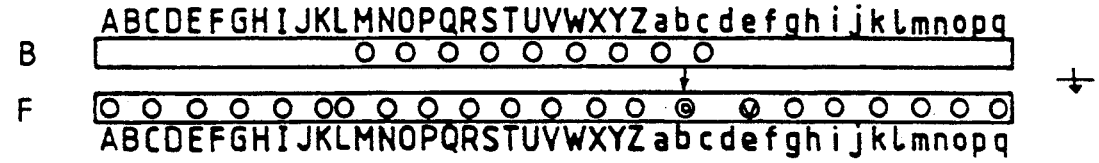
Figure 167:
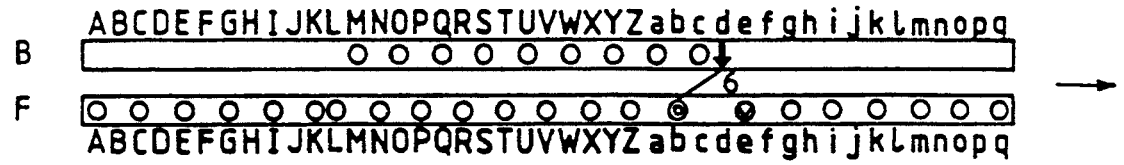
Figure 168:
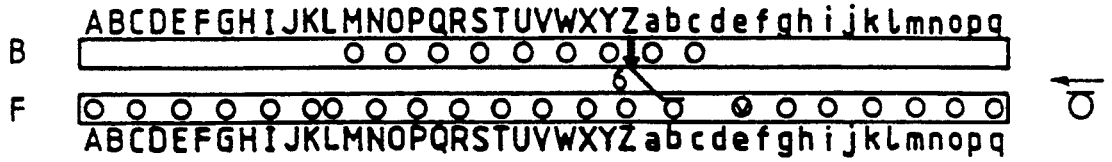
Figure 169:
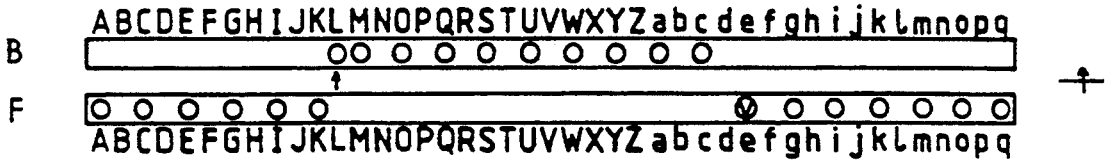
Figure 170:
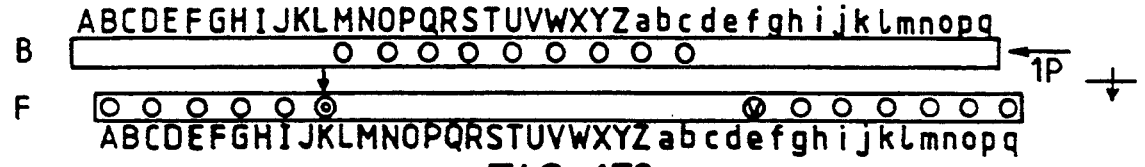
Figure 171:
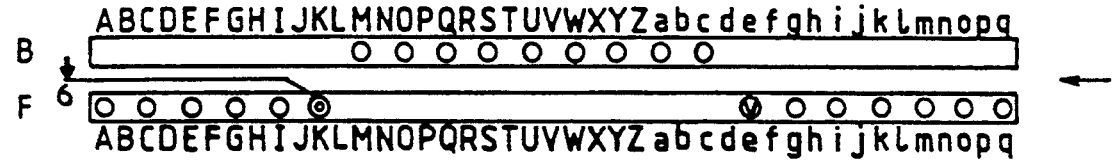
Figure 172:
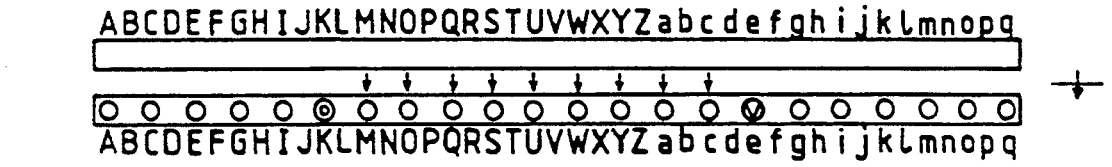

Concretely, as is apparent from the knitting course shown in FIG. 89, of those knitting needles A through q of the needle bed F in the front position for example, those alternate knitting needles including A, C, E, . . .

m, o, and q jointly operate themselves in place of the needle bed FD disposed on the bottom side in the front position for executing the knitting method of the first embodiment, whereas those remaining knitting needles including B, D, F, . . . l, n, and p jointly operate themselves in place of the needle bed FU disposed on the top side in the front position for executing the method made available for executing the first embodiment. Likewise, of those knitting needles A through q of the needle bed B in the rear position for example, those alternate knitting needles including A, C, E, . . . m, o, and q jointly operate themselves in place of the needle bed BD disposed on the bottom side in the rear position for executing the method according to the first embodiment, whereas those remaining knitting needles including B, D, F, . . . l, n, and p jointly operate themselves in place of the needle bed BU disposed on the top side in the rear position for executing the method according to the first embodiment.

Figure 173:
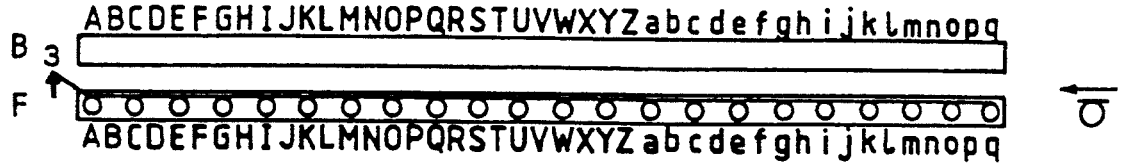

More particularly, the knitting courses shown in FIG. 89 through FIG. 173 respectively and sequentially correspond to those knitting courses shown in FIG. 4 through FIG. 88 executed for the first embodiment of the invention. In the same way as was done for the first embodiment, the method related to the second embodiment of the invention integrally forms an additional type pocket in such a state in which knitting yarns provided for the bottom and edges on both sides of the pocket twist up themselves in combination with the body-part knit, and yet, by way of superficially forming a knitted organization of the front-body knitted domain concealed in the knit corresponding to the pocket region, thus eventually materializing such a quality integrated pocket abundant in bulkiness characteristic of the additional type pocket.

The Third Embodiment

Figure 174:
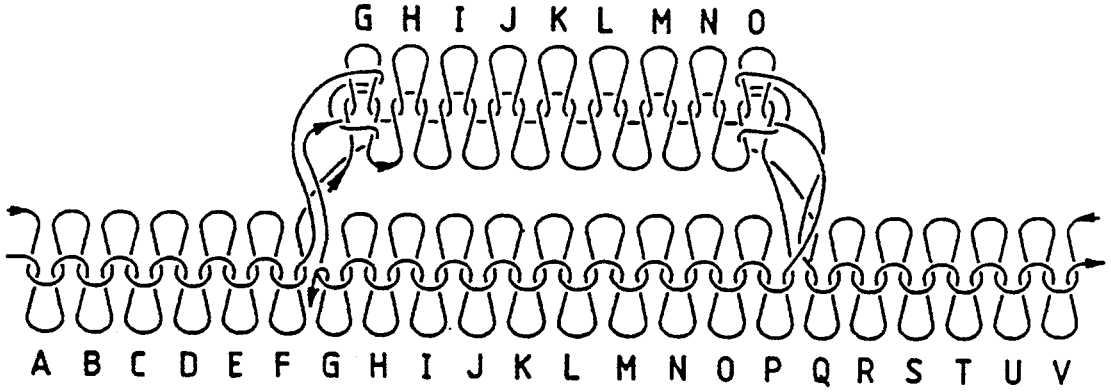
FIG. 174 is an organization chart of a knit composition corresponding to the knitted fabric shown in FIG. 2 composed by applying the third embodiment of the invention.

The method according to the third embodiment of the invention for composing a knit wear integrated with an additional type pocket also introduces a "4-piece needle bed" type flat knitting machine identical to the one made available for executing the method according to the first embodiment of the invention. The flat knitting machine is furnished with four needle beds which are respectively disposed in the "  " shape formation in opposition from each other in file each storing a number of knitting needles capable of slidably moving back and forth. The third embodiment provides a method of composing a knitted wear integrated with an additional type pocket, where those knitting yarns and loops provided for the bottom and edges on both sides of the pocket shown in FIG. 174 are intersectionally linked with each other in combination with the body-part knitted domain.

Those knitting courses shown in FIG. 175 through FIGS. 205 related to the third embodiment of the invention solely designate changeable knitting courses in the course of executing the method of integrally composing knitted fabrics integrated with an additional type pocket among those knitting courses previously described for the first embodiment.

It should be understood however that the number of loops corresponding to a straight region of a pocket composed by executing those knitting courses shown in FIG. 175 through FIG. 205 does not coincide with the number of those loops formed in those knitting courses shown in FIG. 32 through FIG. 45 related to the first embodiment. This is solely because the "4-piece needle-bed" flat knitting machine made available for executing the third embodiment of the invention provides the front needle beds and the rear needle beds by way of shifting their positions by a half pitch. Except for this shifting, the flat knitting machine available for executing the method related to the third embodiment of the invention has the structure identical to that of the flat knitting machine made available for executing the first embodiment.

Figure 175:
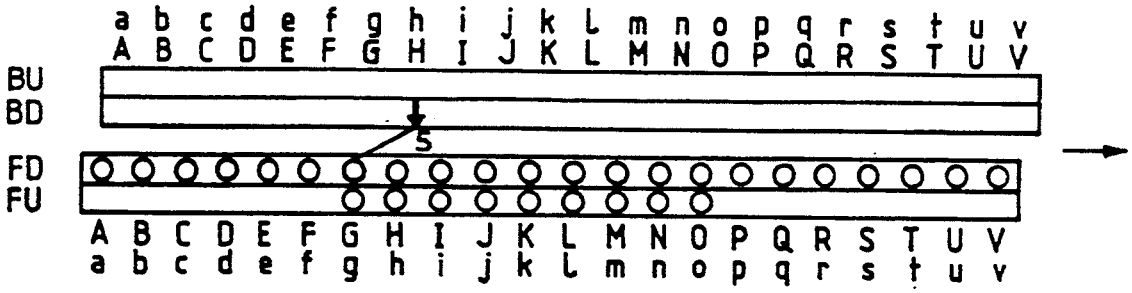
FIG. 175 through FIG. 203 are respectively explanatory of knit composing courses available for integrally forming a pocket with a body part according to the third embodiment of the invention.
Figure 176:
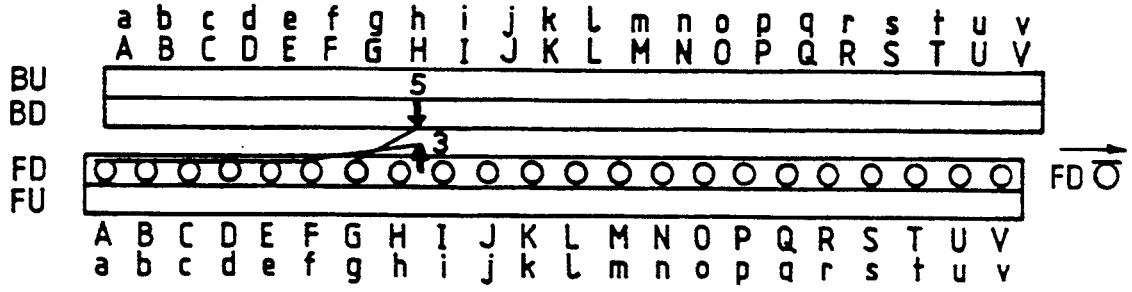
Figure 177:
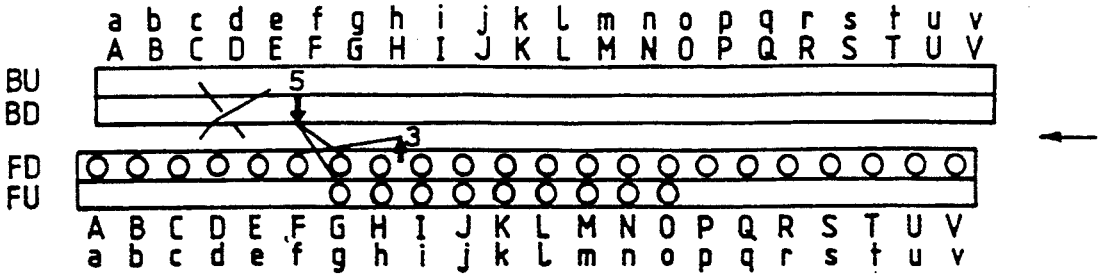
Figure 178:
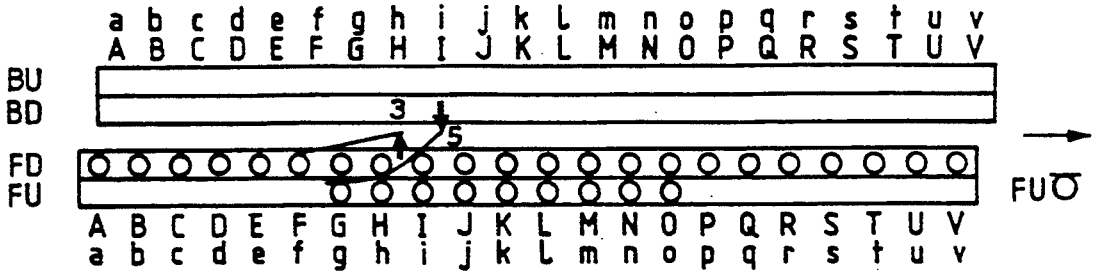
Figure 179:
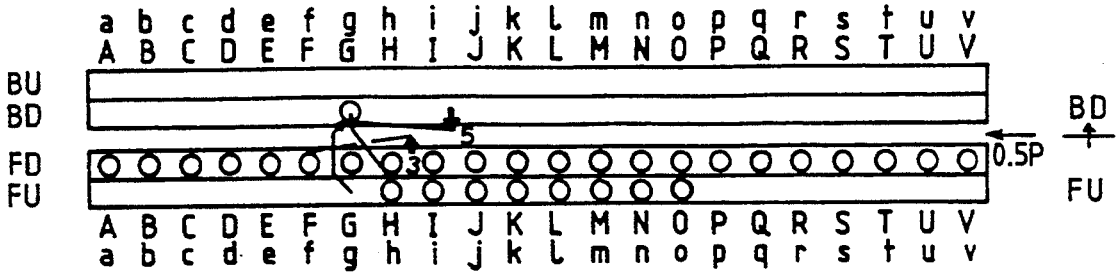

Concretely, when the knitting course shown in FIG. 175 is activated, a feeder 5 is shifted to the right. Next, when the knitting course shown in FIG. 176 is activated, another feeder 3 feeds knitting yarns to those knitting needles A through F of a need bed FD to have them respectively form loops. Next, when the knitting course shown in FIG. 178 is activated, the feeder 5 is shifted to the left. Next, when the knitting course shown in FIG. 179 is activated, the feeder 5 feeds a knitting yarn to a knitting needle g of a needle be FU to have it form a loop.

Figure 180:
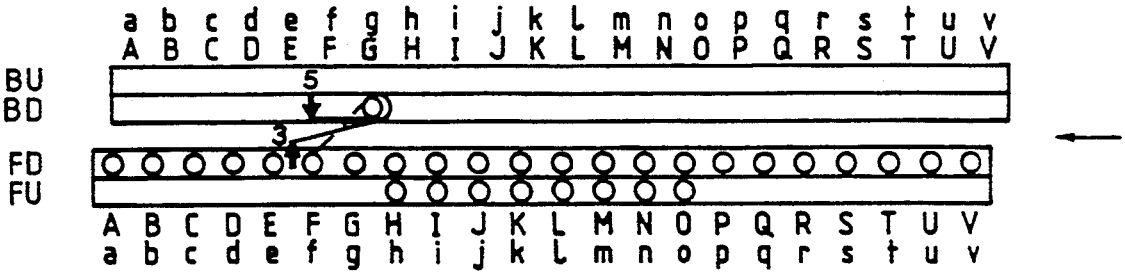
Figure 181:
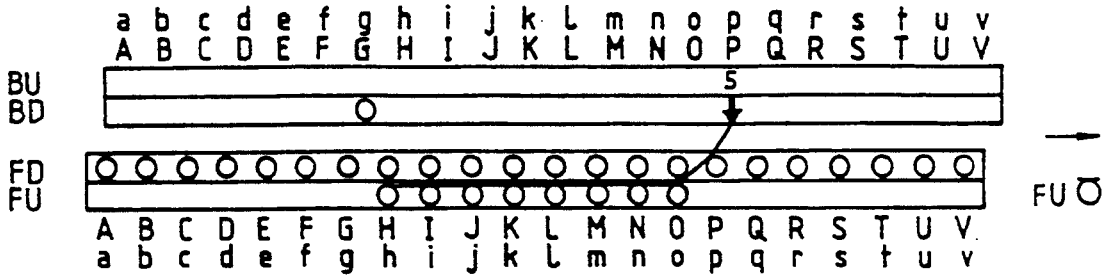

Next, when the knitting course shown in FIG. 180 is activated, those needle beds BU and BD in the rear position are respectively shifted to the left by one-half pitch, and then, the loop engaged with the knitting needle g of the needle bed FU is transferred to a knitting needle G of a needle bed BD, and then, permits the feeder 5 to feed knitting yarns to a knitting needle h of the needle bed FU and the knitting needle G of the needle bed BD. Next, when the knitting course shown in FIG. 181 is activated, those needle beds BU and BD in the rear position are respectively shifted to the right by one-half pitch. Next, the feeder 3 is shifted to the left. In the meanwhile, the feeder 5 feeds knitting yarns by way of encircling the periphery of the loop engaged with the knitting needle G of the needle bed BD.

Figure 182:
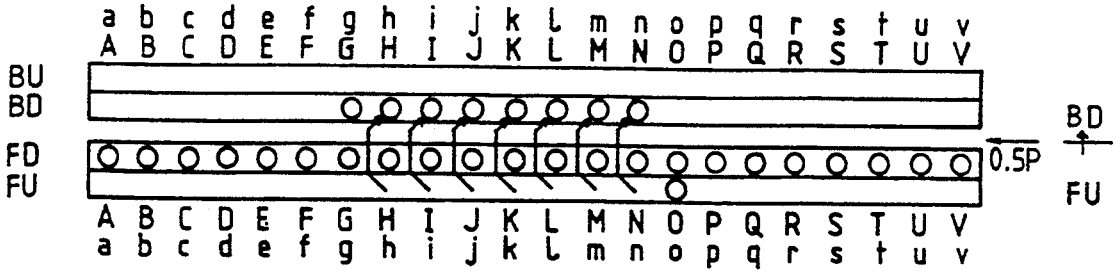
Figure 183:
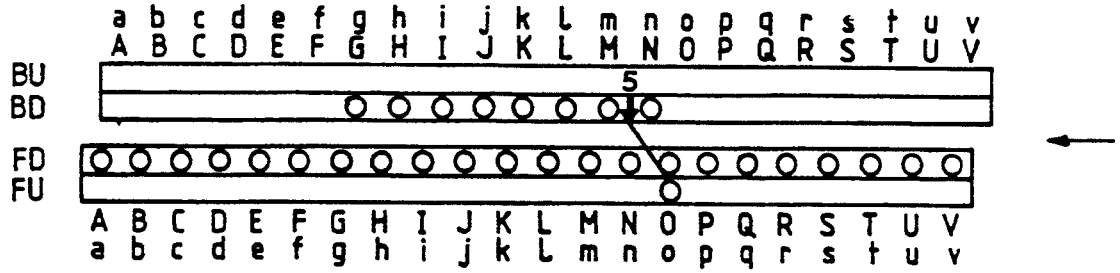
Figure 184:
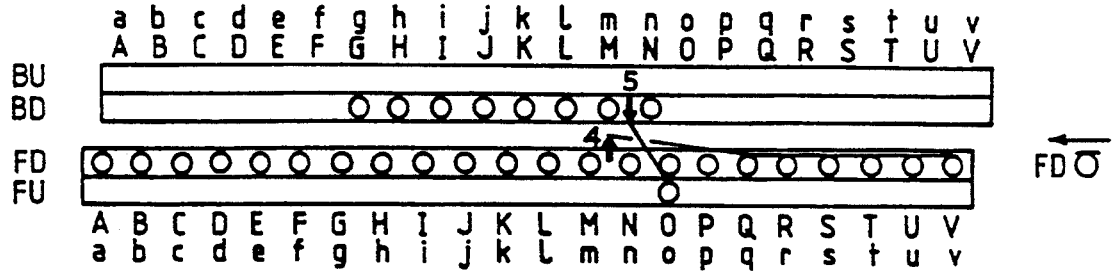

Next, when the knitting course shown in FIG. 182 is activated, initially, the feeder 5 feeds knitting yarns to those knitting needles h through o of the needle bed FU, and then, the knitting course shown in FIG. 183 is activated, in which those needle beds BU and BD in the rear position are respectively shifted to the left by one-half pitch, and then, those loops engaged with those knitting needles h through n of the needle bed FU are respectively transferred to those knitting needles H through N of the needle bed BD.

Figure 185:
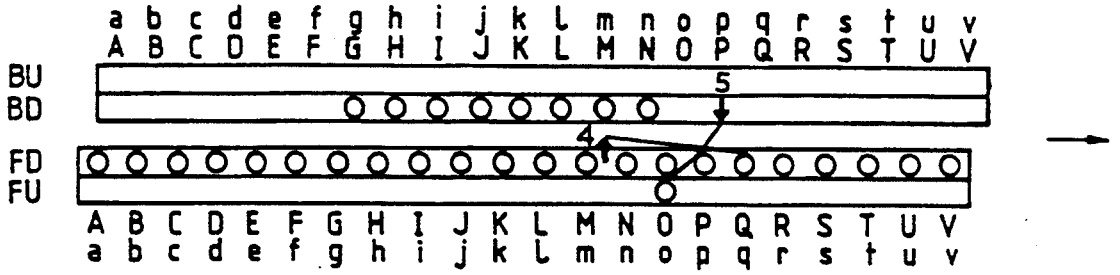
Figure 186:
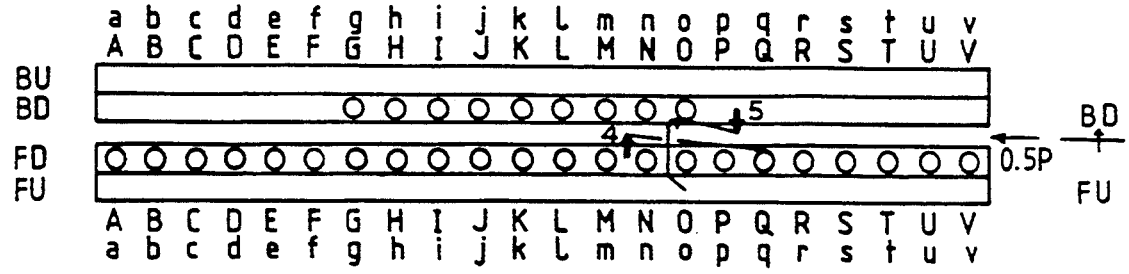
Figure 187:
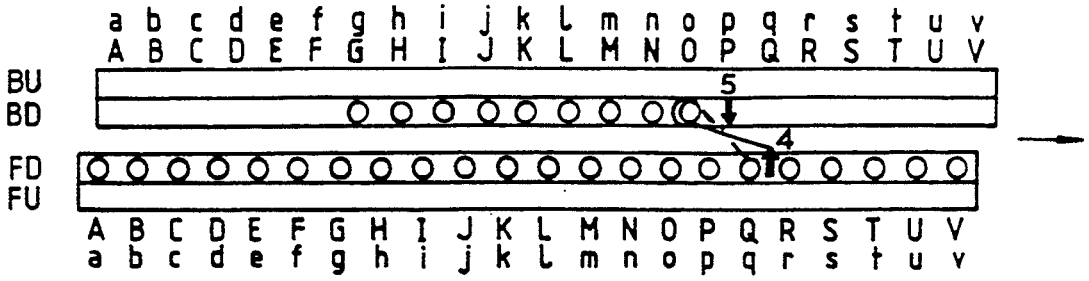
Figure 188:
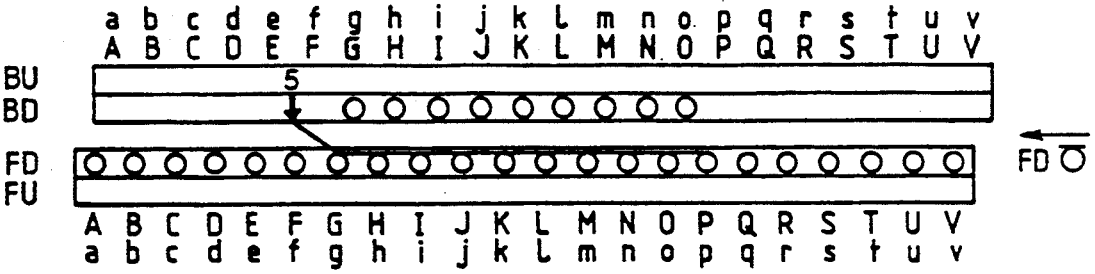
Figure 189:
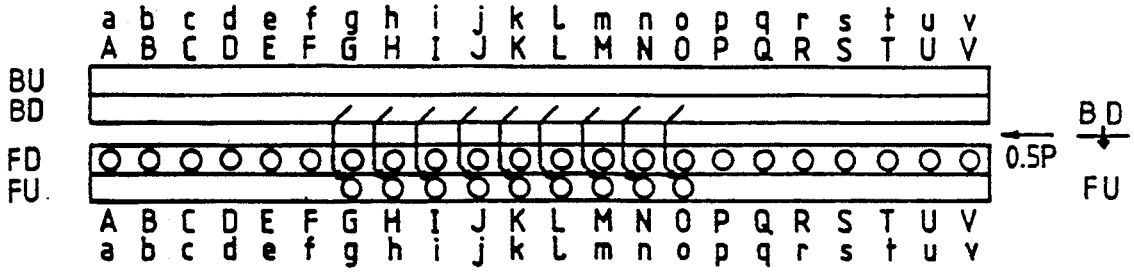

Next, when the knitting course shown in FIG. 185 is activated, another feeder 4 feeds knitting yarns to those knitting needles V through Q of another needle bed FD to have them respectively form loops. Next, when the knitting course shown in FIG. 186 is activated, the feeder 5 is shifted to the right. Next, when the knitting course shown in FIG. 188 is activated, initially, those needle beds BU and BD are respectively shifted to the left by one-half pitch, and then the loop engaged with the knitting needle o of the needle bed FU is transferred to the knitting needle O of the needle bed BD. Next, when the knitting course shown in FIG. 189 is activated, those needle beds BU and BD in the rear position are respectively brought back to the right by one-half pitch. Next, the feeder 4 is shifted to the left, and then causes the feeder 5 to feed knitting yarns by way of encircling the periphery of the loop engaged with the knitting needle G of the needle bed BD.

Figure 190:
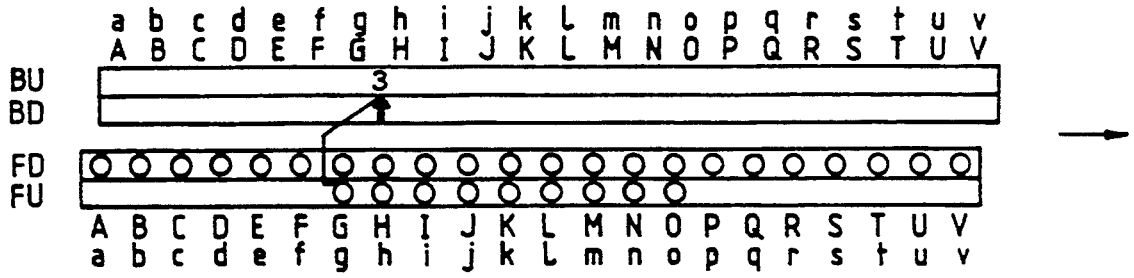
Figure 191:
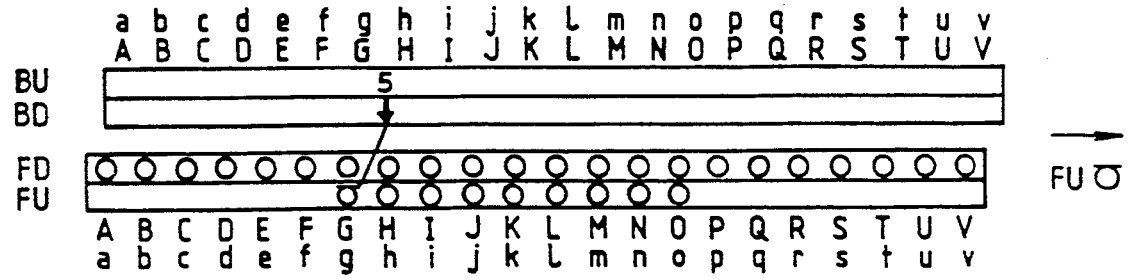

Next, when the knitting course shown in FIG. 190 is activated, the feeder 5 feeds knitting yarns to those knitting needles P through G of the needle bed FD to have them respectively form loops. Next, the knitting course shown in FIG. 191 is activated, in which those needle beds BU and BD in the rear position are respectively shifted to the left by one-half pitch, and then those loops engaged with the knitting needles G through O of the needle bed BD are respectively transferred to those knitting needles g through o of the needle bed FU.

Figure 192:
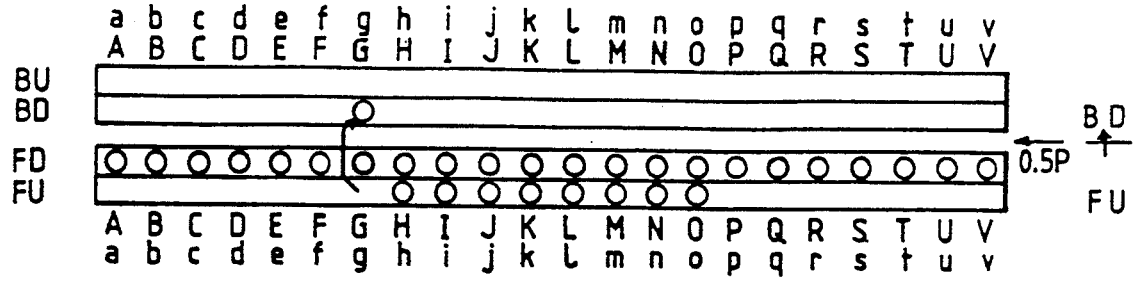
Figure 193:
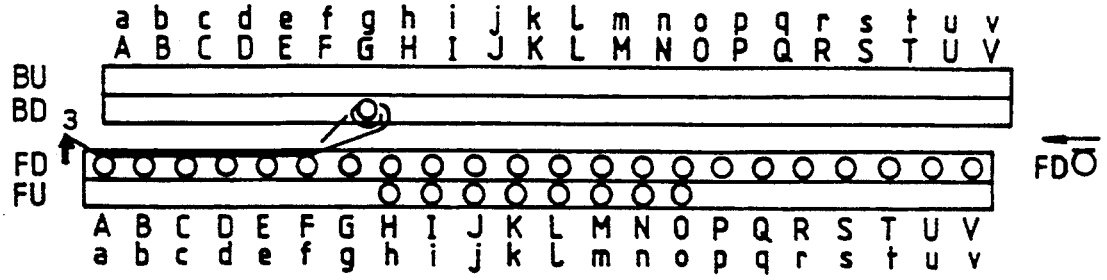
Figure 194:
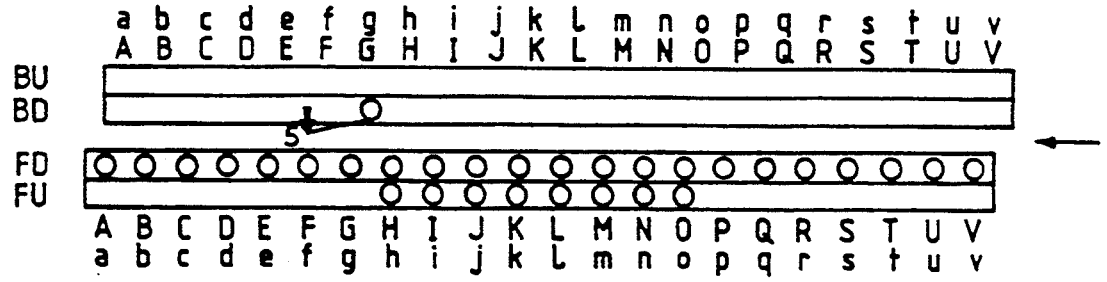

Next, when the knitting course shown in FIG. 192 is activated, the feeder 3 at the position shown in FIG. 181 is shifted to the right. Next, when the knitting course shown in FIG. 193 is activated, the feeder 5 feeds knitting yarns to the knitting needle g of the needle bed FU to have it form a loop. Next, when the knitting course shown in FIG. 194 is activated, those needle beds BU and BD in the rear position are respectively shifted to the left by one-half pitch, and then, the loop engaged with the knitting needle G of the needle bed FU is transferred to the knitting needle G of the needle bed BD.

Figure 195:
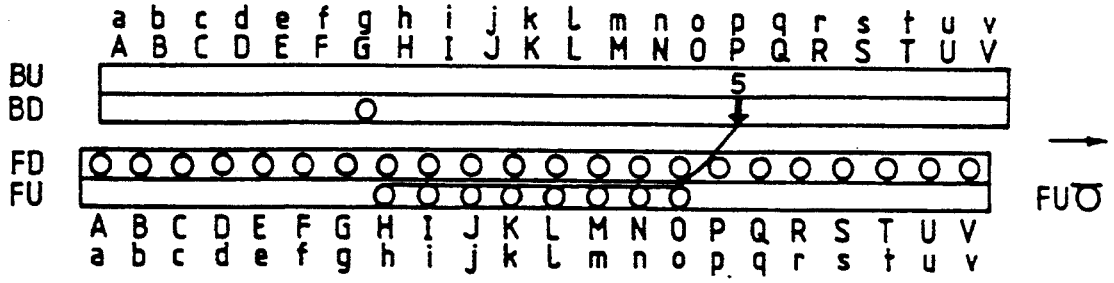
Figure 196:
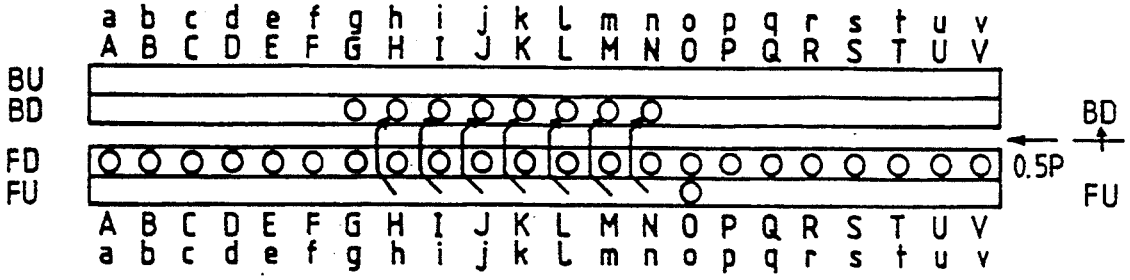
Figure 197:
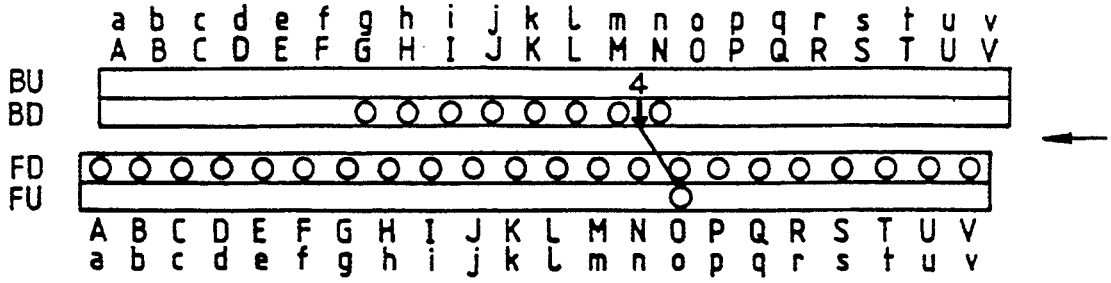

Next, when the knitting course shown in FIG. 195 is activated, the feeder 5 feeds knitting yarns to those knitting needles A through F of the needle bed FD by way of encircling the periphery of the loop engaged with the needle G of the needle bed BD to have these needles respectively form loops. Next, when the knitting course shown in FIG. 196 is activated, the feeder 5 is shifted to the left, and then, when the knitting course shown in FIG. 196 is activated, the feeder 5 is also shifted to the left. When the following knitting course shown in FIG. 197 is activated, the feeder 5 feeds knitting yarns to those knitting needles h through o of the needle bed FU to have these needles respectively form loops.

Figure 198:
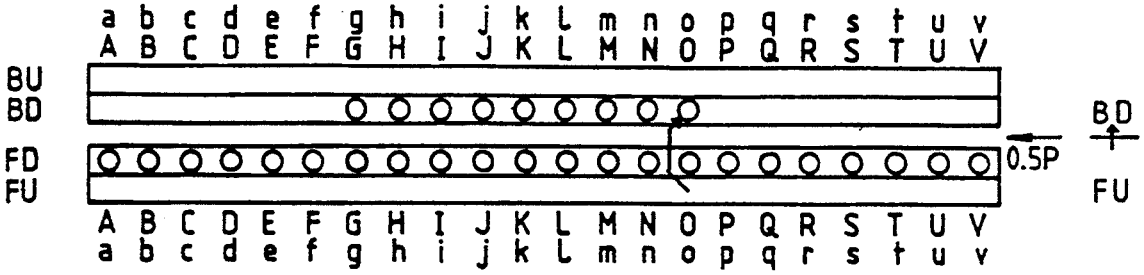
Figure 199:
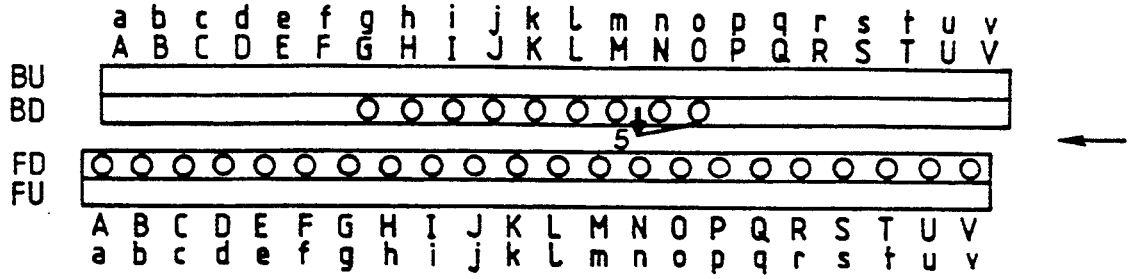
Figure 200:
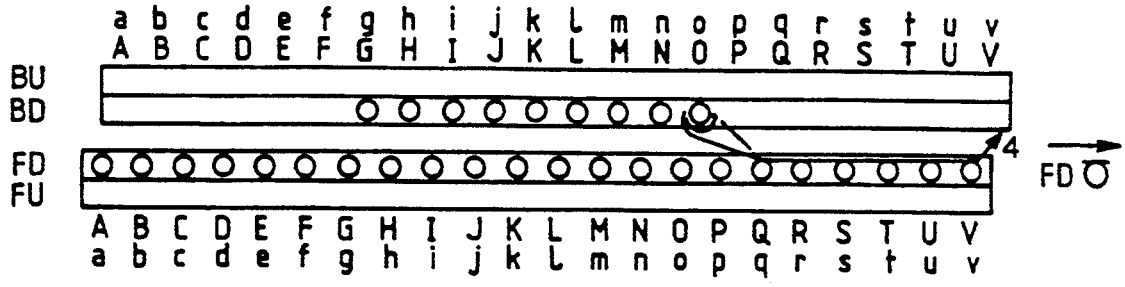

Next, when the knitting course shown in FIG. 198 is activated, those needle beds BU and BD in the rear position are respectively shifted to the left by one-half pitch, and then, those loops engaged with the needles h through o of the needle bed FU are respectively transferred to those knitting needles H through N of the needle bed BD. Next, when the knitting course shown in FIG. 199 is activated, the feeder 4 is shifted to the left, and then, when the knitting course shown in FIG. 200 is activated, the feeder 4 is transferred to the knitting needle O of the needle bed BD.

Figure 201:
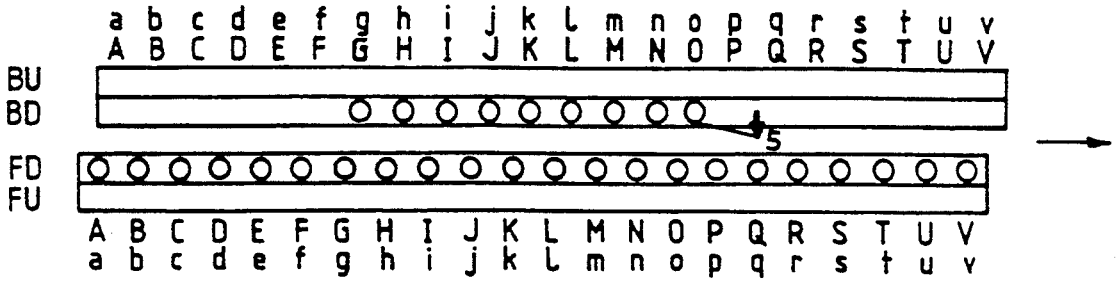
Figure 202:
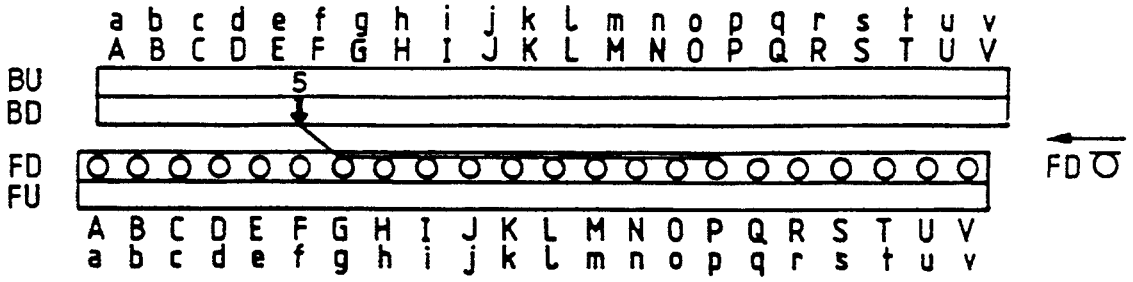

Next, when the knitting course shown in FIG. 201 is activated, the feeder is shifted to the left. When the following knitting course shown in FIG. 202 is activated, the feeder 5 feeds knitting yarns to those knitting needles Q through V of the needle bed FD by way of encircling the periphery of the loop engaged with the knitting needle O of the needle bed BD to have them respectively form loops.

Figure 203:
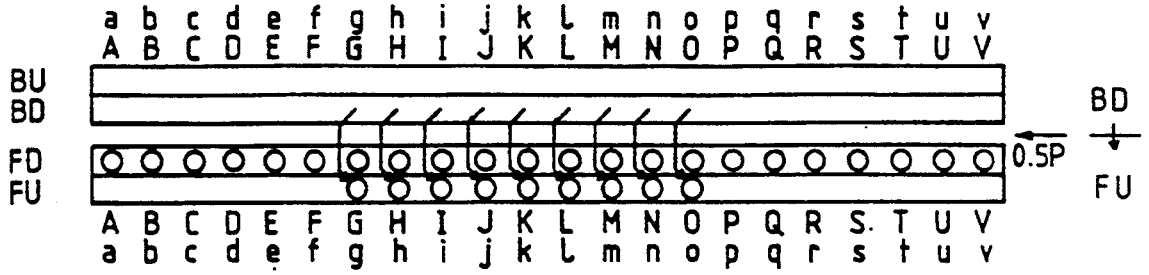
Figure 204:
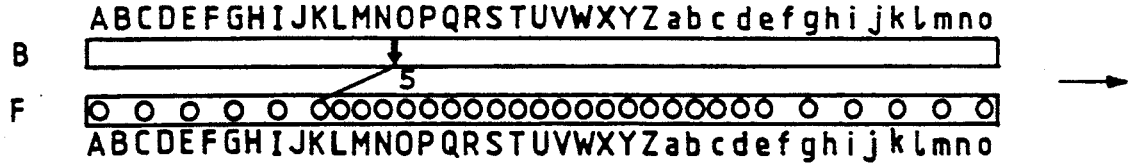
FIG. 204 through FIG. 232 are respectively explanatory of knit composing courses available for integrally forming a pocket with a body part according to the fourth embodiment of the invention.
Figure 205:
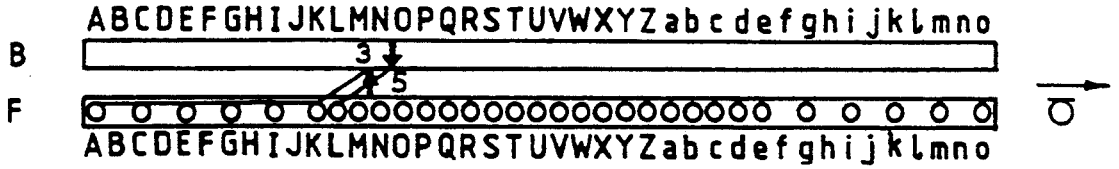

Next, when the knitting course shown in FIG. 203 is activated, the feeder 5 is shifted to the right. Next, when the knitting course shown in FIG. 204 is activated, the feeder 5 feeds knitting yarns to those knitting needles P through G of the needle bed FD to have them respectively form loops. Next, when the knitting course shown in FIG. 205 is activated, those needle beds BU and BD in the rear position are respectively shifted to the left by one-half pitch. Next, those loops engaged with the knitting needles G through O of the needle bed BD are respectively transferred to those knitting needles g through o of the needle bed FU.

Henceforth, the flat knitting machine made available for executing the method related to the third embodiment of the invention repeatedly executes those knitting processes shown in FIG. 175 through FIG. 205 before eventually composing the straight portion of the pocket 2. As shown in FIG. 174 for example, knitting yarns and loops interlock with each other along both-side edges of the pocket 2 and the knitted fabric available for composing the front body domain 7.

The Fourth Embodiment

As described earlier, the method related to the third embodiment of the invention makes use of a "4-piece needle-bed" type flat knitting machine which is furnished with four needle beds in file each storing a number of knitting needles on the top surface by permitting these knitting needles to slidably move back and forth, where these needle beds are respectively disposed in opposition from each other in the "/ \" shape formation. On the other hand, the fourth embodiment of the invention provides the method of composing a knit wear integrally provided with an additional-type pocket by operating a conventional "2-piece needle-bed" type flat knitting machine which is furnished with a pair of needle beds each storing a number of knitting needles on the top surface by permitting these knitting needles to slidably move back and forth, where these needle beds are also disposed in opposition from each other in the "/ \" shape formation. Concretely, using the "2-piece needle-bed" type flat knitting machine mentioned above, the fourth embodiment of the invention provides the method of composing a knitted fabric integrally provided with an additional-type pocket by arranging the bottom and both-side edges of the pocket to be interlocked with the body-part knitted fabric in the state in which knitting yarns are intersectionally linked with loops in the same way as that is achievable by operating the "4-piece needle-bed" type flat knitting machine made available for executing the method related to the third embodiment of the invention.

Figure 206:
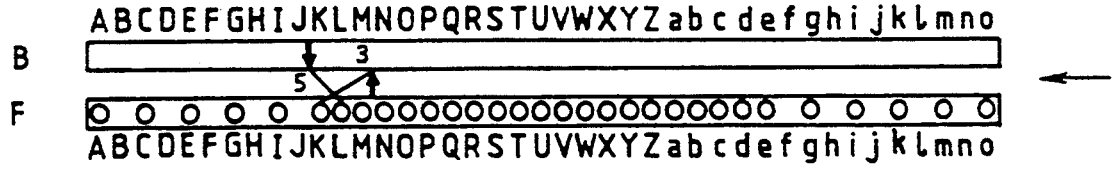
Figure 207:
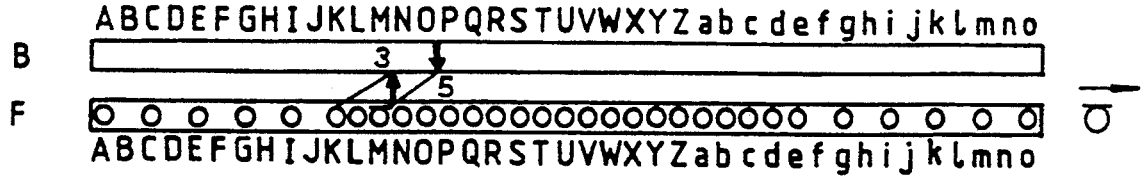
Figure 208:
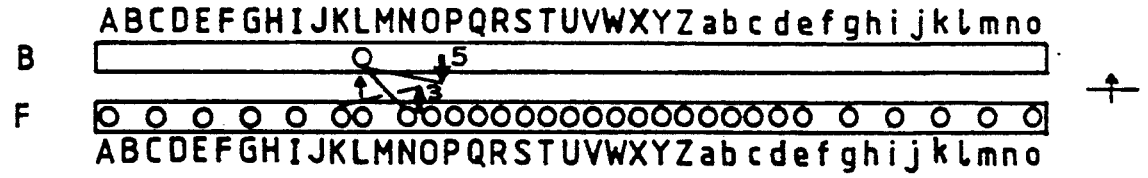
Figure 209:
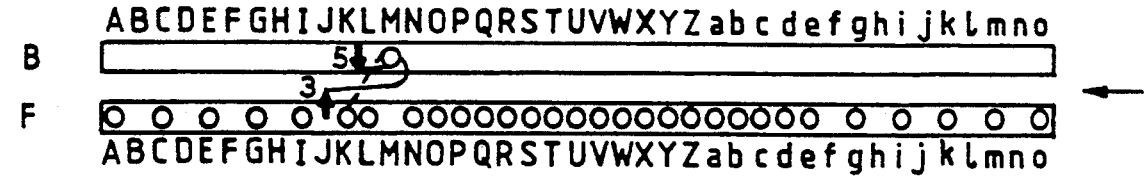
Figure 210:
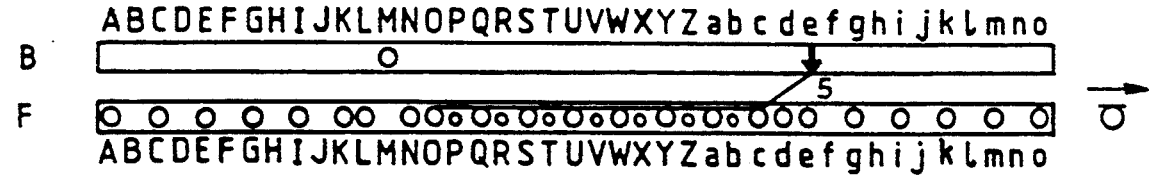
Figure 211:
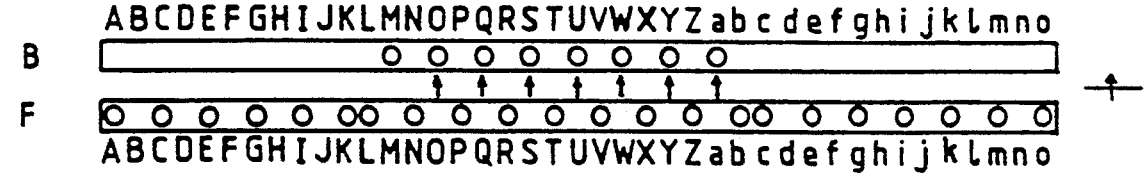
Figure 212:
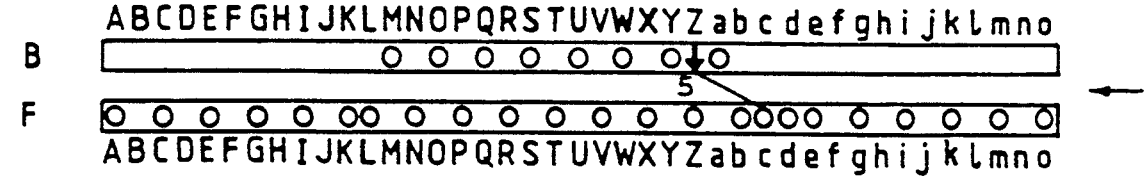
Figure 213:
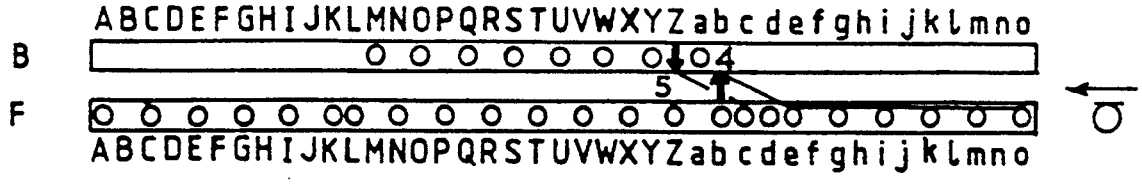
Figure 214:
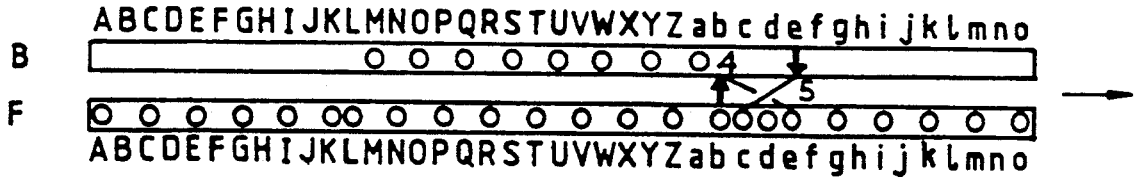
Figure 215:
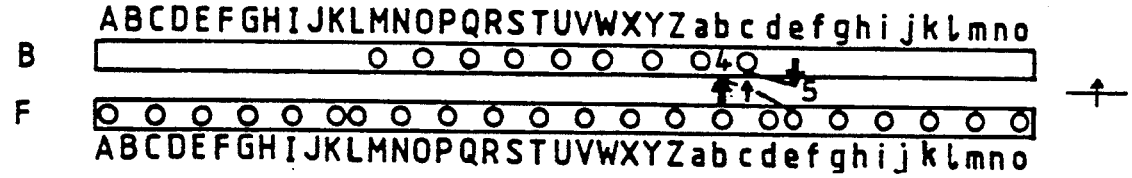
Figure 216:
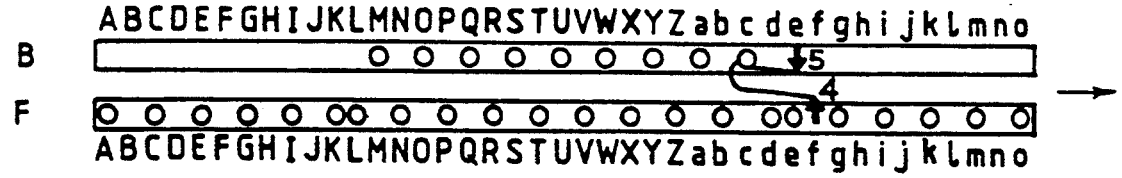
Figure 217:
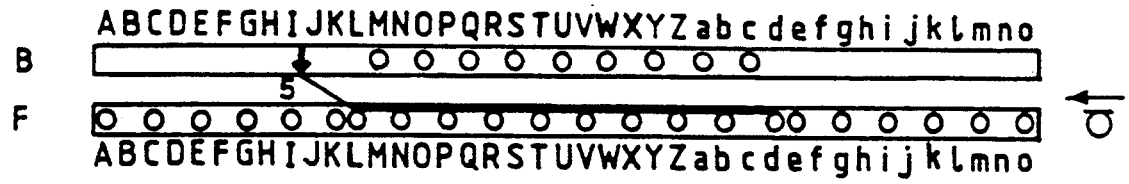
Figure 218:
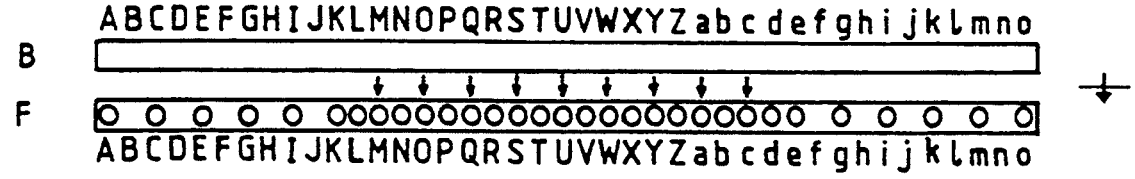
Figure 219:
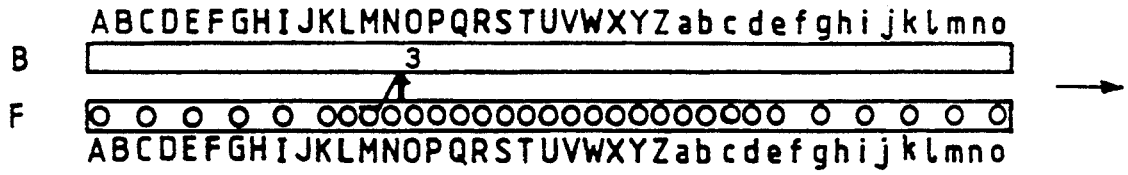
Figure 220:
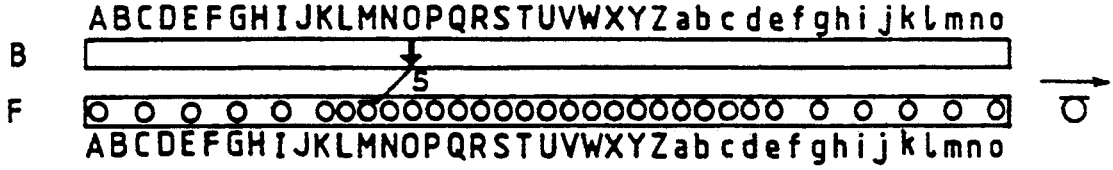
Figure 221:
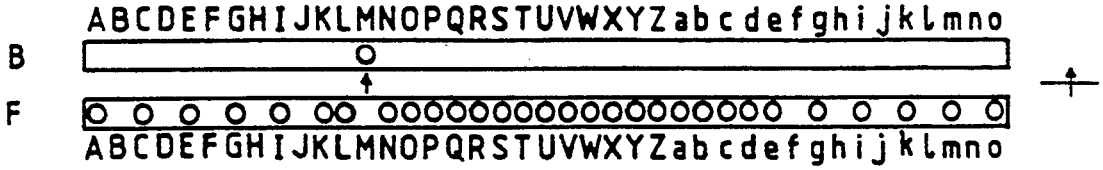
Figure 222:
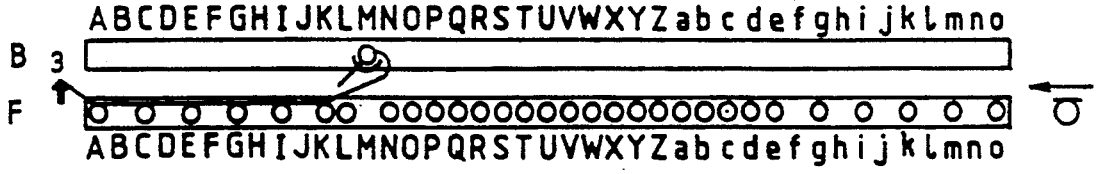
Figure 223:
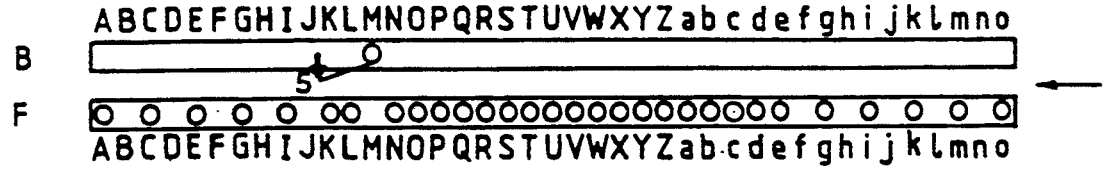
Figure 224:
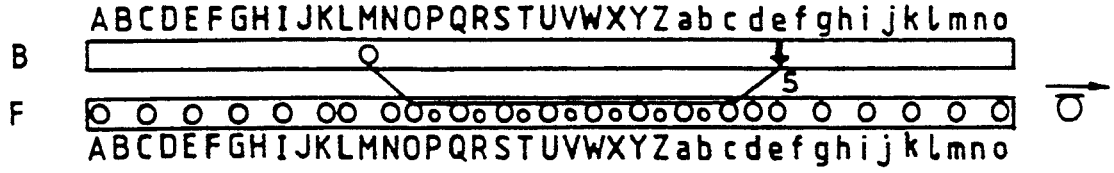
Figure 225:
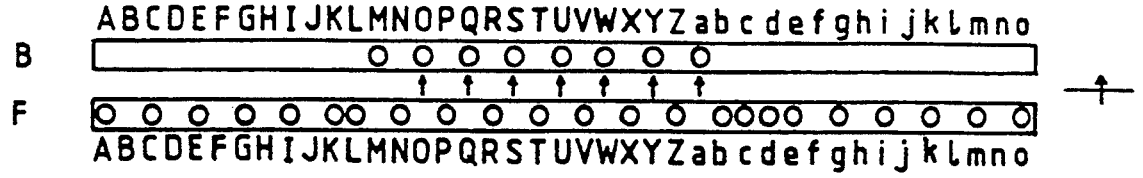
Figure 226:
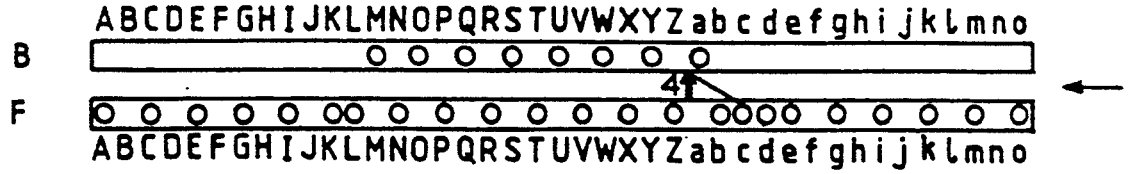
Figure 227:
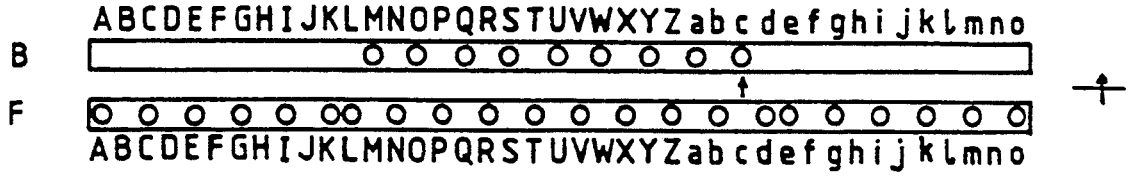
Figure 228:
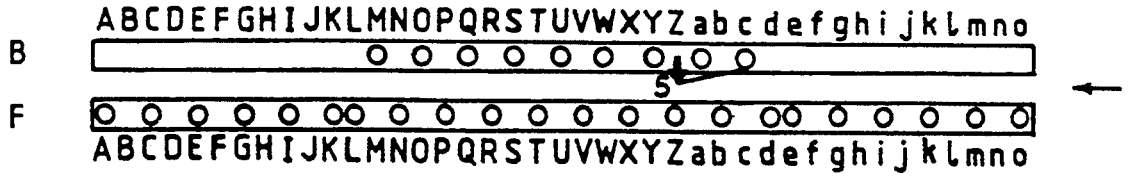
Figure 229:
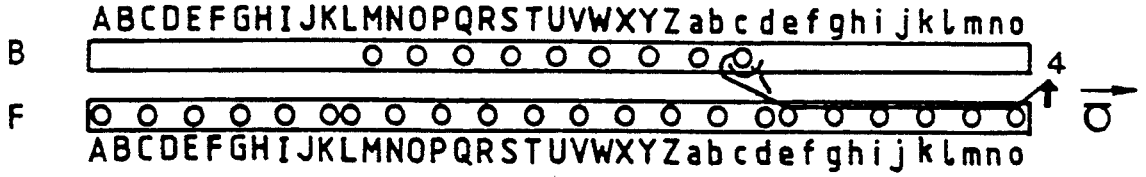
Figure 230:
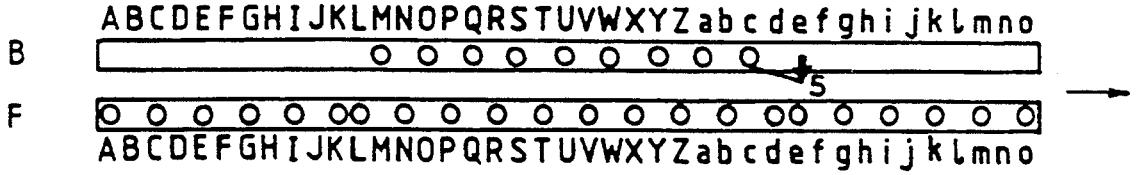
Figure 231:
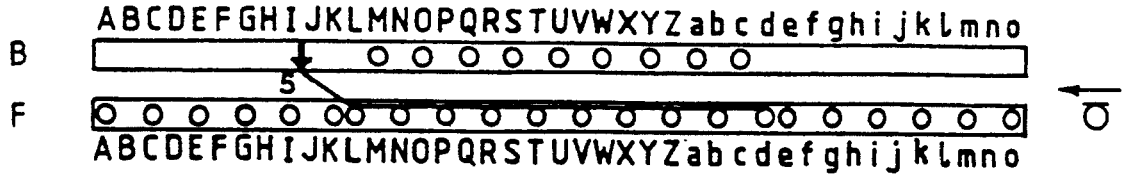
Figure 232:
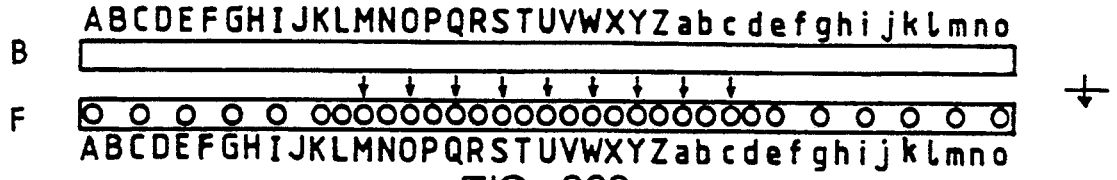
Figure 233:
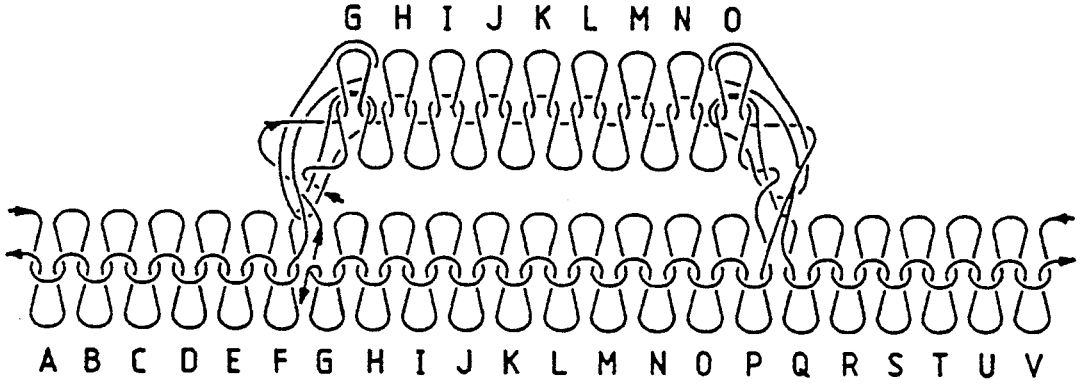
FIG. 233 is an organization chart of a knit composition corresponding to the knitted fabric shown in FIG. 2 composed by applying the fifth embodiment of the invention.
Figure 234:
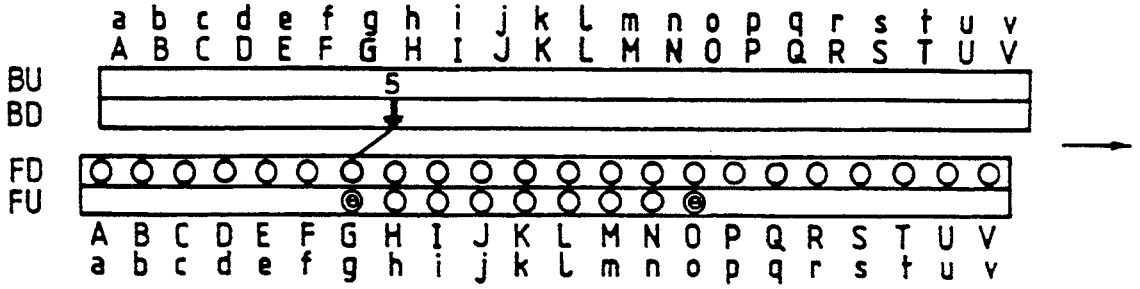
FIG. 234 through FIG. 261 are respectively explanatory of knit composing courses available for integrally forming a pocket with a body part according to the fifth embodiment of the invention.

More particularly, as is apparent from FIG. 206, of those knitting needles A through o of the needle bed F in the front position, those alternate knitting needles including A, C, E, . . . k, m, and o for example jointly operate themselves in place of the needle bed FD disposed on the bottom side in the front position made available for executing the method related to the third embodiment, whereas those remaining alternate knitting needles including B, D, F, . . . h, l, and n of the needle bed F jointly operate themselves in place of the needle bed FU disposed on the top side in the front position made available for executing the third embodiment. Likewise, of those knitting needles A through o of the other needle bed B, those alternate knitting needles including A, C, E, . . . k, m, and o for example jointly operate themselves in place of the needle bed BD disposed on the bottom side in the rear position made available for executing the method related to the invention, whereas those remaining alternate knitting needles including B, D, F, . . . h, l, and n for example jointly operate themselves in place of the other needle bed BU disposed on the top side in the rear position made available for executing the method related to the third embodiment.

Concretely, the knitting course shown in FIG. 206 corresponds to the one shown in FIG. 175 made available for executing the method related to the third embodiment. Those knitting courses shown in FIG. 206 through FIG. 234 respectively and sequentially correspond to those knitting courses shown in FIG. 175 through FIG. 205 made available for executing the method related to the third embodiment. Furthermore, in the same way as was done for the third embodiment, as shown in FIG. 174, both-side edges of the pocket 2 are linked with the front body domain 7 in the state in which knitting yarns respectively interlock with corresponding loops, and yet, the same knit organization as the front-body knitting portion 7 appears on a surface of the pocket 2, thus the pocket provides a voluminous appearance.

The Fifth Embodiment

Figure 235:
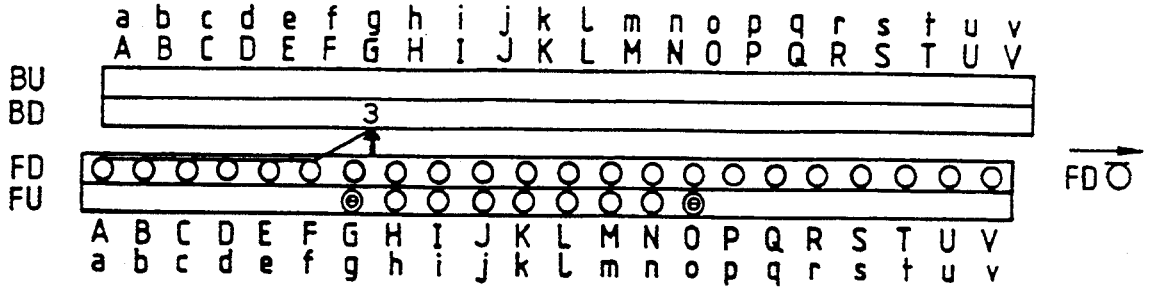

Like the first embodiment of the invention, the fifth embodiment of the invention provides the method of composing a knit wear integrally provided with an additional type pocket by applying the conventionally called "4-piece needle-bed" type flat knitting machine furnished with four needle beds each storing a number of knitting needles on the top surface by permitting them to slidably move back and forth, where these four needle beds are disposed in opposition from each other in the "/ \" shape formation in file. The fifth embodiment provides the method of composing a knit wear integrally provided with an additional-type pocket, where the bottom and both-side edges of the pocket shown in FIG. 235 are integrally linked with the front body knit.

FIG. 236 through FIG. 263 respectively designate only the changeable portions in those knitting courses made available for composing a knit wear integrated with an additional-type pocket according to the method related to the first embodiment of the invention.

It should be understood however that the number of loops corresponding to a straight region of a pocket composed by executing those knitting courses shown in FIG. 236 through FIG. 263 does not coincide with the number of those loops formed in those knitting courses shown in FIG. 32 through FIG. 45 related to the first embodiment. This is solely because the "4-piece needle-bed" flat knitting machine made available for executing the fifth embodiment of the invention provides the front needle beds and the rear needle beds by way of deviating their positions by a half pitch. Except for this deviation, the structure of the flat knitting machine made available for executing the method related to the fifth embodiment of the invention is identical to that of the flat knitting machine made available for executing the method related to the first embodiment of the invention.

Figure 236:
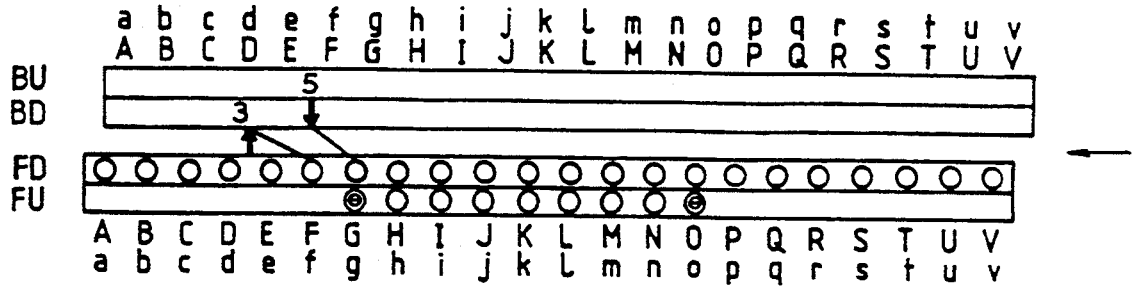
Figure 237:
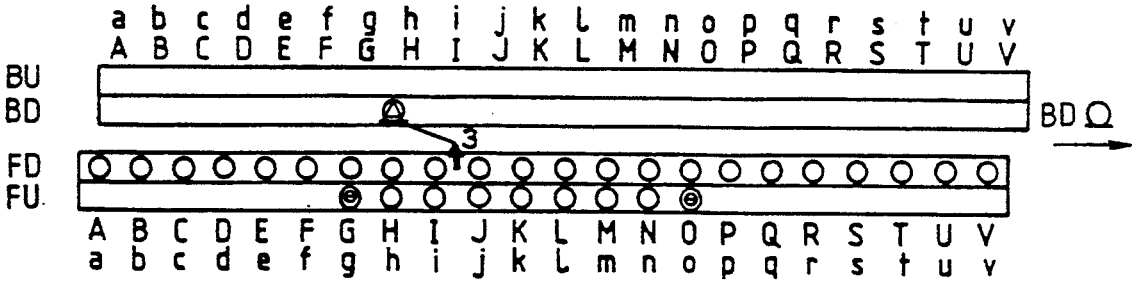
Figure 238:
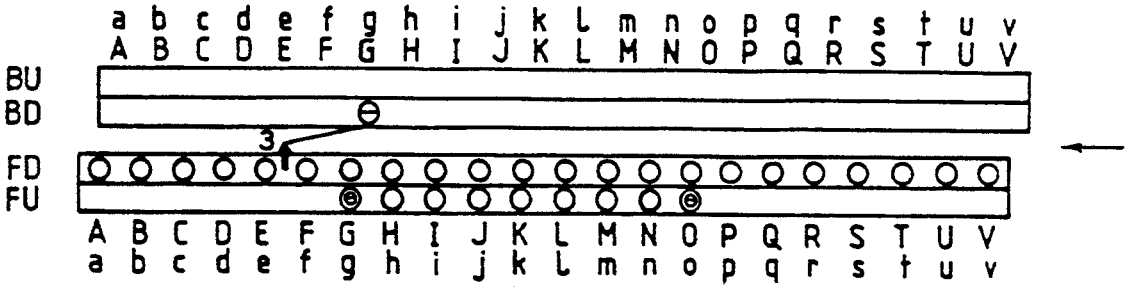

Concretely, when the knitting course shown in FIG. 236 is activated, a feeder 5 is shifted to the right. Next, when the knitting course shown in FIG. 237 is activated, another feeder 3 feeds knitting yarns to those knitting needles A through F of a needle bed FD to have them respectively form loops. Next, when the knitting course shown in FIG. 238 is activated, those feeders 3 and 5 are respectively shifted to the left. While processing the knitting course shown in FIG. 238, knitting yarns are fed to empty needles to form loops. Next, corresponding front sticks are superposed on the formed loops. Concretely, a pair of loops are formed in engagement with those knitting needles g and o of the needle bed FU superposed in file.

Figure 239:
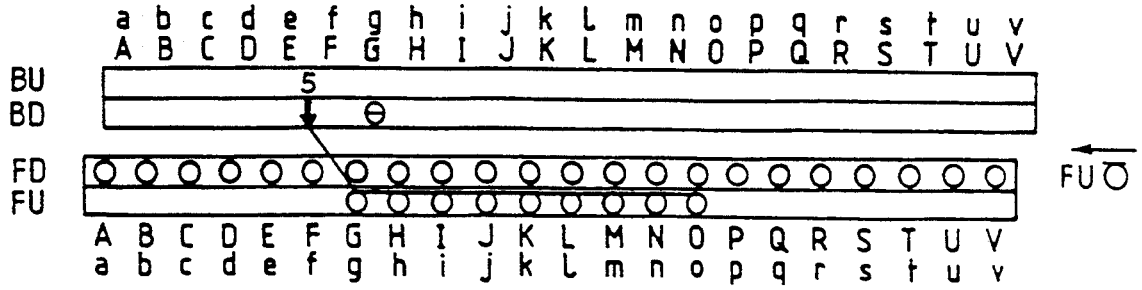
Figure 240:
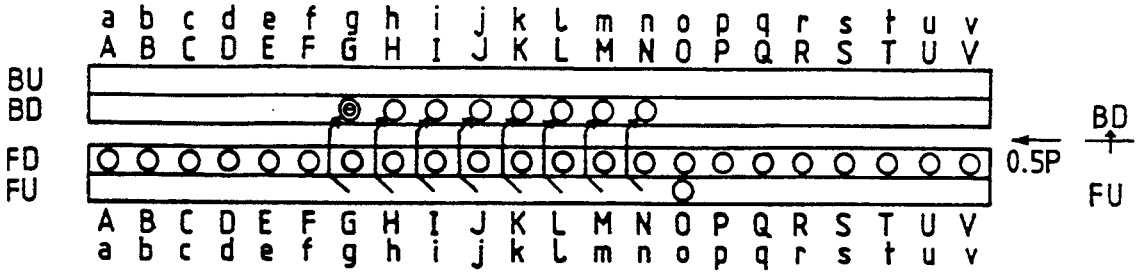
Figure 241:
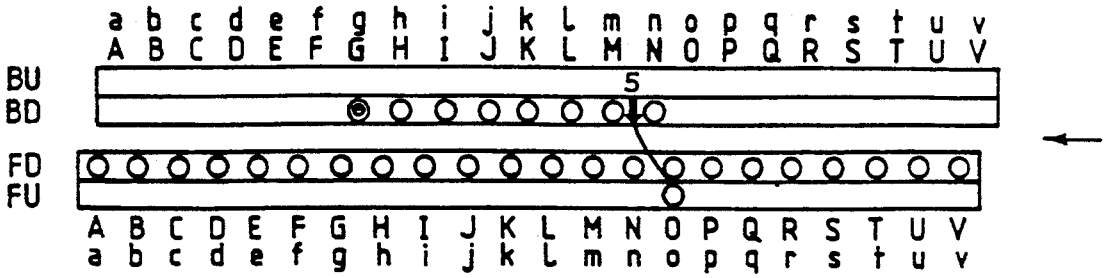

When the knitting course shown in FIG. 239 is activated, the feeder 3 feeds a knitting yarn to a knitting needle G of a needle bed BD to have it form a loop. This means that a conventionally called "empty-needle knitting" process is done. Next, when the knitting course shown in FIG. 240 is activated, the feeder 3 is shifted to the left. Next, when the knitting course shown in FIG. 241 is activated, the feeder 5 feeds knitting yarns to those knitting needles g through o of the needle bed FU to have them respectively form loops.

Figure 242:
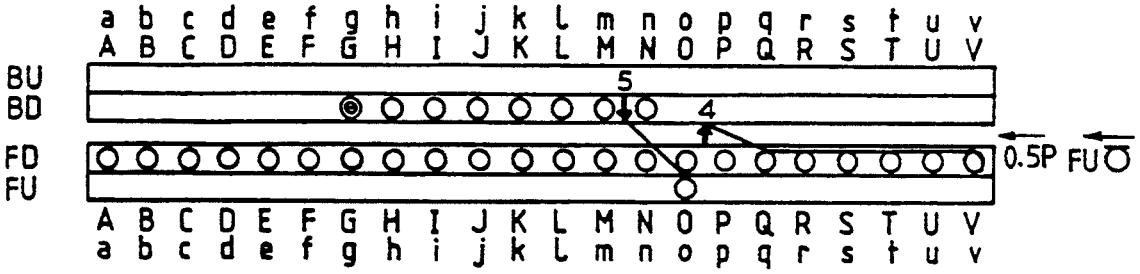
Figure 243:
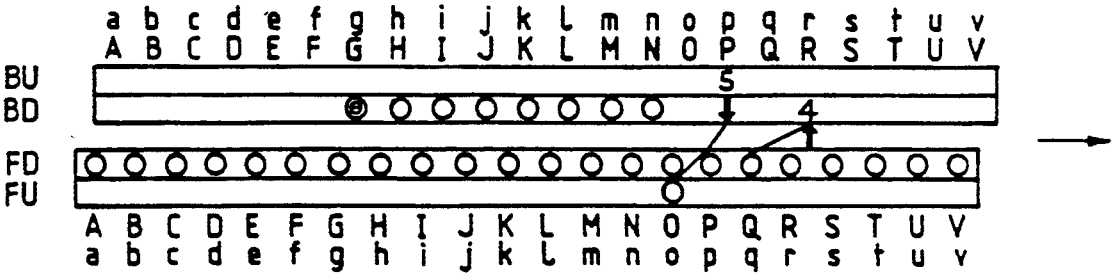

Next, when the knitting course shown in FIG. 242 is activated, those needle beds BU and BD in the rear position are respectively shifted to the left by one-half pitch, and then those loops engaged with the knitting needles g through n of the needle bed FU are respectively transferred to those knitting needles G through N of the needle bed BD. Next, when the knitting course shown in FIG. 243 is activated, the feeder 5 is shifted to the left.

Figure 244:
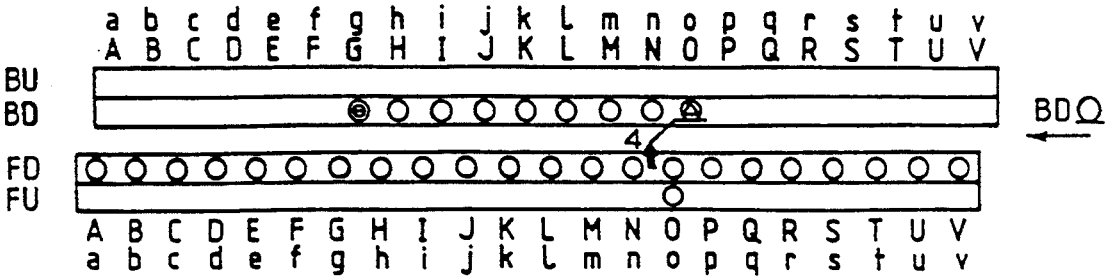
Figure 245:
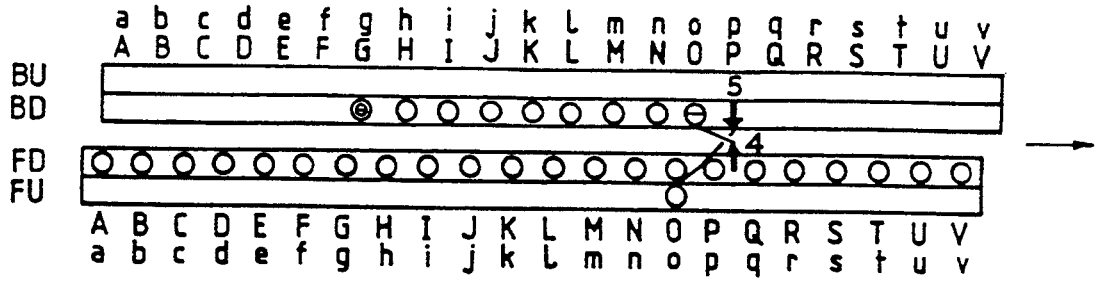
Figure 246:
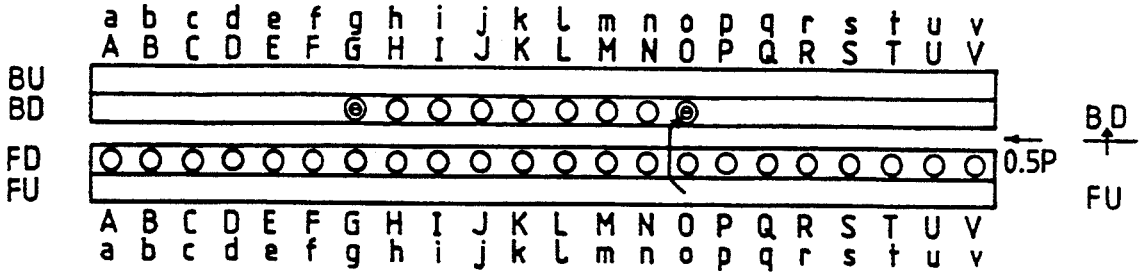

Next, when the knitting course shown in FIG. 244 is activated, those needle beds BU and BD in the rear position are respectively shifted to the left by one-half pitch, and then another feeder 4 feeds knitting yarns to those knitting needles V through Q of the needle bed FD to have them respectively form loops. Next, when the knitting course shown in FIG. 245 is activated, those needle beds BU and BD are respectively brought back to the right by one-half pitch, and then those feeders 4 and 5 are also shifted to the right. Next, when the knitting course shown in FIG. 246 is activated, the feeder 4 feeds a knitting yarn to the knitting needle G of the needle bed BD to have it form a loop.

Figure 247:
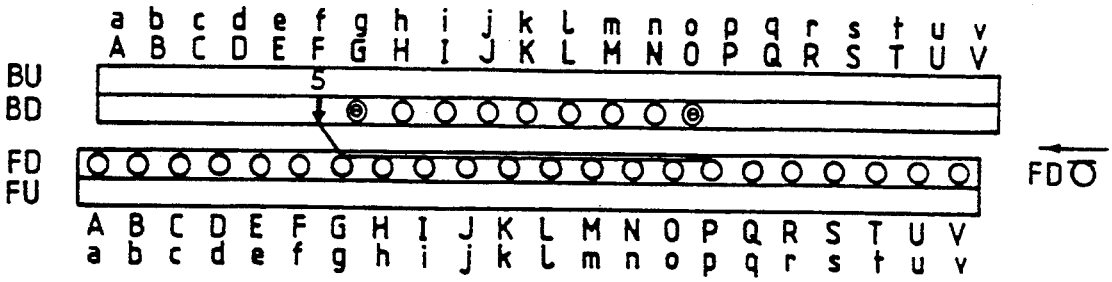
Figure 248:
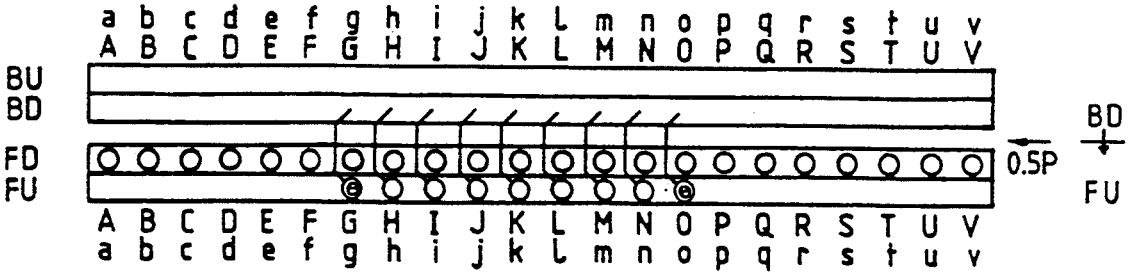

Next, when the knitting course shown in FIG. 247 is activated, the feeder 4 is shifted to the right to cause the yarn delivered from this feeder 4 to intersect the yarn delivered by the feeder 5. Next, when the knitting course shown in FIG. 248 is activated, those needle beds BU and BD are respectively shifted to the left by one-half pitch, and then, the loop engaged with the knitting needle o of the needle bed FU is transferred to the knitting needle O of the needle bed BD overlap with the loops engaged with the needle O of the needle bed BD. As a result, the right-side edge of the shaped pocket interlocks with the front body knitted fabric.

Figure 249:
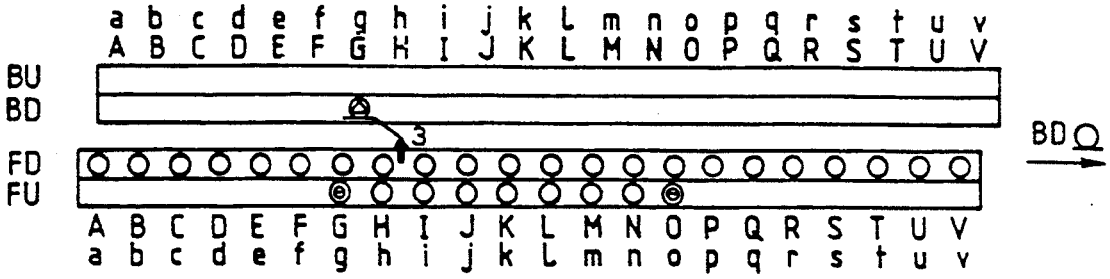
Figure 250:
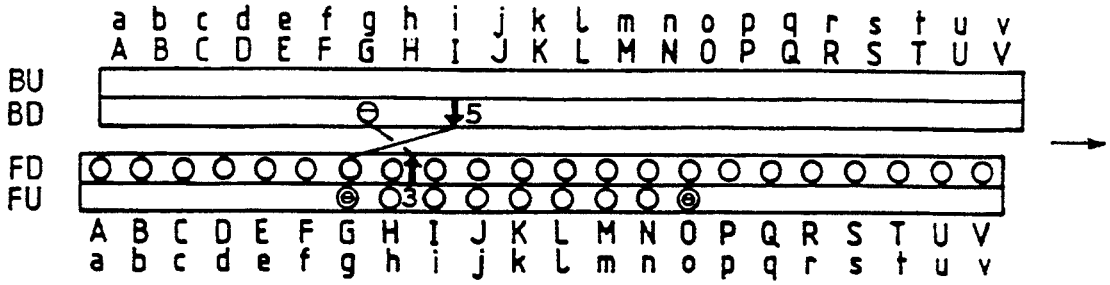

Next, when the knitting course shown in FIG. 249 is activated, those needle beds BU and BD are respectively brought back to the right by one-half pitch, and then, the feeder 5 feeds knitting yarns to those knitting needles P through G of the needle bed FD. Next, when the knitting course shown in FIG. 250 is activated, those needle beds BU and BD are respectively shifted to the left by one-half pitch, and then those loops engaged with the knitting needles G through O of the needle bed BD are respectively transferred to those knitting needles g through o of the needle bed FU.

Figure 251:
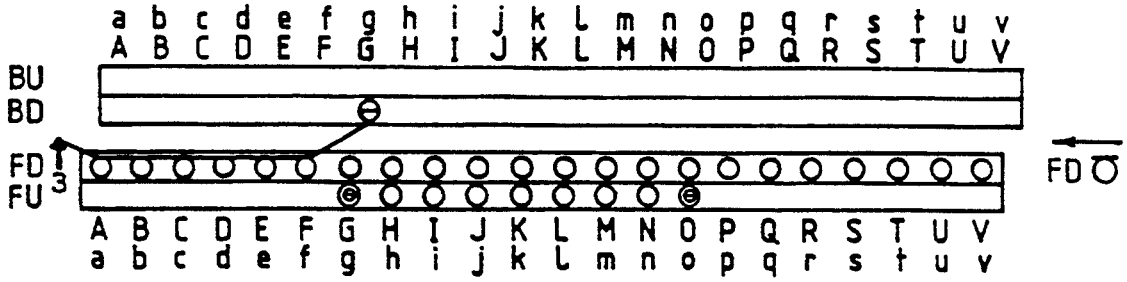
Figure 252:
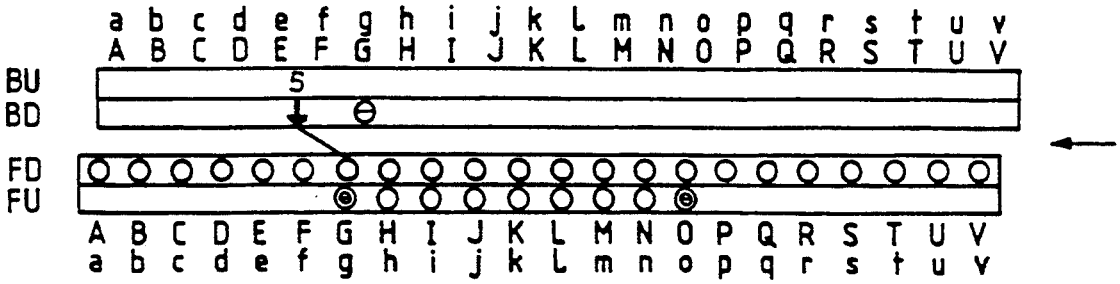
Figure 253:
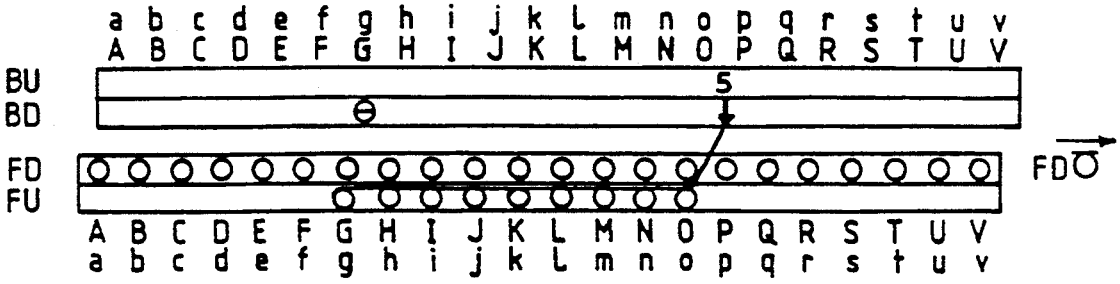
Figure 254:
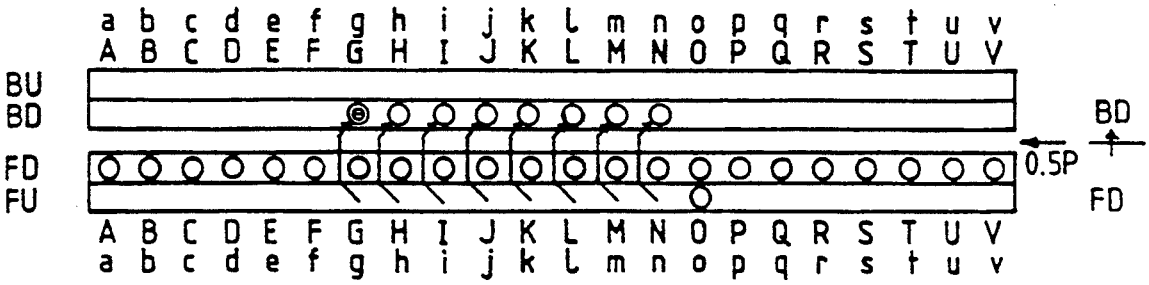
Figure 255:
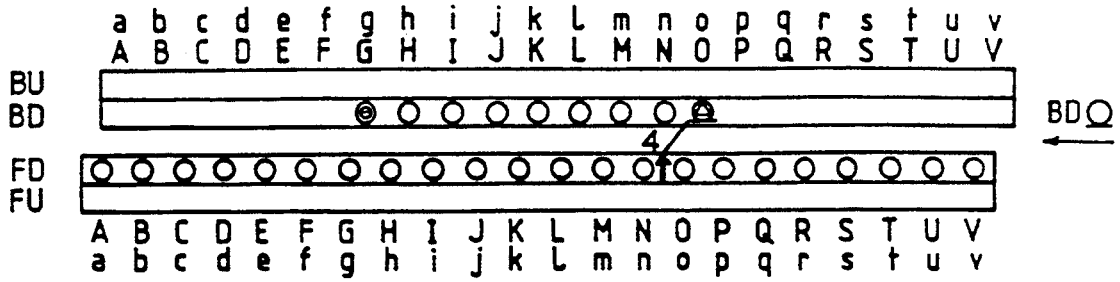
Figure 256:
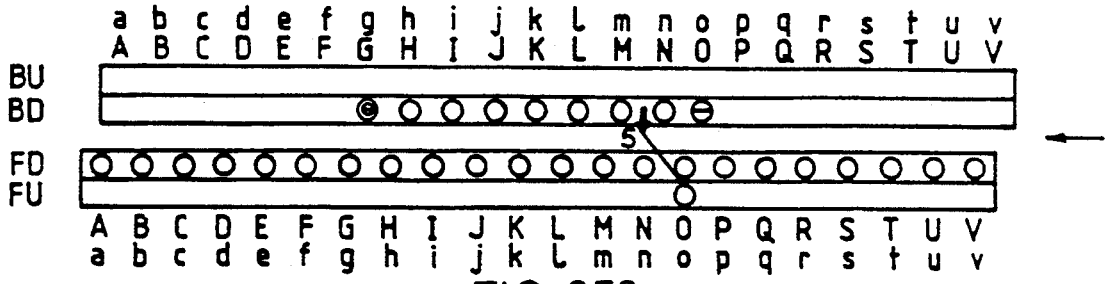
Figure 257:
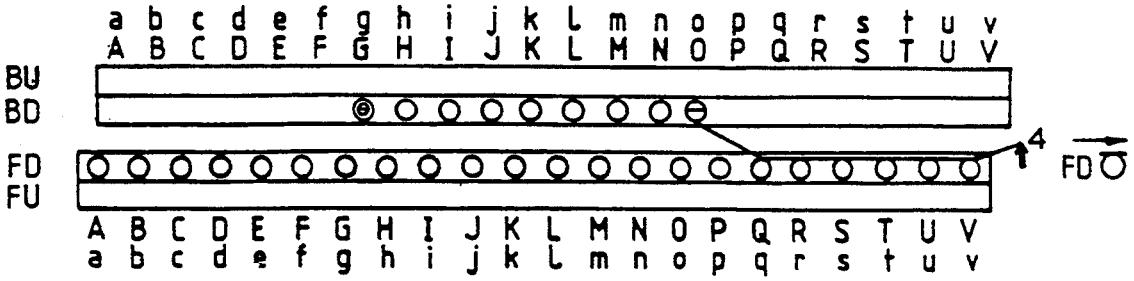

Next, when the knitting course shown in FIG. 251 is activated, the feeder 3 feeds a knitting yarn to the empty needle G of the needle bed BD to have it form a loop. Next, when the knitting course shown in FIG. 256 is activated, those needle beds BU and BD in the rear position are respectively shifted to the left by one-half pitch, and then those loops engaged with the knitting needles g through o of the needle bed FU are respectively transferred to those knitting needles G through N of the needle bed BD. Next, when the knitting course shown in FIG. 257 is activated, those needle beds BU and BD in the rear position are respectively shifted to the right by one-half pitch, and then the feeder 4 feeds a knitting yarn to the empty knitting needle O of the needle bed BD.

Figure 258:
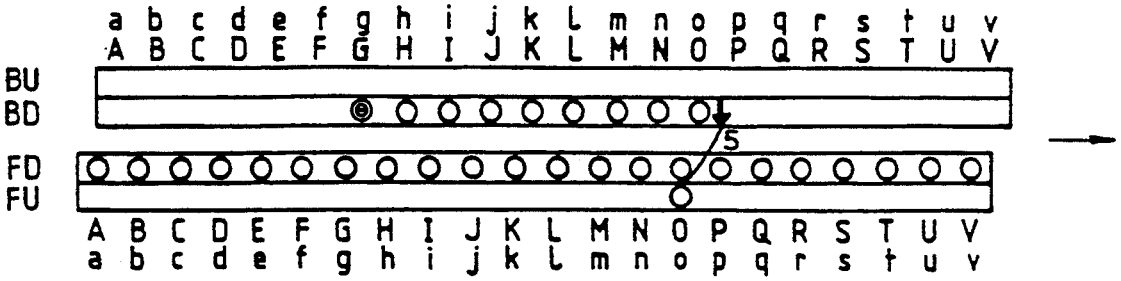
Figure 259:
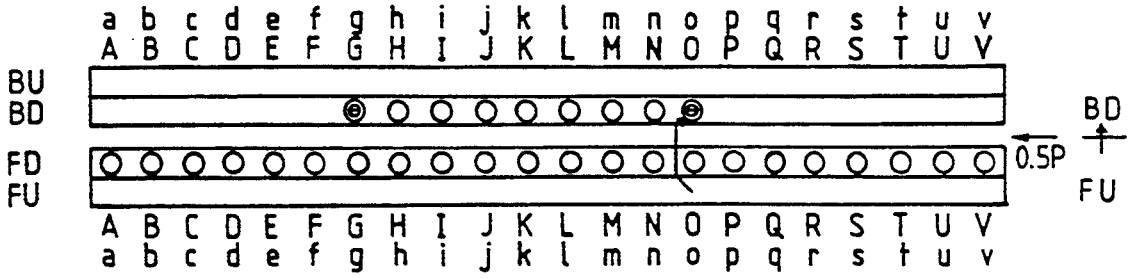
Figure 260:
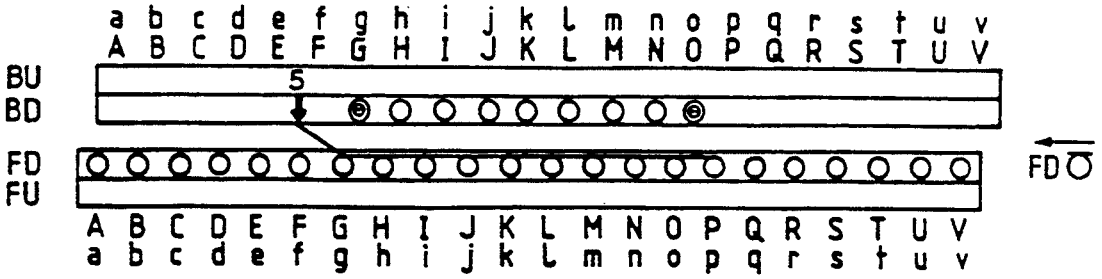
Figure 261:
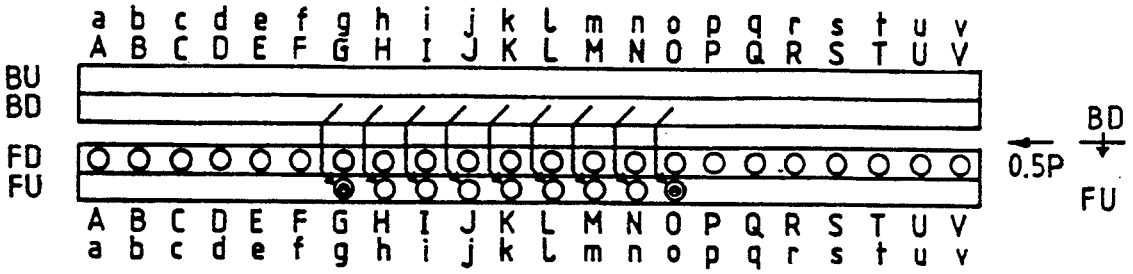

Next, when the knitting course shown in FIG. 258 is activated, the feeder 5 is shifted to the left. Next, when the knitting course shown in FIG. 259 is activated, the feeder 4 feeds knitting yarns to those knitting needles q through v of the needle bed FU. Next, when the knitting course shown in FIG. 260 is activated the feeder 5 is shifted to the right. Next, when the knitting course shown in FIG. 261 is activated, those needle beds BU and BD are respectively shifted to the left by one-half pitch, and then the loop engaged with the knitting needle o of the needle bed FU is transferred to the knitting needle O of the needle bed BD.

Figure 262:
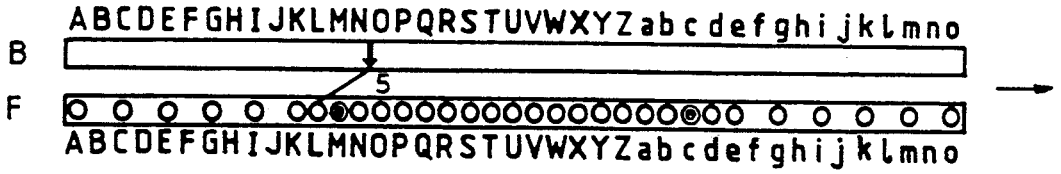
FIG. 262 through FIG. 289 are respectively explanatory of knit composing courses available for integrally forming a pocket with a body part according to the sixth embodiment of the invention.
Figure 263:
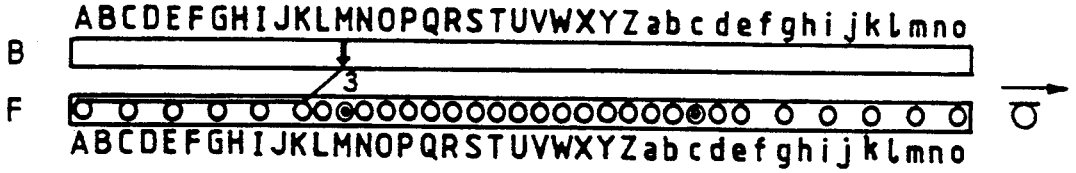

Next, when the knitting course shown in FIG. 262 is activated, those needle beds BU and BD in the rear position are respectively shifted to the right by one-half pitch in return, and then, the feeder 5 feeds knitting yarns to those knitting needles P through G of the needle bed FD to have them respectively form loops. Next, when the knitting course shown in FIG. 263 is activated, those needle beds BU and BD in the rear position are respectively shifted to the left by one-half pitch, and then those loops engaged with the knitting needles G through O of the needle bed BD are respectively transferred to those knitting needles g through o of the needle bed FU. Henceforth, the flat knitting machine available for executing the fifth embodiment repeatedly executes those knitting processes shown in FIG. 236 through FIG. 263 before eventually composing the straight portion of the pocket 2.

As shown in FIG. 236, both-side edges of the pocket 2 composed by executing the above processes are integrally linked to the front body knitted domain 7 solely by means of knitting, where the "intarsia jacquard" is made available for the knit.

The Sixth Embodiment

As described earlier, the method related to the fifth embodiment of the invention for composing a knit wear integrally provided with an additional-type pocket makes use of a conventionally called "4-piece needle-bed" type flat knitting machine which is furnished with four needle beds in file each storing a number of knitting needles on the top surface by permitting these knitting needles to slidably move back and forth, where these needle beds are respectively disposed in opposition from each other in the "/ \" shape formation. On the other hand, the sixth embodiment of the invention provides the method of composing a knit wear integrally provided with an additional-type pocket by operating a conventionally called "2-piece needle-bed" type flat knitting machine which is furnished with a pair of needle beds each storing a number of knitting needles on the top surface by permitting these knitting needles to slidably move back and forth, where these needle beds are also disposed in opposition from each other in the "/ \" shape formation. Concretely, using the "2-piece needle-bed" type flat knitting machine, the sixth embodiment of the invention provides the method of composing a knitted fabric integrally provided with an additional-type pocket by arranging the bottom and both-side edges of the pocket to be interlocked with the front body knitted fabric in the state in which knitting yarns are linked with loops by means of a knit.

Figure 264:
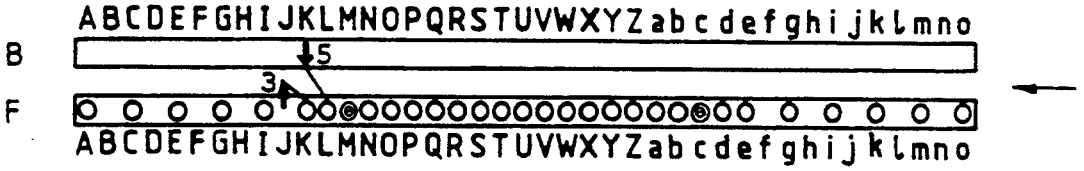
Figure 265:
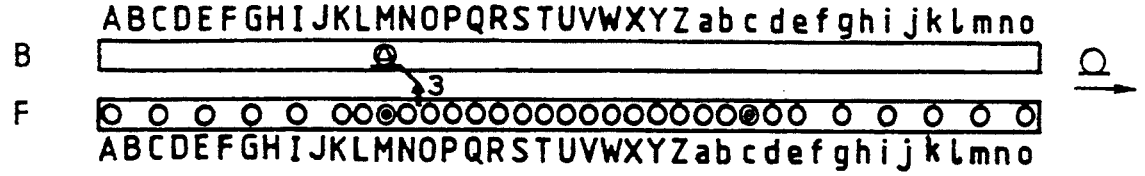
Figure 266:
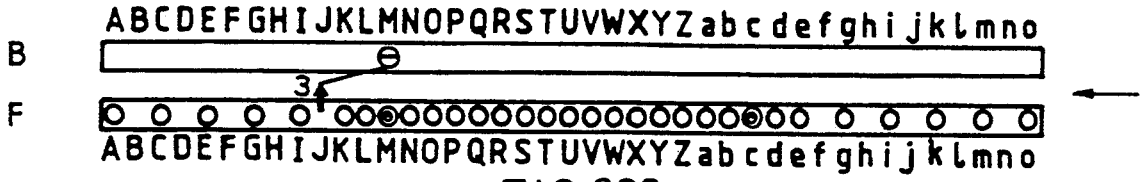
Figure 267:
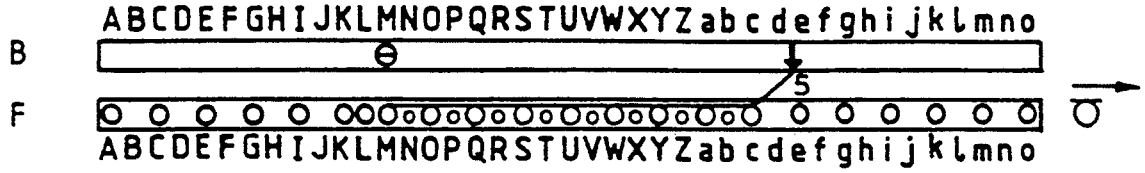
Figure 268:
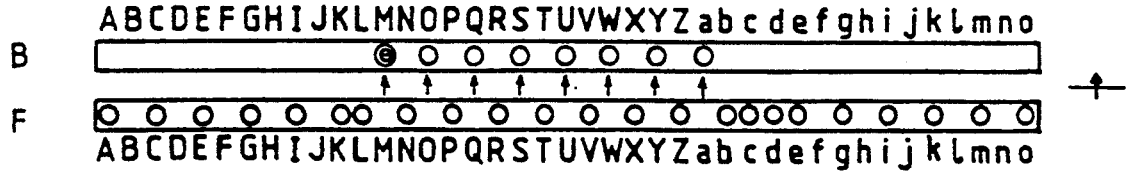
Figure 269:
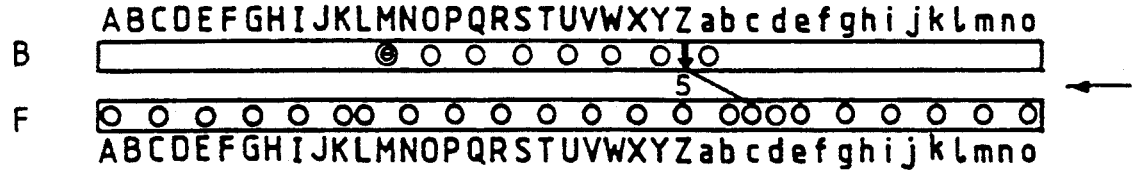
Figure 270:
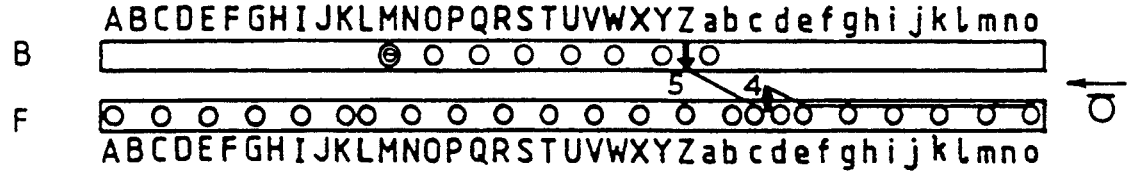
Figure 271:
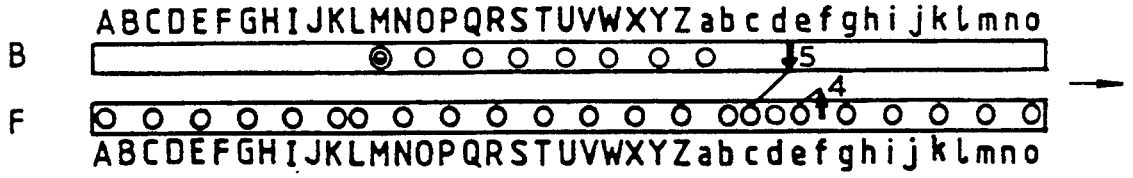
Figure 272:
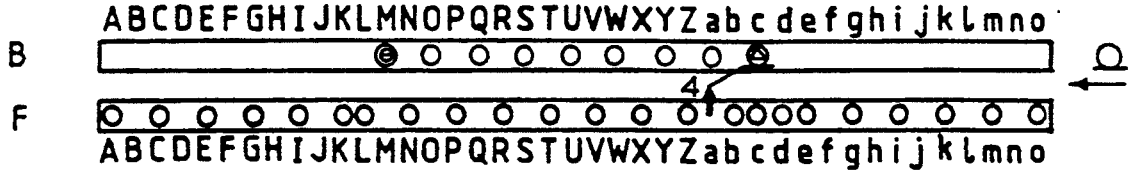
Figure 273:
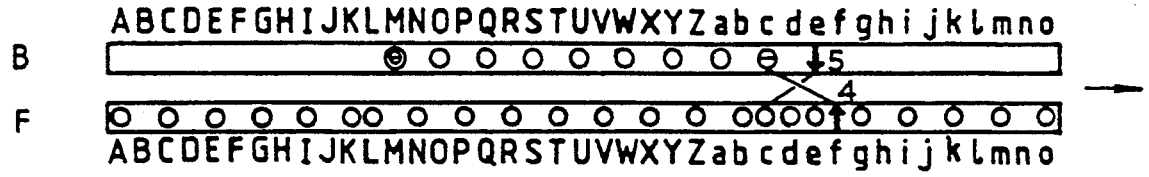
Figure 274:
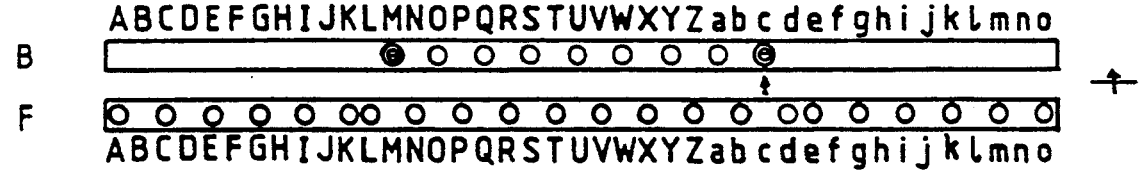
Figure 275:
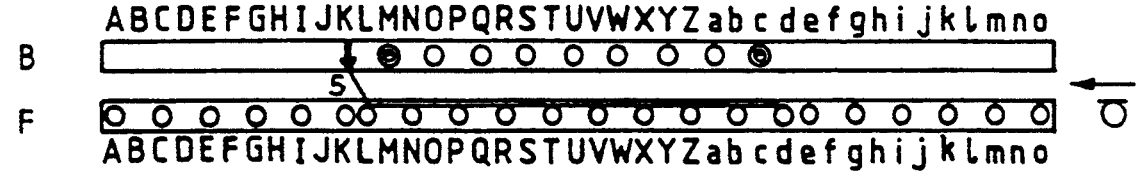
Figure 276:
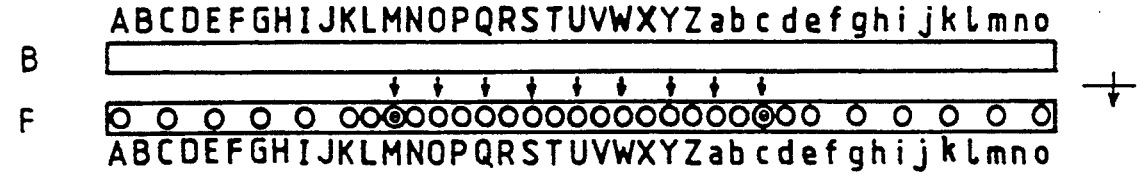
Figure 277:
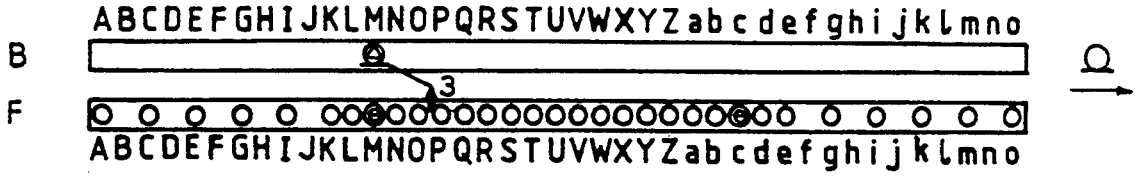
Figure 278:
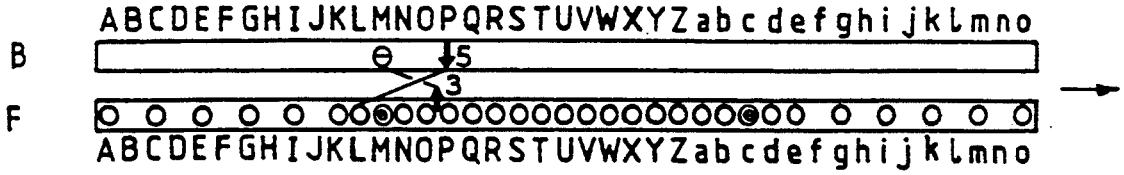
Figure 279:
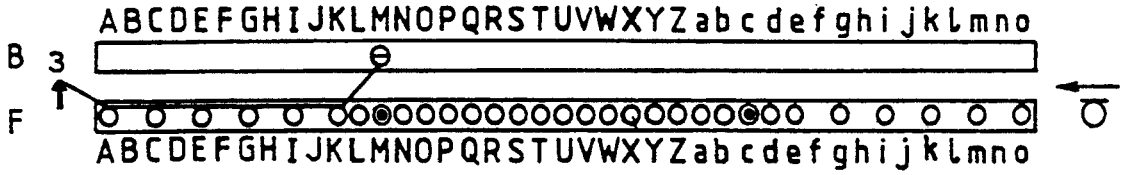
Figure 280:
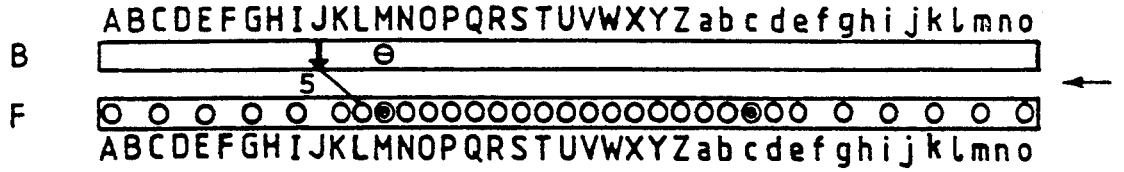
Figure 281:
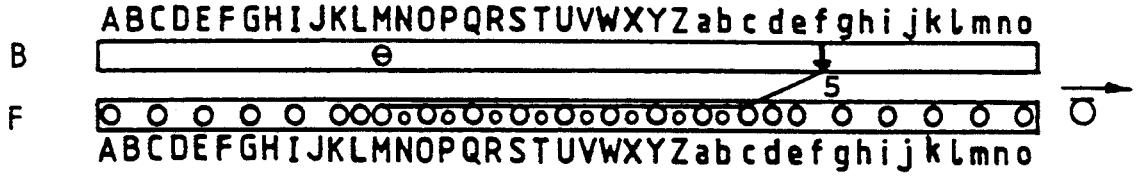
Figure 282:
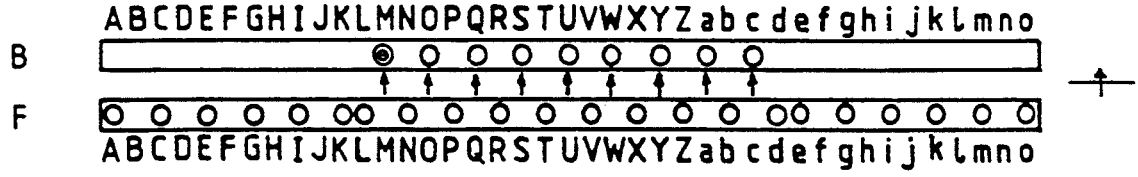
Figure 283:
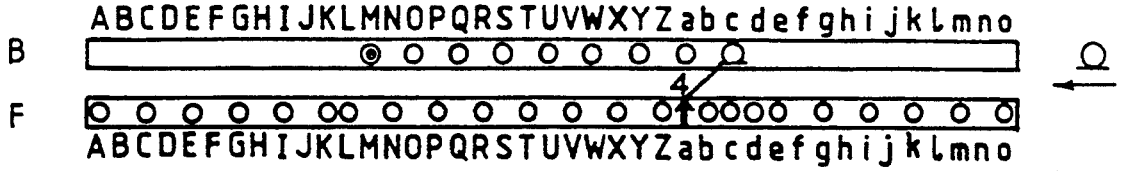
Figure 284:
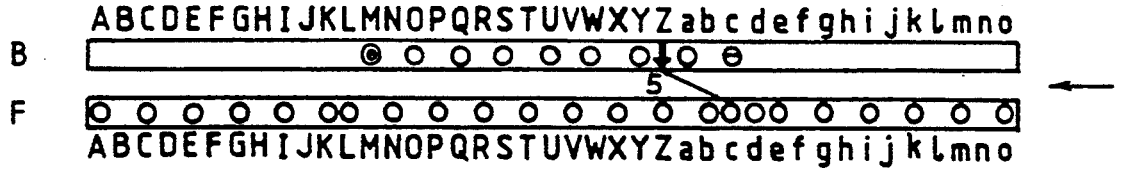
Figure 285:
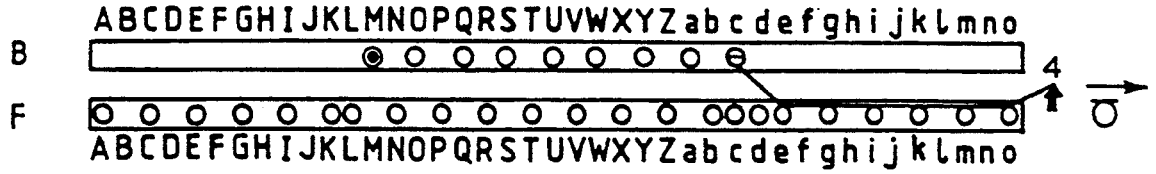
Figure 286:
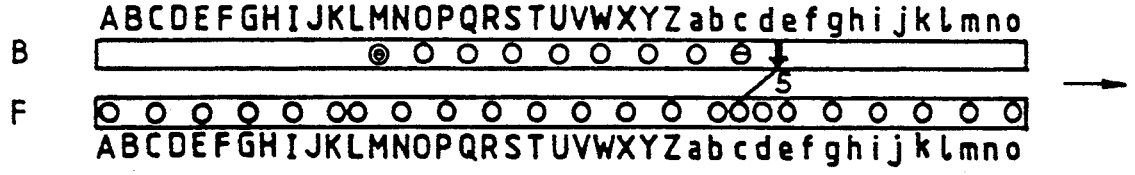
Figure 287:
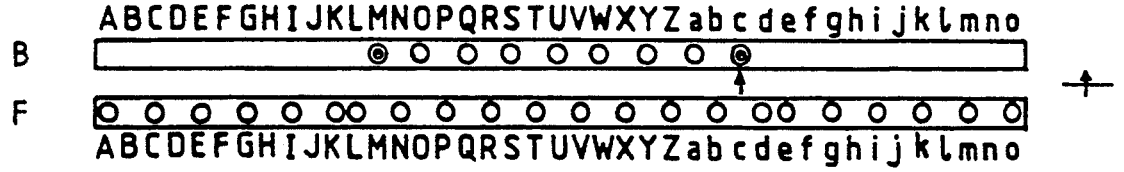
Figure 288:
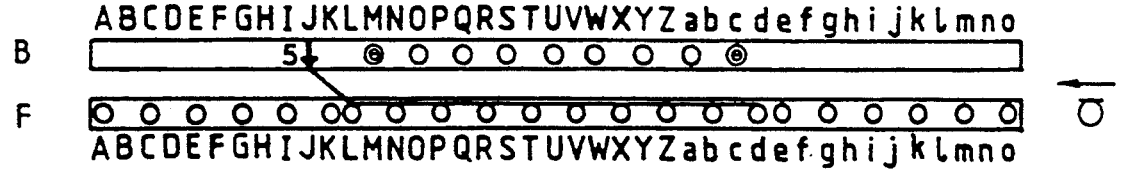
Figure 289:
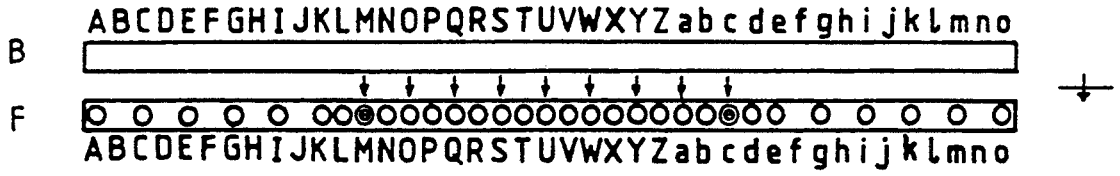
Figure 290:
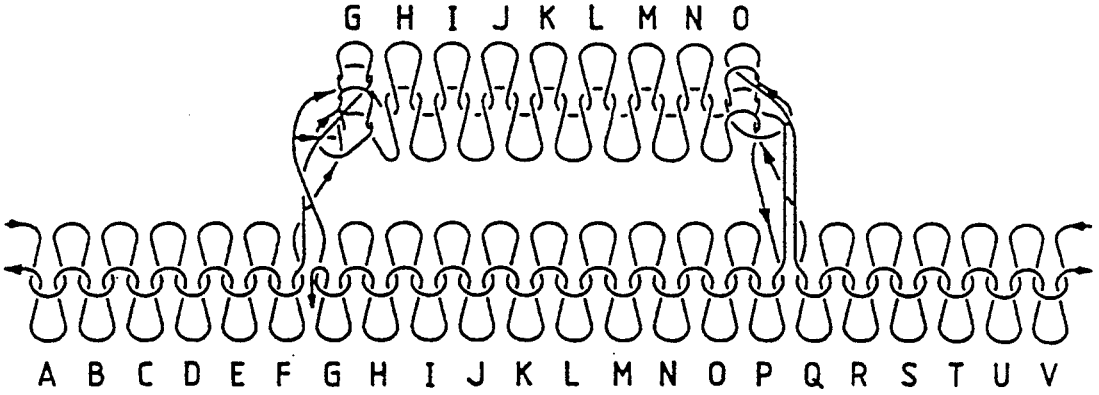
FIG. 290 is an organization chart of a knit composition corresponding to the knitted fabric shown in FIG. 2 composed by applying the seventh embodiment of the invention.
Figure 291:
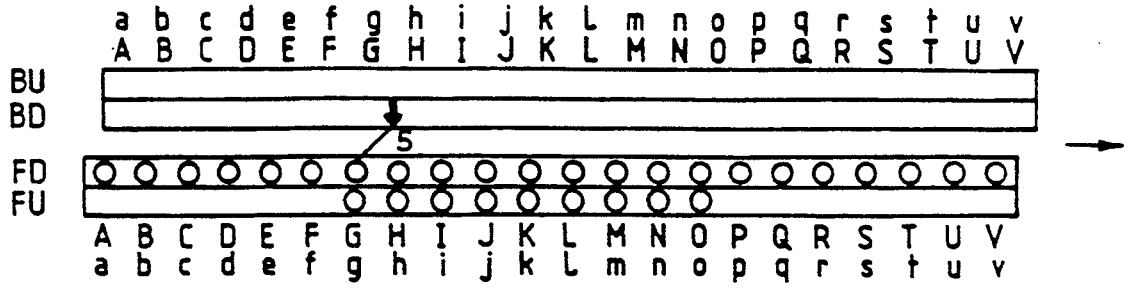
FIG. 291 through FIG. 320 are respectively explanatory of knit composing courses available for integrally forming a pocket with a body part according to the seventh embodiment of the invention.

More particularly, as is apparent from FIG. 264, of those knitting needles Q through o of the needle bed F present in the front position, those alternate knitting needles including A, C, E, . . . k, m, and o jointly operate themselves in place of the needle bed FD disposed on the bottom side in the front position made available for the fifth embodiment, whereas those remaining alternate knitting needles including B, D, F, . . . h, l, and n jointly operate themselves in place of the needle bed FU disposed on the top side in the front position made available for the fifth embodiment. In addition, of those knitting needles A through o of the needle bed B in the rear position for example, those alternate knitting needles including A, C, E, . . . k, m, and o jointly operate in place of the needle bed BD disposed on the bottom side in the rear position made available for the fifth embodiment, whereas those remaining alternate knitting needles B, D, F, . . . h, l, and n jointly operate themselves in place of the needle bed BU disposed on the top side in the rear position made available for the fifth embodiment of the invention.

Concretely, the knitting course shown in FIG. 264 corresponds to the one shown in FIG. 236 made available for executing the method related to the fifth embodiment. Those knitting courses shown in FIG. 265 through FIG. 291 respectively and sequentially correspond to those knitting courses shown in FIG. 237 through FIG. 263 made available for executing the fifth embodiment of the invention. Like the fifth embodiment described above, as shown in FIG. 235, both-side edges of the pocket 2 are linked with the front body knitted domain 7 in the state in which knitting yarns respectively interlock with corresponding loops, and yet, knit organization of the front body knit domain 7 concealed in the pocket region is superficially formed, thus eventually providing a quality pocket abundant in bulkiness characteristic of the additional type pocket.

The Seventh Embodiment

Figure 292:
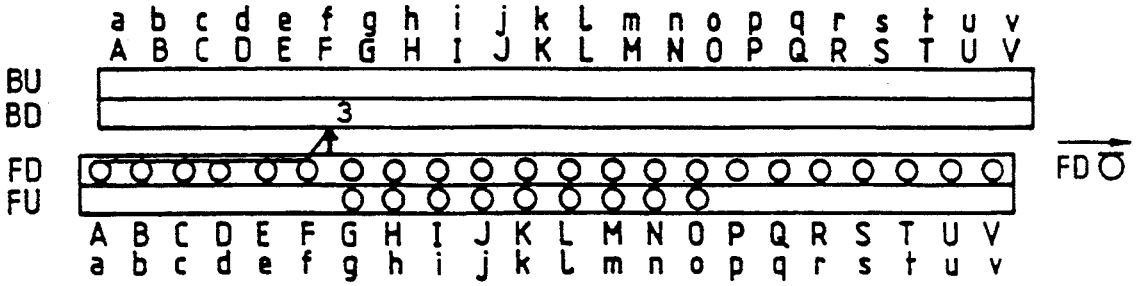

Like the first embodiment of the invention, the seventh embodiment of the invention provides the method of composing a knit wear integrally provided with an additional type pocket by applying the conventionally called "4-piece needle-bed" type flat knitting machine furnished with four needle beds each storing a number of knitting needles on the top surface by permitting them to slidably move back and forth, where these four needle beds are disposed in opposition from each other in the "/ \" shape formation in file. The seventh embodiment of the invention provides the method of composing a knit wear integrally provided with an additional-type pocket, where the bottom and both-side edges of the pocket shown in FIG. 292 are integrally linked with the front body knit.

FIG. 293 through FIG. 322 respectively designate only the changeable portions in those knitting courses made available for composing a knit wear integrated with an additional type pocket according to the method related to the first embodiment of the invention.

It should be understood however that the actual number of loops corresponding to a straight portion of a pocket composed by processing those knitting courses shown in FIG. 293 through FIG. 322 does not coincide with the actual number of those loops formed in those knitting courses shown in FIG. 32 through FIG. 45 related to the first embodiment. This is solely because the "4-piece needle-bed" type flat knitting machine available for executing the seventh embodiment provides the front needle beds and the rear needle beds by way of deviating their positions by a half pitch. Except for this deviation, the structure of the flat knitting machine available for executing the method according to the seventh embodiment is identical to that of the flat knitting machine made available for executing the method according to the first embodiment of the invention described earlier.

Figure 293:
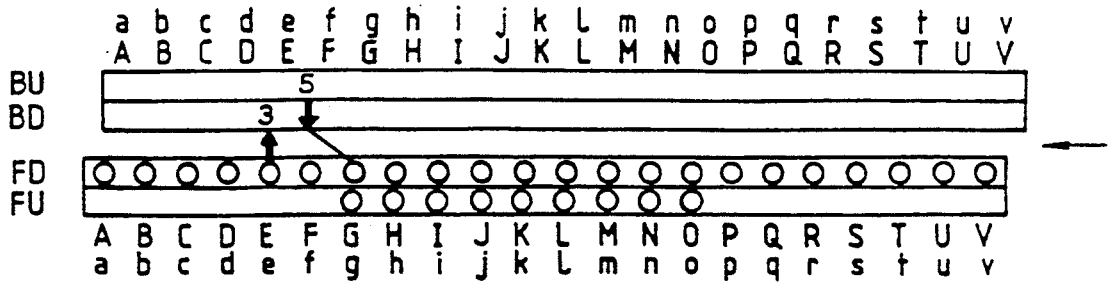
Figure 294:
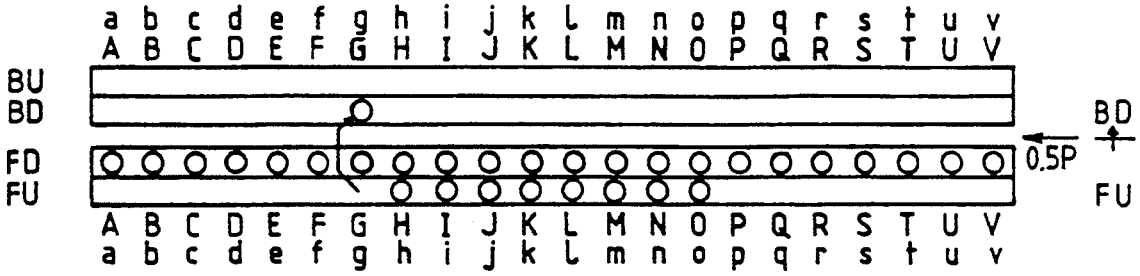
Figure 295:
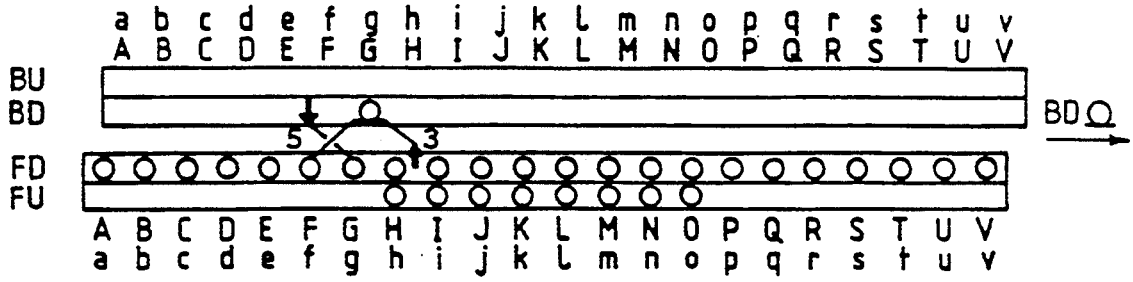

Concretely, when the knitting course shown in FIG. 293 is activated, a feeder 5 is shifted to the right. Next, when the knitting course shown in FIG. 294 is activated, another feeder 3 feeds knitting yarns to those knitting needles A through F of a needle bed FD to have them respectively form loops. Next, when the knitting course shown in FIG. 295 is activated, these feeders 3 and 5 are respectively shifted to the left.

Figure 296:
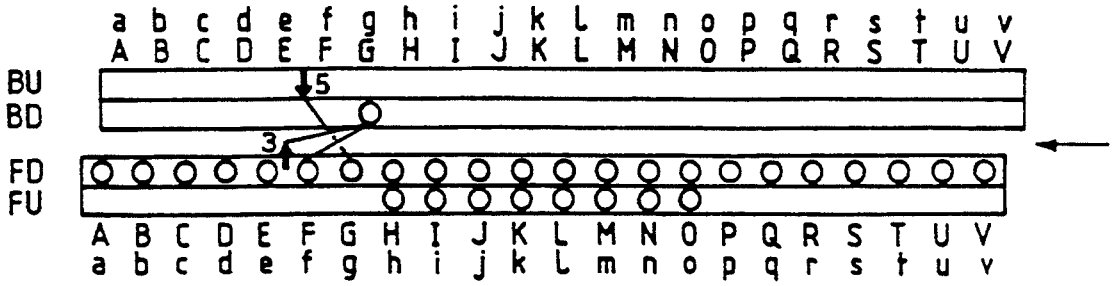
Figure 297:
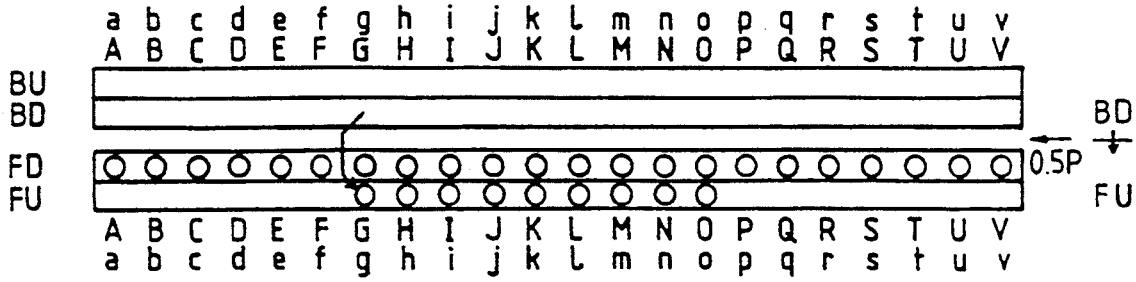

When the following knitting course shown in FIG. 296 is activated, those needle beds BU and BD in the rear position are respectively shifted to the left by one-half pitch, and then the loop engaged with a knitting needle g of a needle bed FU is transferred to a knitting needle G of the needle bed BD, and then causes the feeder 3 to feed a knitting yarn to a knitting needle G of the needle bed BD to have it form a loop.

Figure 298:
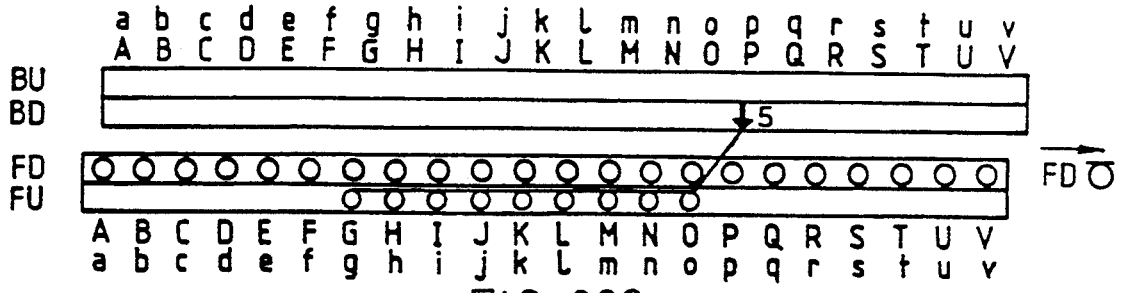
Figure 299:
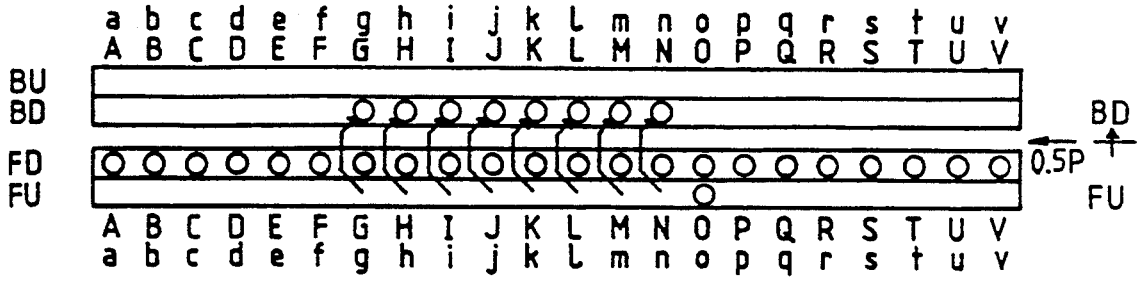

Next, when the knitting course shown in FIG. 298 is activated, the feeder 3 is shifted to the left. Next, when the knitting course shown in FIG. 299 is activated, initially, those needle beds BU and BD in the rear position are respectively shifted to the left by one-half pitch, and then, the loop engaged with the knitting needle G of the needle bed BD is transferred to the knitting needle g of the needle bed FU.

Figure 300:
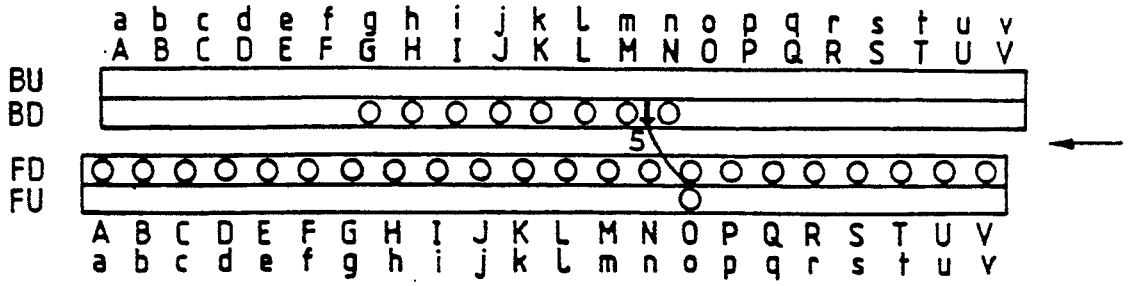

Next, when the knitting course shown in FIG. 300 is activated, those needle beds BU and BD are respectively brought back to the right by one-half pitch, and then causes the feeder 5 to feed knitting yarns to those knitting needles G through o of the needle bed FU to have them respectively form loops.

Figure 301:
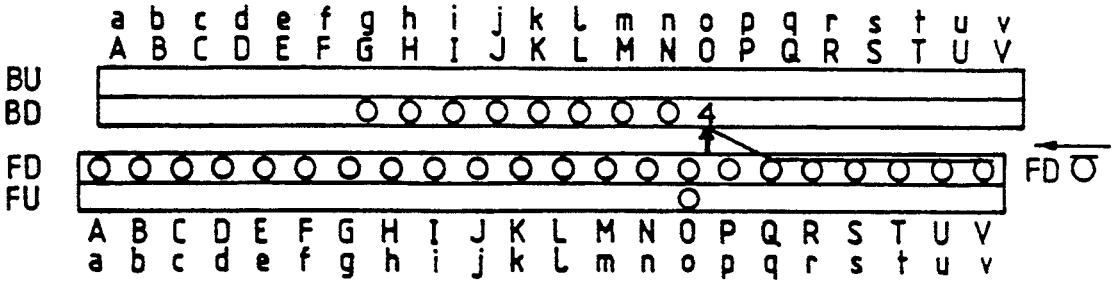
Figure 302:
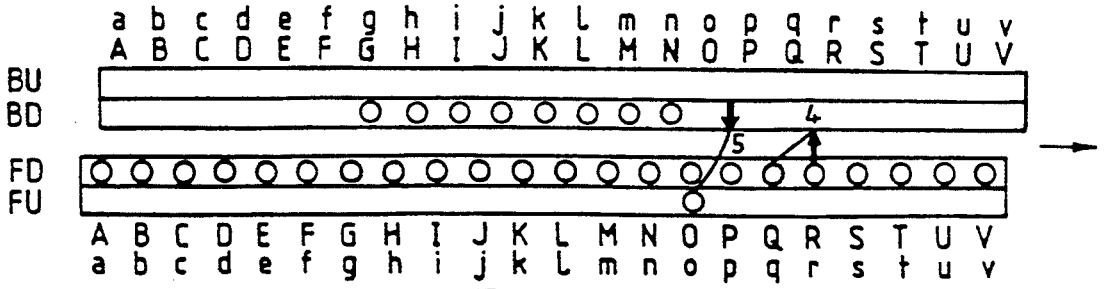

Next, when the knitting course shown in FIG. 301 is activated, those needle beds BU and BD in the rear position are respectively shifted to the left by one-half pitch, and then, those loops engaged with the knitting needles g through n of the needle bed FU are transferred to those knitting needle G through N of the needle bed BD. Next, when the knitting course shown in FIG. 302 is activated, those needle beds BU and BD are respectively brought back to the right by one-half pitch, and then causes the feeder 5 to feed a knitting yarn to the knitting needle o of the needle bed FU.

Figure 303:
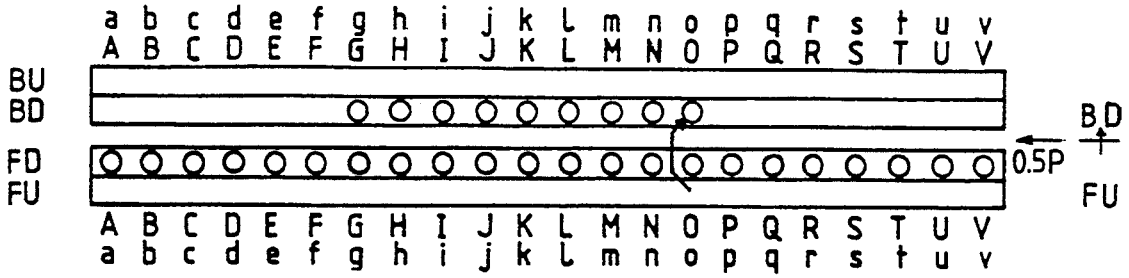
Figure 304:
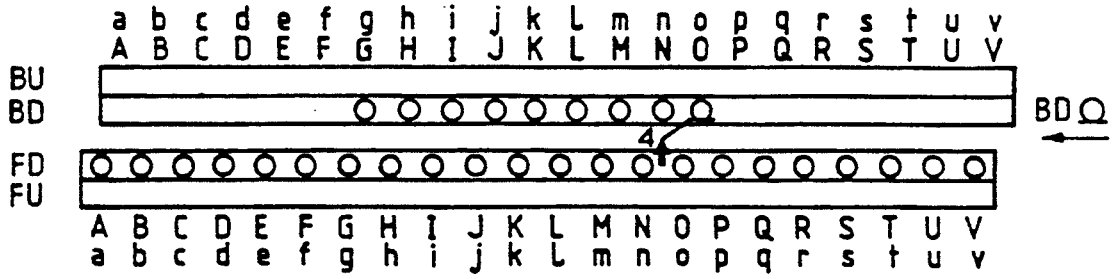
Figure 305:
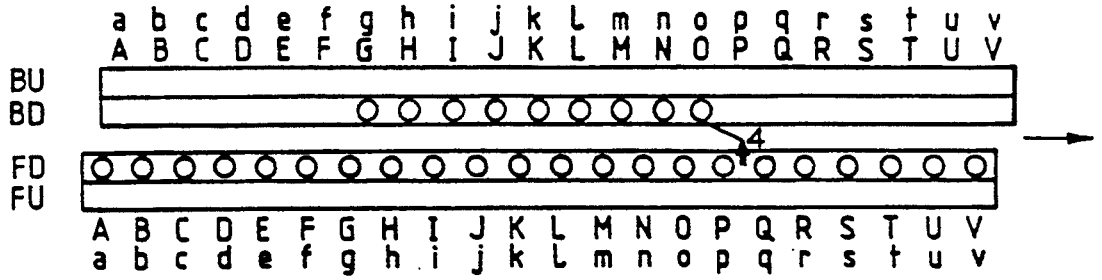

Next, when the knitting course shown in FIG. 303 is activated, another feeder 4 feeds knitting yarns to those knitting needles V through Q of the needle bed FD to have them respectively form loops. Next, when the knitting course shown in FIG. 304 is activated, those feeders 4 and 5 are respectively shifted to the right. When the following knitting course shown in FIG. 305 is activated, initially, those needle beds BU and BD are respectively shifted to the left by one-half pitch, and then the loop engaged with the knitting needle o of the needle bed FU is transferred to the knitting needle O of the needle bed BD.

Figure 306:
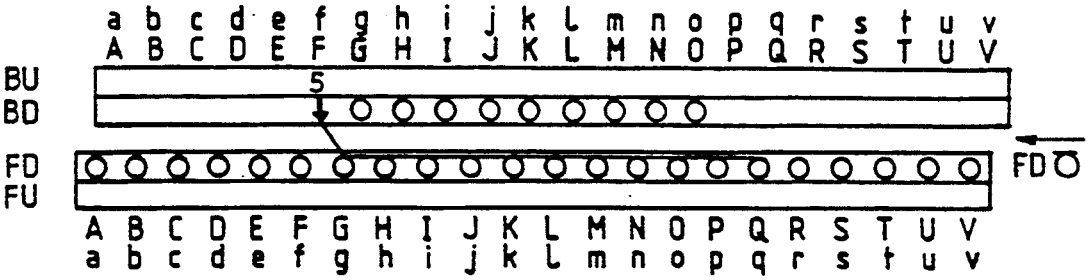
Figure 307:
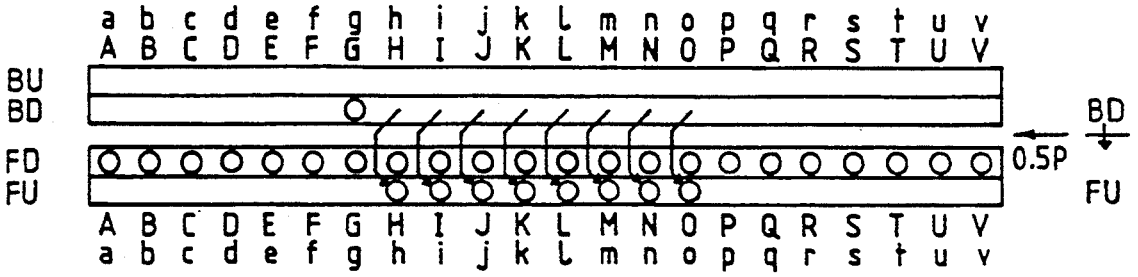

Next, when the knitting course shown in FIG. 306 is activated, those needle beds BU and BD are respectively shifted to the right by one-half pitch, and then causes the feeder 4 to feed a knitting yarn to the knitting needle O of the needle bed BD to have it form a loop. Next, when the knitting course shown in FIG. 307 is activated, the feeder 4 is shifted to the right.

Figure 308:
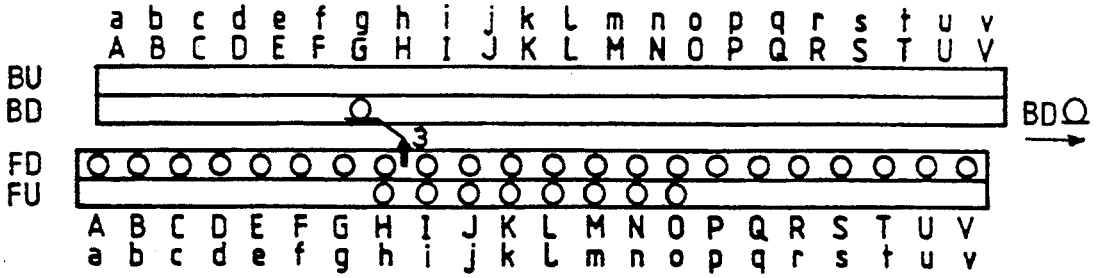
Figure 309:
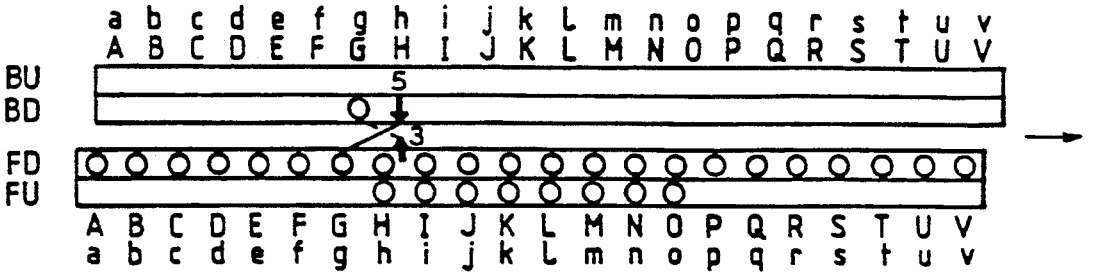

Next, when the knitting course shown in FIG. 308 is activated, the feeder 5 feeds knitting yarns to those knitting needles P through G of the needle bed FD to have them respectively form loops. Next, when the knitting course shown in FIG. 309 is activated, those needle beds BU and BD in the rear position are respectively shifted to the left by one-half pitch, and then, those loops engaged with the knitting needles H through O of the needle bed BD are respectively transferred to those knitting needles h through o of the needle bed FU.

Figure 310:
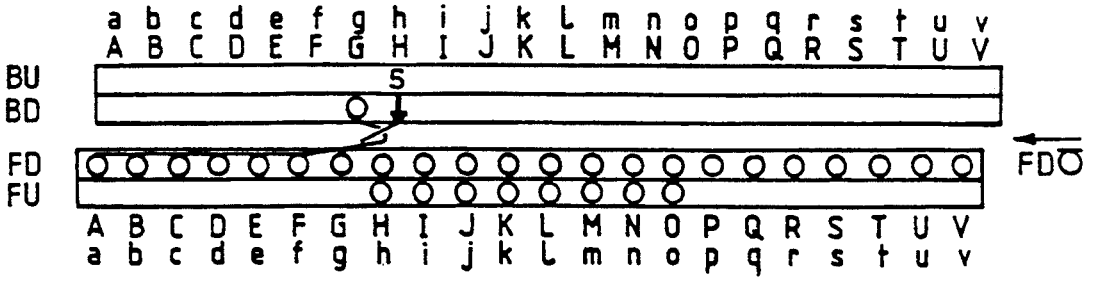
Figure 311:
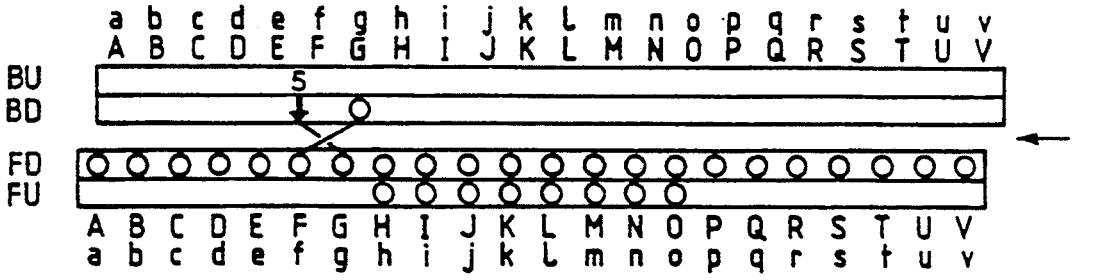

Next, when the knitting course shown in FIG. 310 is activated, the feeder 3 feeds a knitting yarn to the knitting needle G of the needle bed BD to have it form a loop. Next, when the knitting course shown in FIG. 311 is activated, the feeder 5 is shifted to the right to have those knitting yarns delivered from the feeders 3 and 5 intersect each other.

Figure 312:
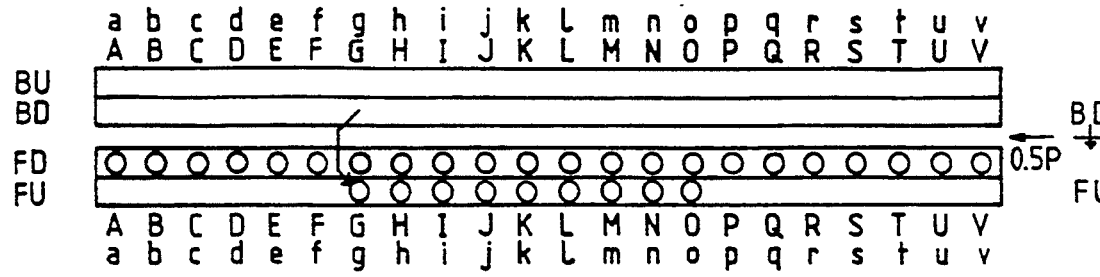
Figure 313:
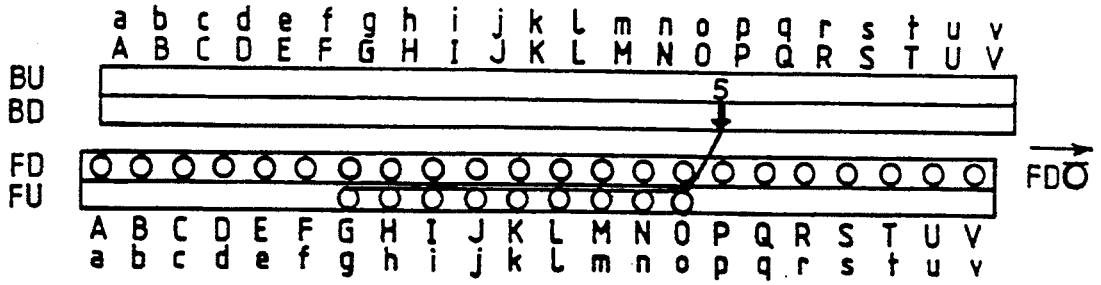
Figure 314:
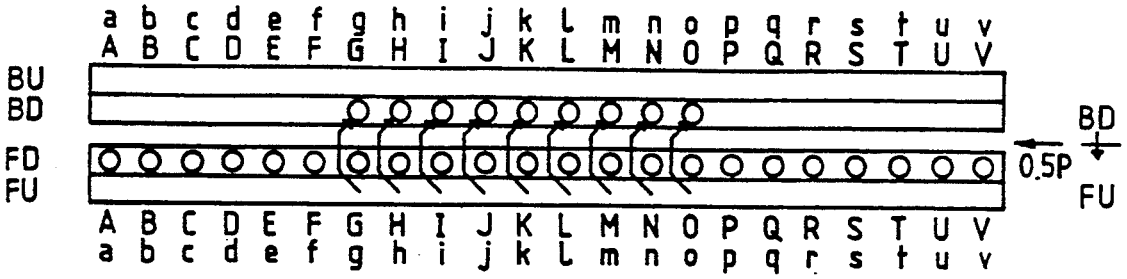
Figure 315:
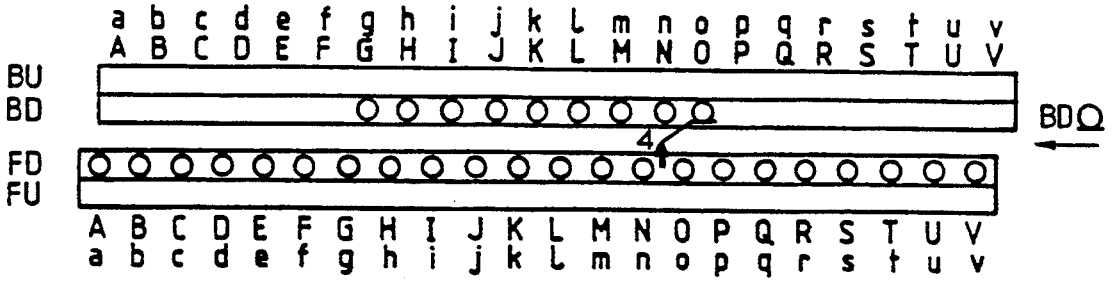
Figure 316:
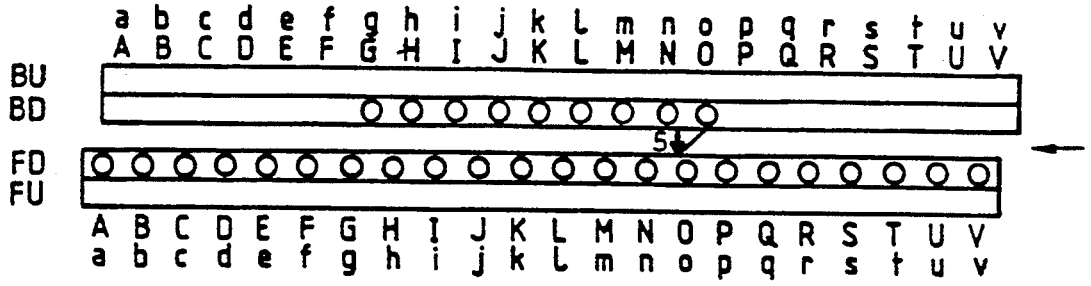

Next, when the knitting course shown in FIG. 312 is activated, the feeder 3 feeds knitting yarns to those knitting needles F through A of the needle bed FD to have them respectively form loops. Next, when the knitting course shown in FIG. 313 is activated, the feeder 5 is shifted to the left. Next, when the knitting course shown in FIG. 314 is activated those needle beds BU and BD in the rear position are respectively shifted to the left by one-half pitch, and then, the loop engaged with the knitting needle G of the needle bed BD is transferred to the knitting needle g of the needle bed FU. Next, when the knitting course shown in FIG. 315 is activated, those needle beds BU and BD in the rear position are respectively brought back to the right by one-half pitch, and then causes the feeder 5 to feed knitting yarns to those knitting needles g through o of the needle bed FU to have it form a loop. Next, when the knitting course shown in FIG. 316 is activated, initially, those needle beds BU and BD in the rear position are respectively shifted to the left by one-half pitch, and then, those loops engaged with the knitting needles g through o of the needle bed FU are respectively transferred to those knitting needles G through O of the needle bed BD.

Figure 317:
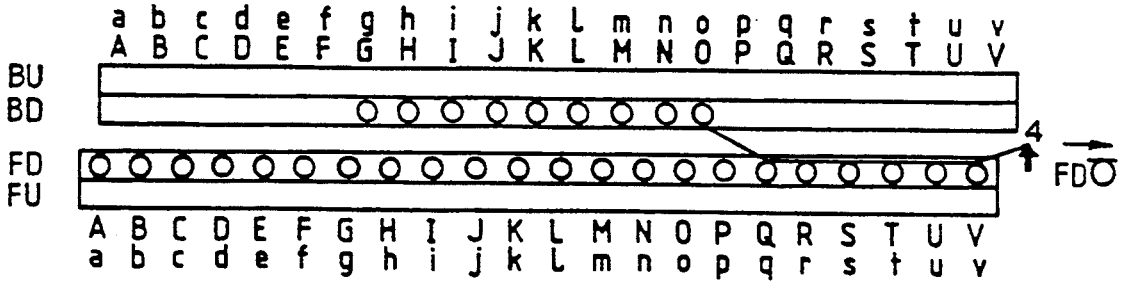

Next, when the knitting course shown in FIG. 317 is activated, those needle beds BU and BD in the rear position are respectively brought back to the right by one-half pitch, and then causes the feeder 4 to feed a knitting yarn to the knitting needle O of the needle bed BD to have it form a loop.

Figure 318:
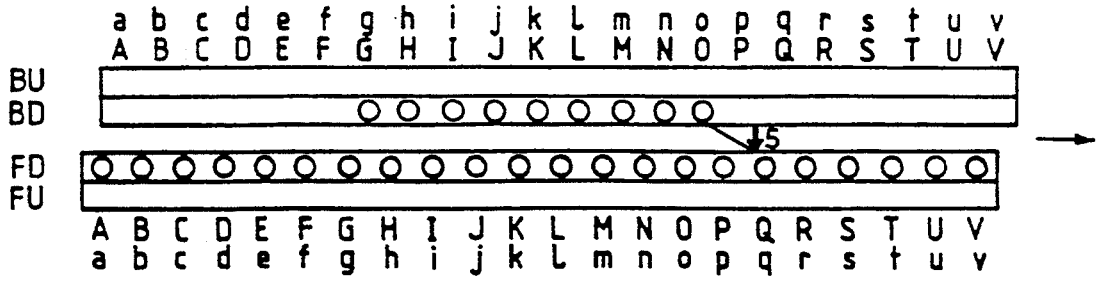
Figure 319:
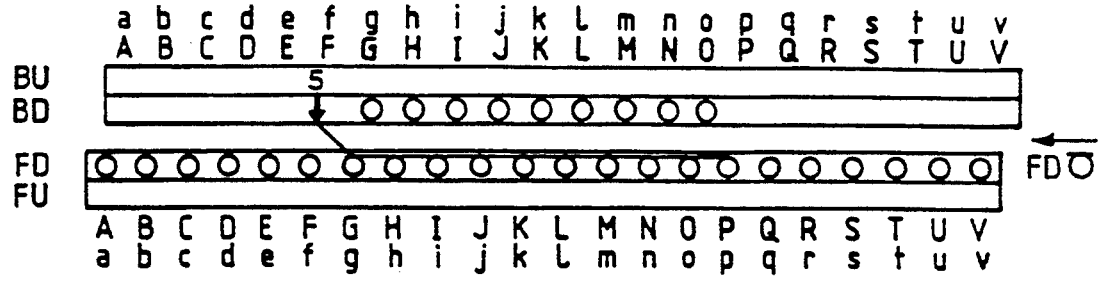
Figure 320:
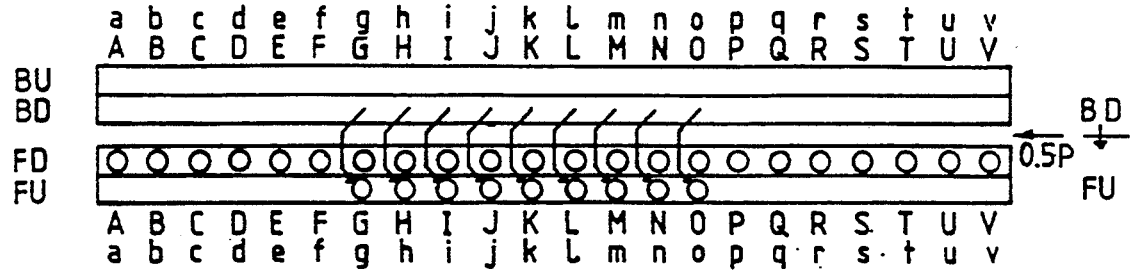
Figure 321:
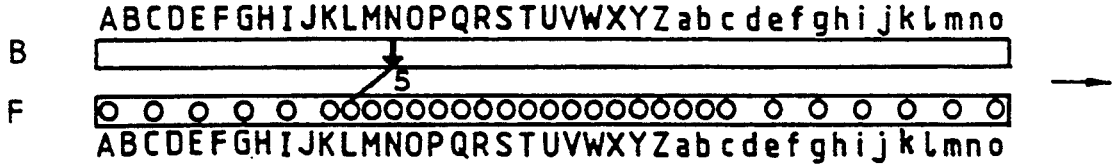
FIG. 321 through FIG. 350 are respectively explanatory of knit composing courses available for integrally forming a pocket with a body part according to the eighth embodiment of the invention.

Next, when the knitting course shown in FIG. 318 is activated, the feeder 5 is shifted to the left. Next, when the knitting course shown in FIG. 319 is activated, the feeder 4 feeds knitting yarns to those knitting needles q through v of the needle bed FU. Next, when the knitting course shown in FIG. 320 is activated, the feeder 5 is shifted to the right.

Figure 322:
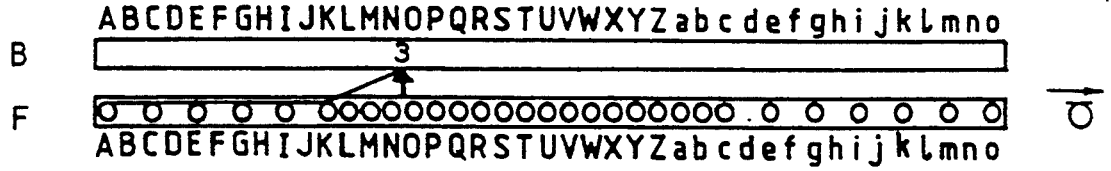

Next, when the knitting course shown in FIG. 322 is activated, those needle beds BU and BD in the rear position are respectively shifted to the left by one-half pitch, and then, those loops engaged with the knitting needles G through O of the needle bed BD are respectively transferred to those knitting needles g through o of the needle bed FU.

Henceforth, the flat knitting machine available for executing the seventh embodiment of the invention repeatedly executes operations for processing those knitting courses shown in FIG. 297 through FIG. 322 before eventually composing the straight portion of the predetermined pocket 2.

As shown in FIG. 292, both-side edges of the pocket 2 composed by executing the above sequential processes are integrally linked with the front-body knit 1 solely by means of knitting, where the "intarsia jacquard" is made available for the knit.

The Eighth Embodiment

As described earlier, the method related to the seventh embodiment of the invention for composing a knit wear integrally provided with an additional-type pocket makes use of a conventionally called "4-piece needle-bed" type flat knitting machine which is furnished with four needle beds in file each storing a number of knitting needles on the top surface by permitting these knitting needles to slidably move back and forth, where these needle beds are respectively disposed in opposition from each other in the "/ \" shape formation.

On the other hand, the eighth embodiment of the invention provides the method of composing a knit wear integrally provided with an additional-type pocket by operating a conventionally called "2-piece needle-bed" type flat knitting machine which is furnished with a pair of needle beds each storing a number of knitting needles on the top surface by permitting these knitting needles to slidably move back and forth, where these needle beds are also disposed in opposition from each other in the "/ \" shape formation. Concretely, using the "2-piece needle-bed" type flat knitting machine, the eighth embodiment of the invention provides the method off composing a knitted fabric integrally provided with an additional-type pocket by arranging the bottom and both-side edges of the pocket to be interlocked with the front body knitted fabric in the state in which the knitting yarns are linked with loops by means of a knit.

Figure 323:
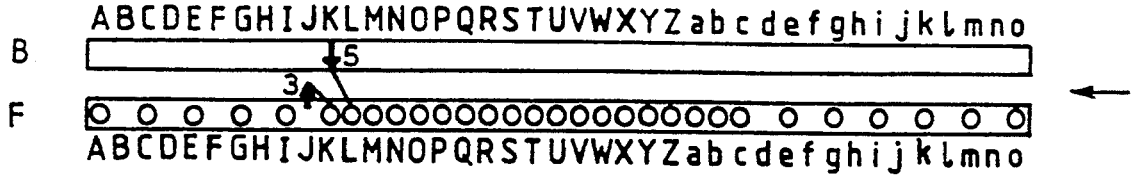
Figure 324:
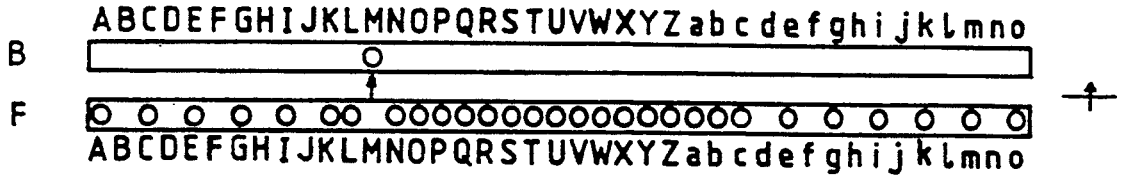
Figure 325:
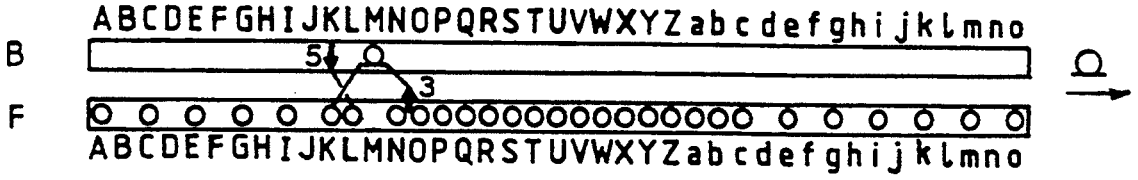
Figure 326:
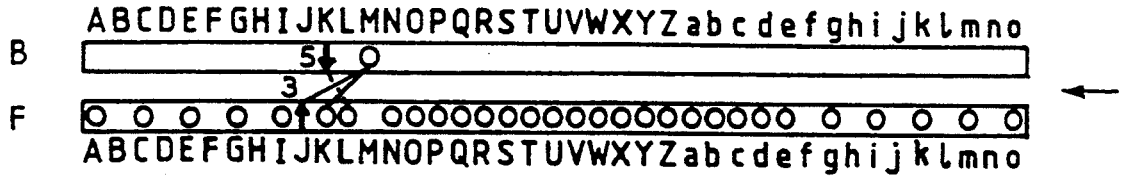
Figure 327:
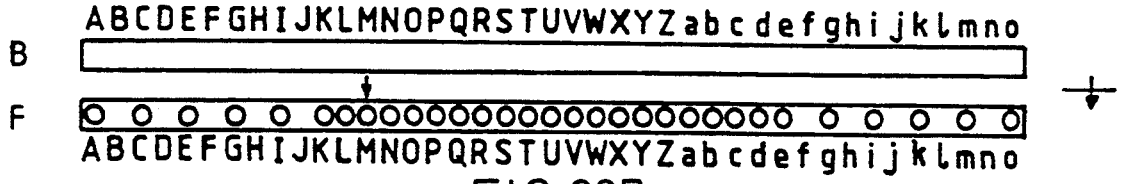
Figure 328:
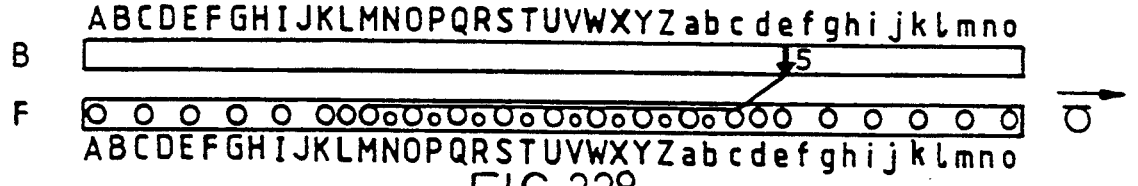
Figure 329:
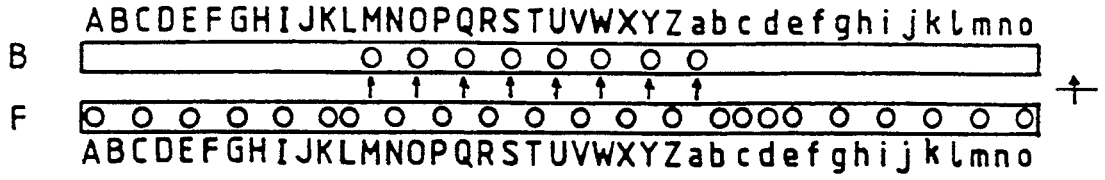
Figure 330:
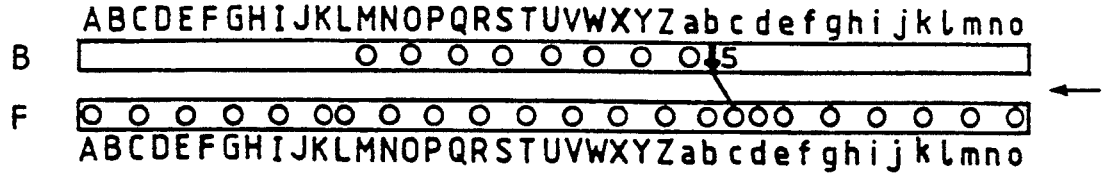
Figure 331:
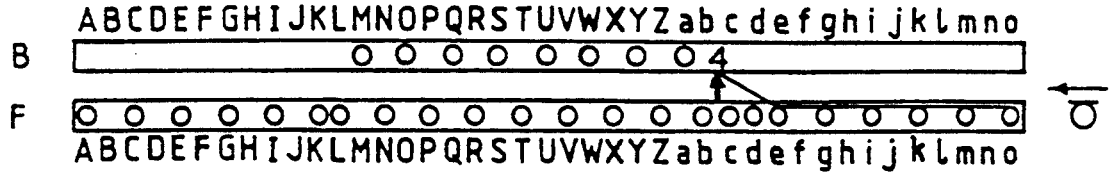
Figure 332:
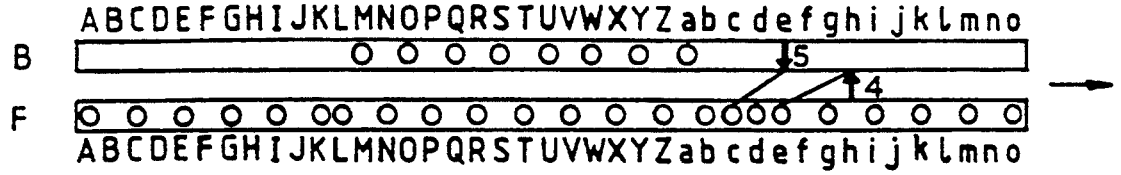
Figure 333:
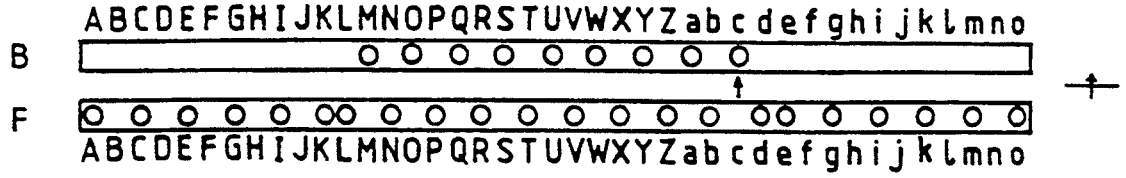
Figure 334:
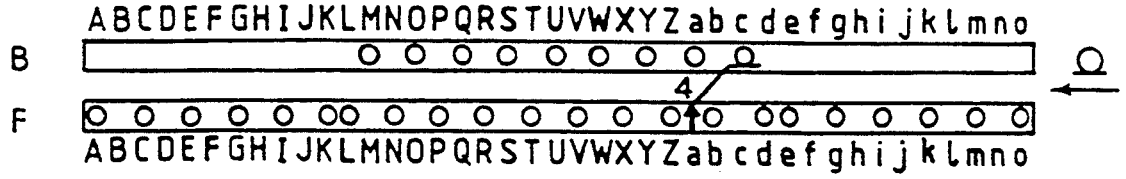
Figure 335:
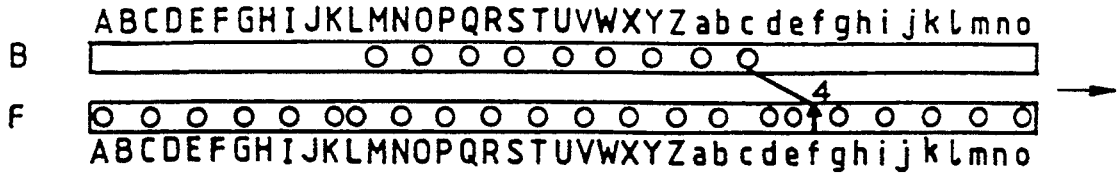
Figure 336:
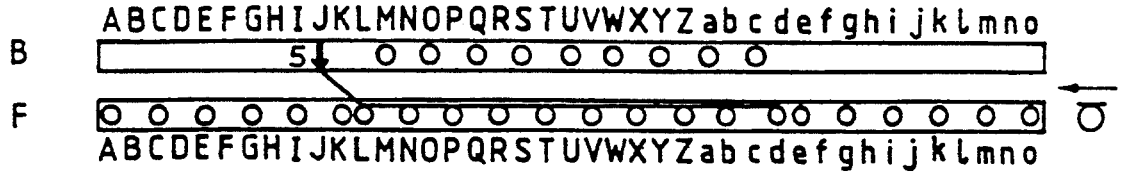
Figure 337:
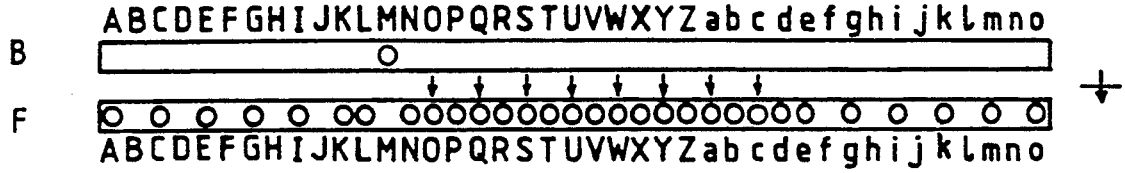
Figure 338:
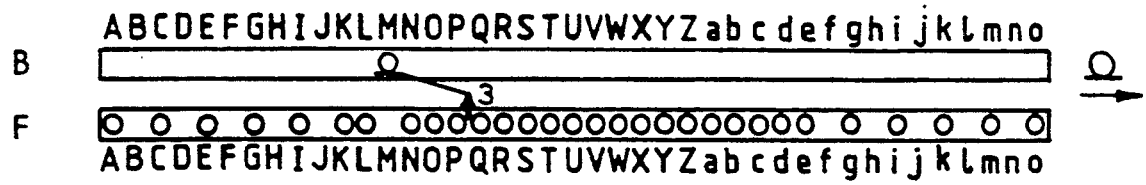
Figure 339:
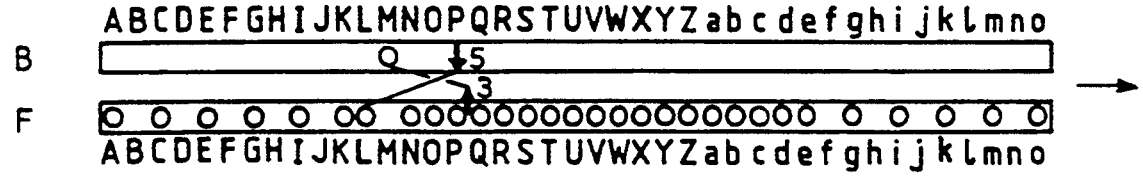
Figure 340:
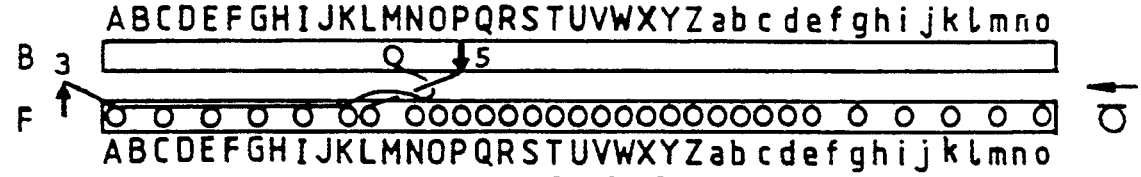
Figure 341:
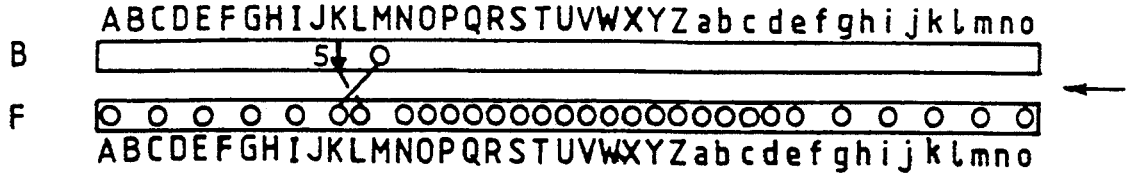
Figure 342:
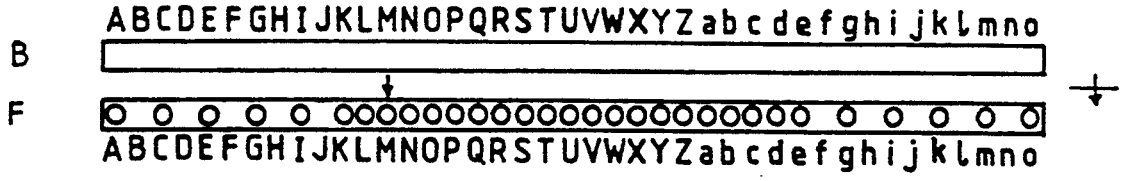
Figure 343:
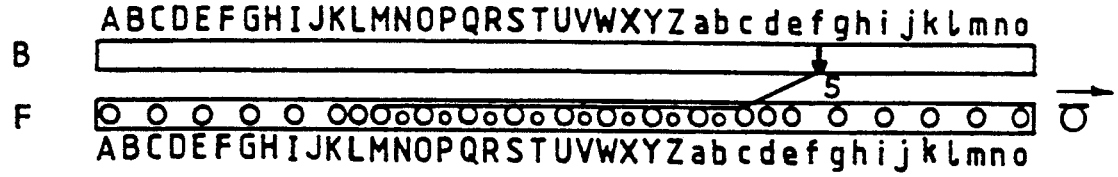
Figure 344:
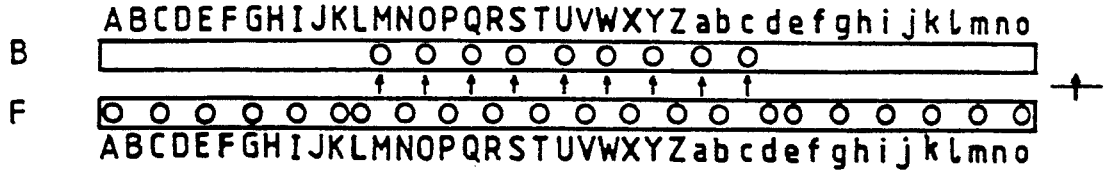
Figure 345:
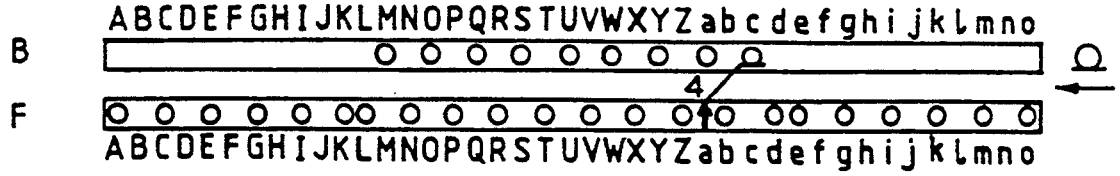
Figure 346:
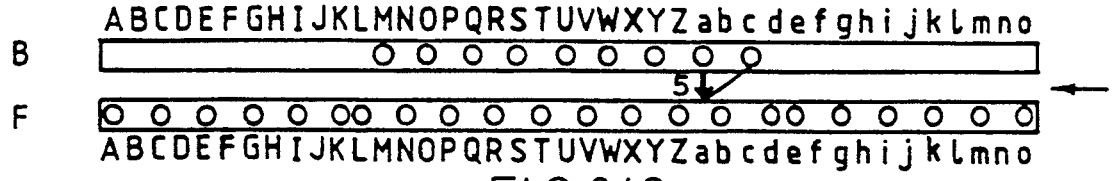
Figure 347:
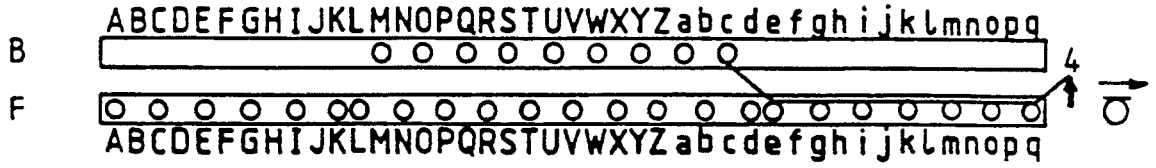
Figure 348:
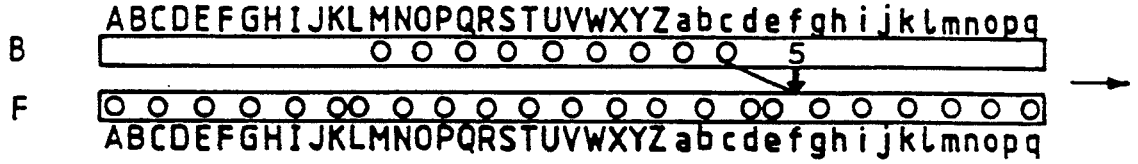
Figure 349:
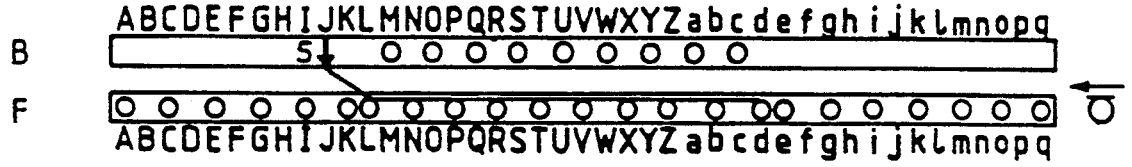
Figure 350:
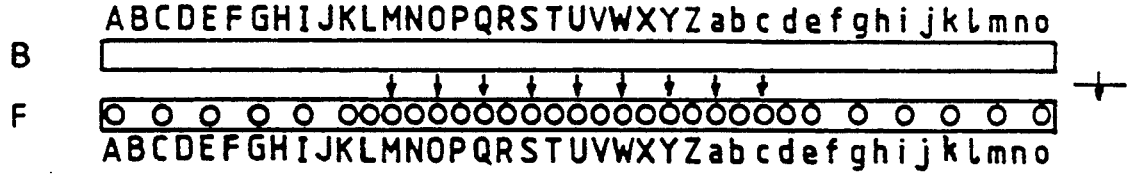
Figure 351:
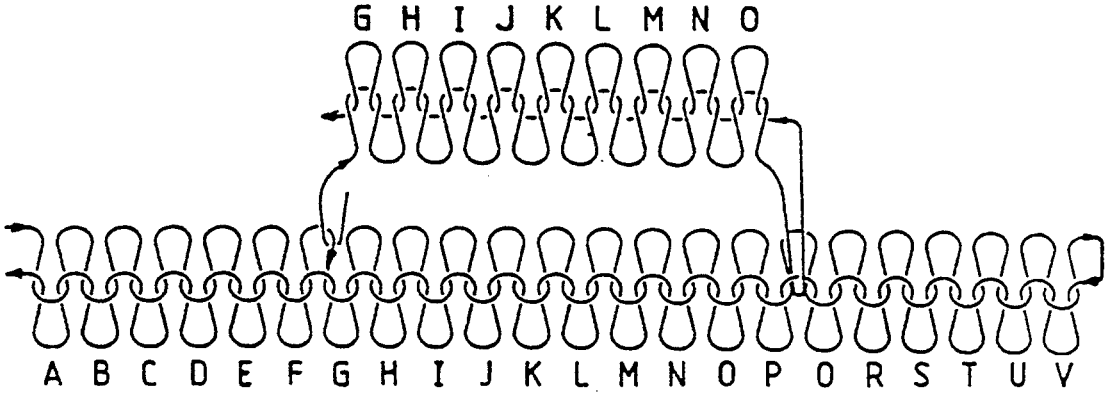
FIG. 351 is an organization chart of a knit composition corresponding to the knitted fabric shown in FIG. 2 composed by applying the nineth embodiment of the invention.
Figure 352:
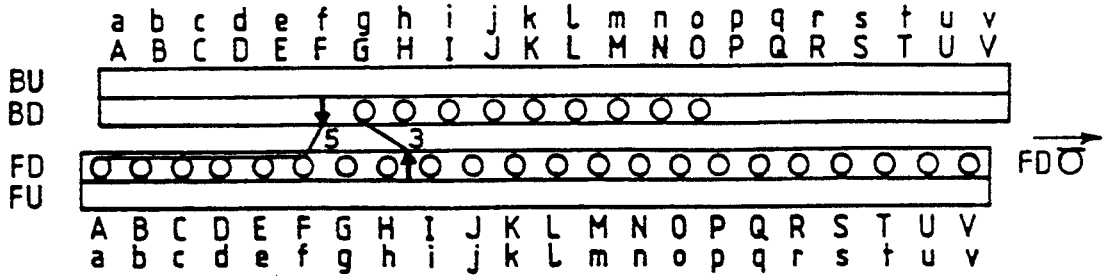
FIG. 352 through FIG. 366 are respectively explanatory of knit composing courses available for integrally forming a pocket with a body part according to the nineth embodiment of the invention.

More particularly, as is apparaent from FIG. 323, of those knitting needles A through o of a needle bed F in the front position for example, those alternate knitting needles including A, C, E, . . . k, m, and o jointly operate themselves in place of the needle bed FU disposed on the top side in the front position made available for the method related to the seventh embodiment of the invention. On the other hand, of those knitting needles A through o of a needle bed B in the rear position for example, those alternate knitting needles including A, C, E, . . . k, m, and o jointly operate themselves in place of the needle bed BD disposed on the bottom side the rear position made available for executing the seventh embodiment of the invention. On the other hand, when executing the method according to the eighth embodiment of the invention, of those knitting needles A through o of a needle bed B in the rear position, those alternate knitting needles A, C, E, . . . k, m,and o for example jointly operate themselves in place of the needle bed BD disposed on the bottom side in the rear position made available for the seventh embodiment., whereas those remaining alternate knitting needles B, D, F, . . . h, l, and n jointly operate themselves in place of the needle bed BU disposed on the top side in the rear position made available for the seventh embodiment, respectively.

Concretely, FIG. 323 corresponds to FIG. 293 made available for the seventh embodiment. Furthermore, those knitting courses shown in FIG. 324 through FIG. 352 respectively and sequentially correspond to those knitting courses shown in FIG. 294 through FIG. 322 made available for the seventh embodiment. Furthermore, in the same way as was done for the seventh embodiment described above, as shown in FIG. 235, both-side edges of the pocket 2 are linked with the front body knit 7 in the state in which knitting yarns respectively interlock with corresponding loops, and yet, knit organization of the front body knit domain 7 concealed in the pocket region is superficially formed, thus eventually providing a quality pocket abundant in bulkiness characteristic of the additional-type pocket.

The Nineth Embodiment

Figure 353:
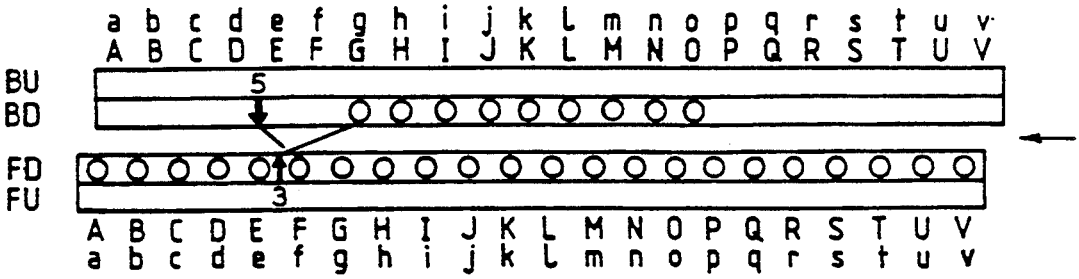

Like the first embodiment of the invention described earlier, the nineth embodiment of the invention provides the method of composing a knit wear integrally provided with an additional type pocket by operating the conventionally called "4-piece needle-bed" type flat knitting machine furnished with four needle beds disposed in opposition from each other in the "/ \" shape formation in file, where each needle bed stores a number of knitting needles on the top surface by permitting them to slidably move back and forth. The nineth embodiment of the invention provides the method of composing a knit wear integrally provided with an additional-type pocket, where the bottom and both-side edges of the pocket shown in FIG. 353 are integrally linked with the front body knit by way of interlocking knitting yarns themselves.

FIG. 354 through FIG. 369 respectively designate only the changeable portions in those knitting courses made available for composing a knit wear integrated with an additional type pocket according to the method related to the first embodiment of the invention.

Figure 354:
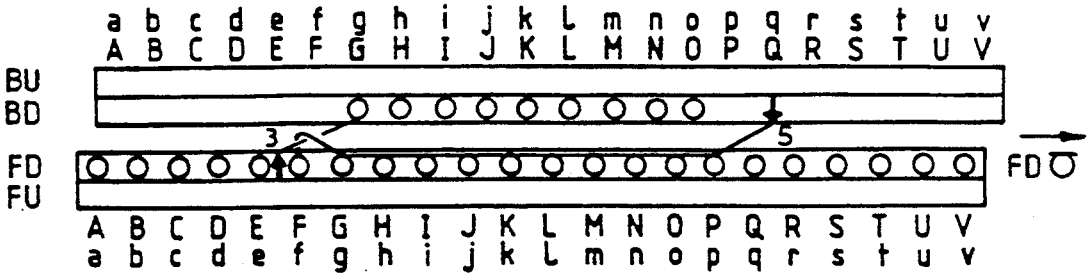
Figure 369:
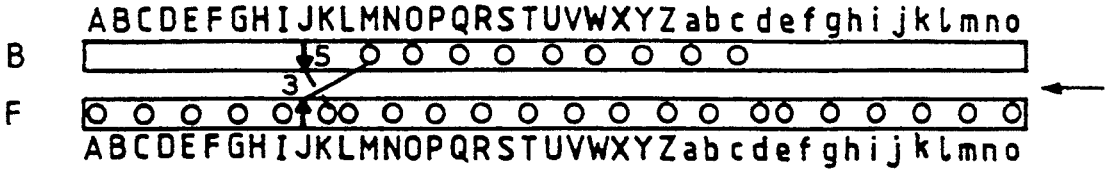

It should be understood however that the actual number of loops corresponding to a straight portion of a pocket composed by executing those knitting courses shown in FIG. 293 through FIG. 354 through 369 does not coincide with the actual number of those loops formed in those knitting courses shown in FIG. 32 through FIG. 45 made available for executing the method related to the first embodiment. This is solely because the "4-piece needle-bed" type flat knitting machine available for executing the method related to the nineth embodiment of the invention provides the front needle beds and the rear needle beds by way of deviating their positions by a half pitch. Except for this deviation, the structure of the flat knitting machine available for executing the method related to the nineth embodiment is identical to that of the flat knitting machine made available for executing the method according to the first embodiment described earlier.

Figure 355:
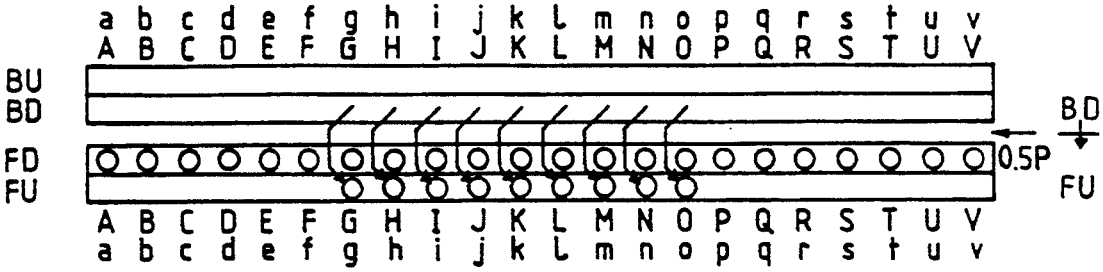
Figure 356:
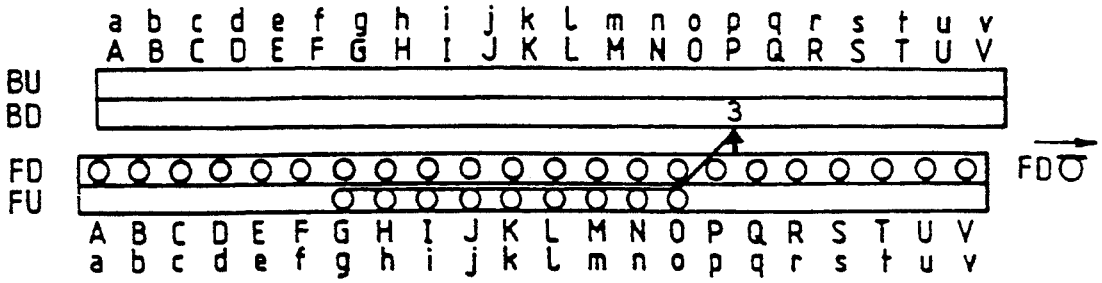

Concretely, when the knitting course shown in FIG. 354 is activated, a feeder 5 feeds knitting yarns to those knitting needles A through F of a needle bed FD to have them respectively form loops. Next, when the knitting course shown in FIG. 355 is activated, the feeder 5 and another feeder 3 are respectively shifted to the left. Next, when the knitting course shown in FIG. 356 is activated, the feeder 5 feeds knitting yarns to those knitting needles F through P of the needle bed FD to have them respectively form loops in the state in which both ends of the loops interlock with each other.

Figure 357:
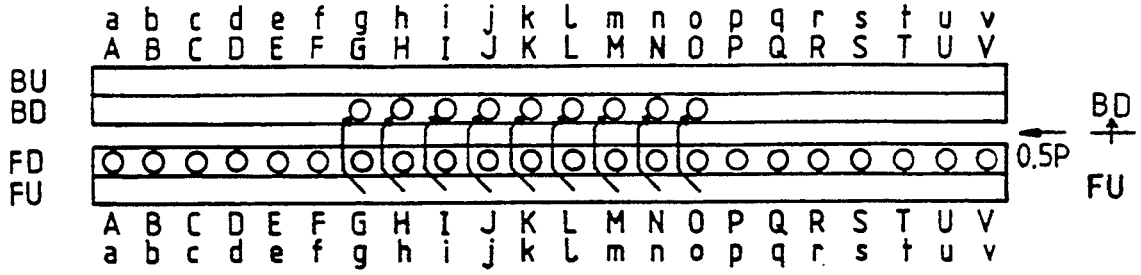
Figure 358:
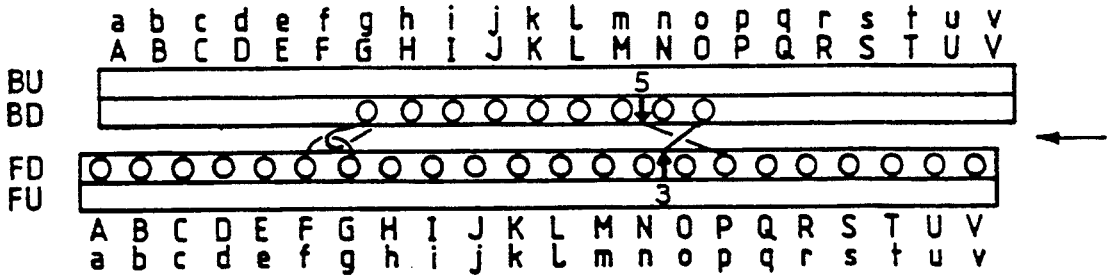

Next, when the knitting course shown in FIG. 357 is activated, those needle beds BU and BD in the rear position are respectively shifted to the left by one-half pitch, and then, those loops engaged with the knitting needles G through O of a needle bed BD are respectively transferred to those knitting needles g through o of a needle bed FU. Next, when the knitting course shown in FIG. 358 is activated, those needle beds BU and BD in the rear position are respectively brought back to the right by one-half pitch, and then causes the feeder 3 to feed knitting yarns to those knitting needles g through o of the needle bed FU to have them respectively form loops.

Figure 359:
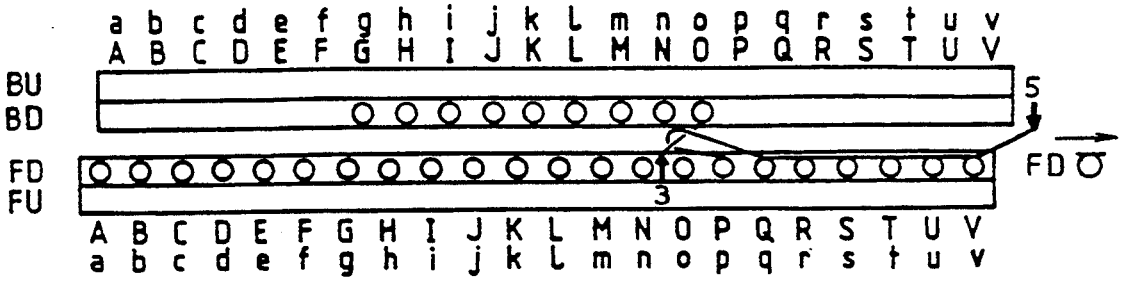
Figure 360:
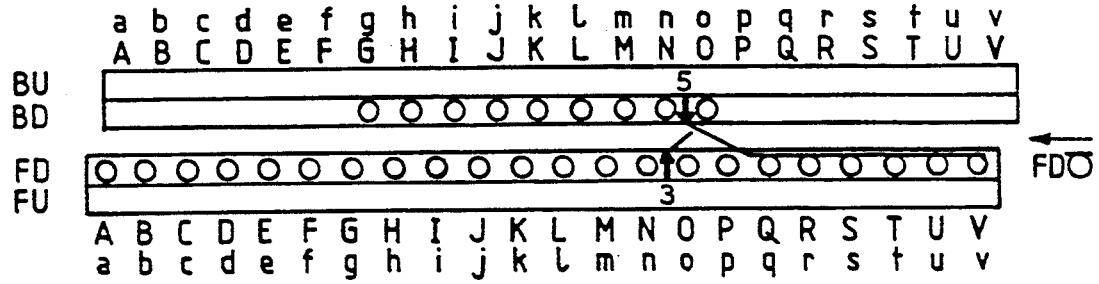
Figure 361:
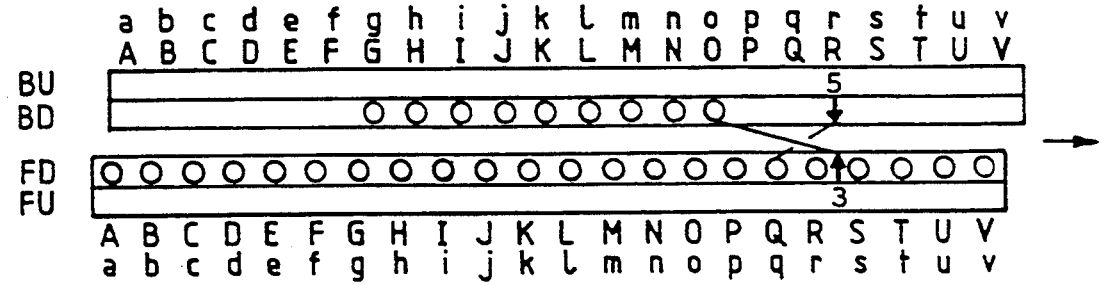

Next, when the knitting course shown in FIG. 359 is activated, initially, those needle beds BU and BD in the rear position are respectively shifted to the left by one-half pitch, and then, those loops engaged with those knitting needles g through o of the needle bed FU are respectively transferred to those knitting needles G through O of the needle bed BD. In consequence, as shown in FIG. 360, the left edge of pocket 2 comprises those knitting yarns interlocked with each other. When the knitting course shown in FIG. 360 is activated, those feeders 3 and 5 are respectively shifted to the left to cause those knitting yarns out of these feeders 3 and 5 to intersect each other. Next, when the knitting course shown in FIG. 361 is activated, the feeder 5 feeds knitting yarns to those knitting needles Q through V of the needle bed FD to have them respectively form loops. As a result, knitting yarns interlock with the left edge of pocket 2

Figure 362:
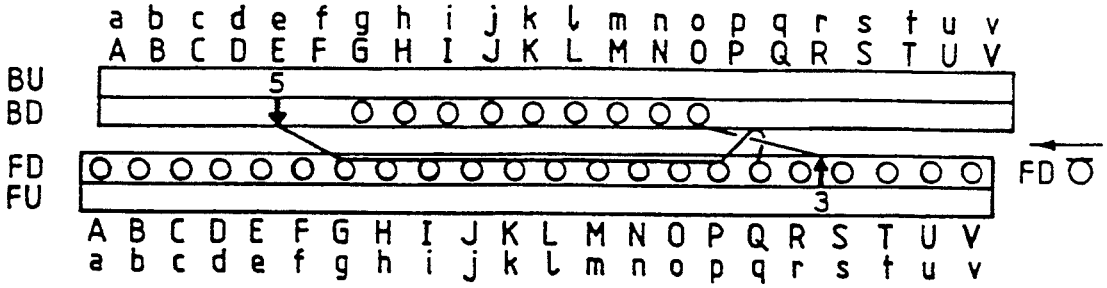
Figure 363:
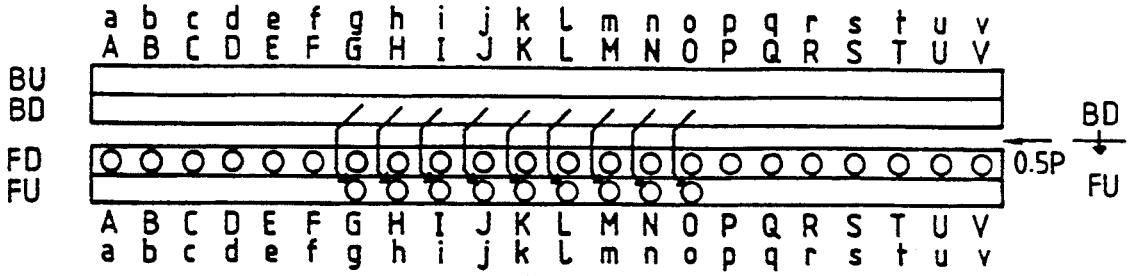
Figure 364:
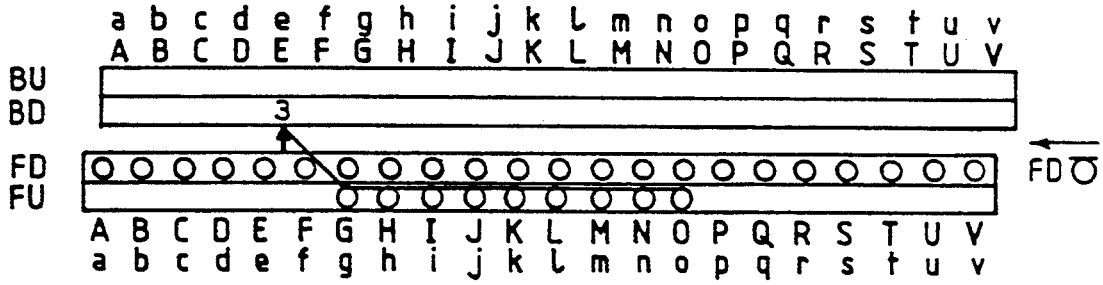
Figure 365:
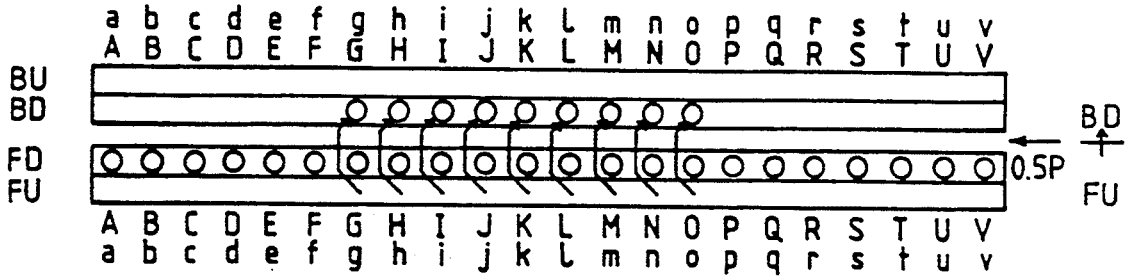

Next, when the knitting course shown in FIG. 362 is activated, the feeder 5 feeds knitting yarns to those knitting needles V through Q of the needle bed FD to have them respectively form loops. Next, when the knitting course shown in FIG. 363 is activated, those feeders 3 and 5 are respectively shifted to the right. When the following knitting course shown in FIG. 364 is activated, the feeder 5 also feeds knitting yarns to those knitting needles P through G of the needle bed FD to have them respectively form loops. Next, when the knitting course shown in FIG. 365 is activated, those needle beds BU and BD in the rear position are respectively shifted to the left by one-half pitch, and then those loops engaged with the knitting needles G through O of the needle bed BD are respectively transferred to those knitting needles g through o of the needle bed FU.

Figure 366:
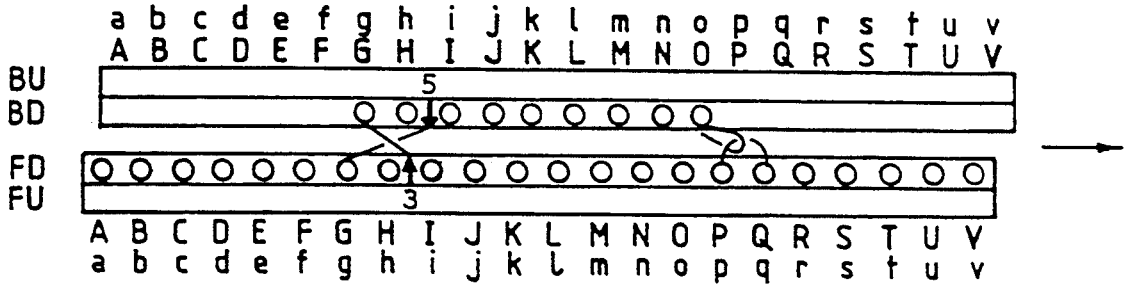
Figure 367:
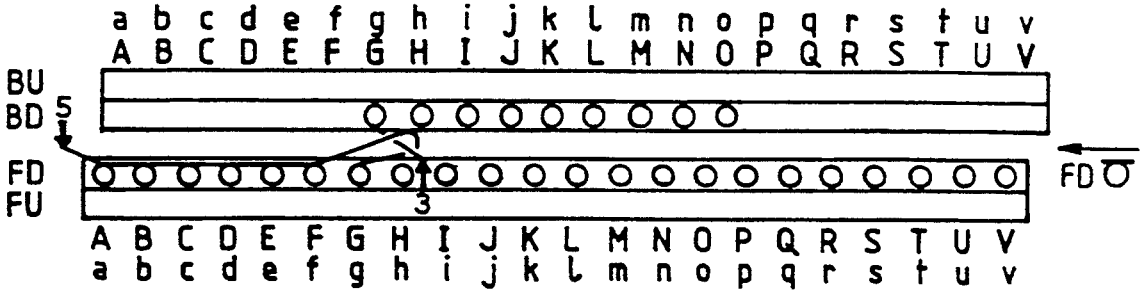
FIG. 367 through FIG. 383 are respectively explanatory of knit composing courses available for integrally forming a pocket with a body part according to the tenth embodiment of the invention.

Next, when the knitting course shown in FIG. 366 is activated, those needle beds BU and BD in the rear position are respectively brought back to the right by one-half pitch, and then causes the feeder 3 to feed knitting yarns to those knitting needles o through g of the needle bed FU to have them respectively form loops. Next, when the knitting course 367 is activated, those needle beds BU and BD in the rear position are respectively shifted to the left by one-half pitch, and then, those loops engaged with the knitting needles g through o of the needle bed FU are respectively transferred to those knitting needles G through O of the needle bed BD.

Figure 368:
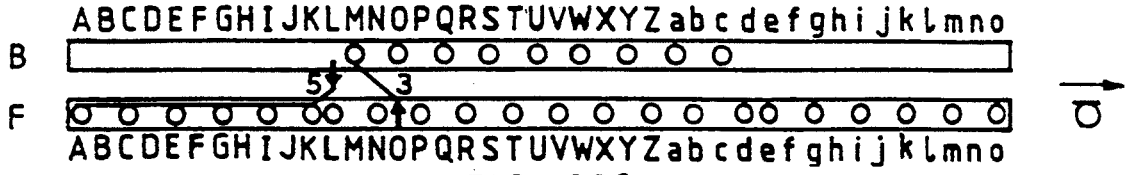

Next, when the knitting course shown in FIG. 368 is activated, those feeders 3 and 5 are respectively shifted to the right to cause those knitting yarns out from these feeders 3 and 5 to intersect each other. When the knitting course shown in FIG. 369 is activated, the feeder 5 feeds knitting yarns to those knitting needles F through A of the needle bed FD to have them respectively form loops. As a result, knitting yarns respectively interlock each other at the left edge of the pocket 2.

Henceforth, the flat knitting machine available for executing the method related to the nineth embodiment repeatedly executes operation for processing those knitting courses shown in FIG. 354 through FIG. 369 before eventually composing a straight portion of the pocket 2.

As shown in FIG. 353, both-side edges of the pocket 2 are linked with the front body knit 7 solely by means of knitting.

The Tenth Embodiment

As described earlier, the method according to the nineth embodiment of the invention for composing a knit wear integrally provided with an additional-type pocket makes use of the conventionally called "4-piece needle-bed" type flat knitting machine which is furnished with four needle beds in file each storing a number of knitting needles on the top surface by permitting these knitting needles to slidably move back and forth, where these needle beds are respectively disposed in opposition from each other in the "/ \" shape formation. On the other hand, the tenth embodiment of the invention provides the method of composing a knit wear which is integrally provided with an additional-type pocket by operating a conventionally called "2-piece needle-bed" type flat knitting machine which is furnished with a pair of needle beds each storing a number of needle beds on the top surface by way of permitting these knitting needles to slidably move back and forth, where these needle beds are also disposed in opposition from each other in the "/ \" shape formation. Concretely, using the "2-piece needle-bed" type flat knitting machine, the tenth embodiment of the invention provides the method of composing a knitted fabric which is integrated with an additional type pocket having the bottom and both-side edges of the pocket integrally being linked with the front-body knit by means of knitting yarns and kit in the same way as was executed by the "4-piece needle-bed" type flat knitting machine made available for executing the method related to the nineth embodiment of the invention.

Figure 370:
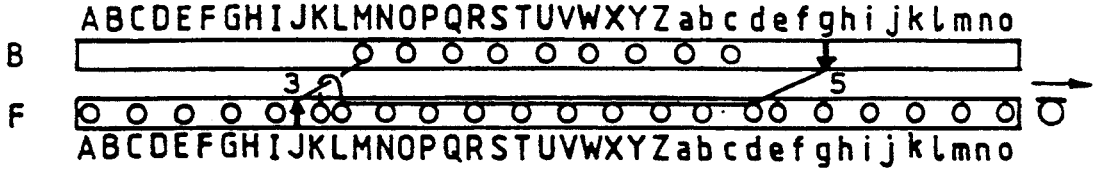
Figure 371:
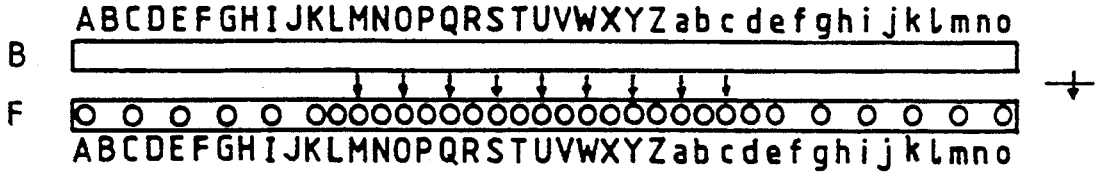
Figure 372:
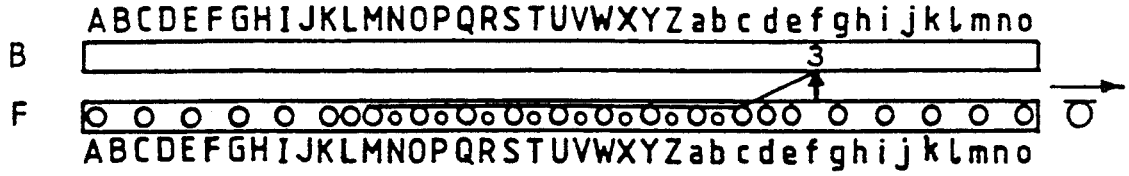
Figure 373:
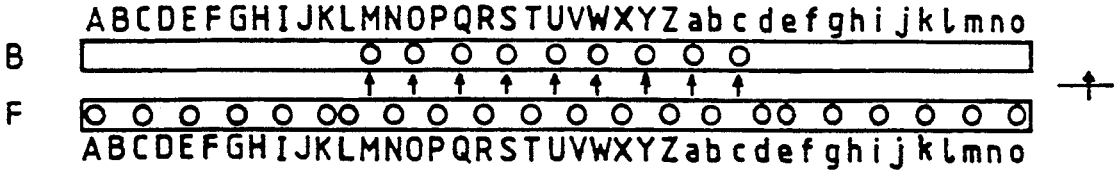
Figure 374:
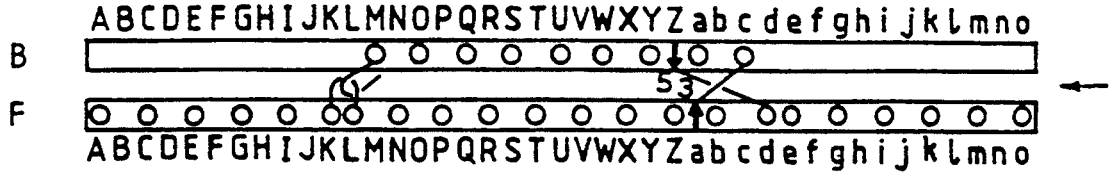
Figure 375:
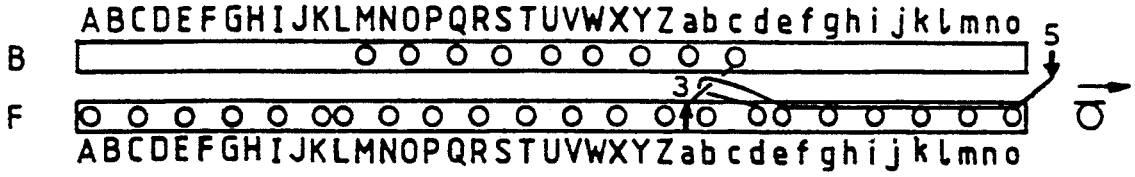
Figure 376:
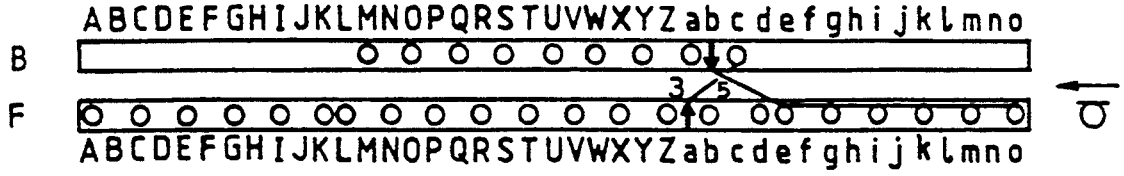
Figure 377:
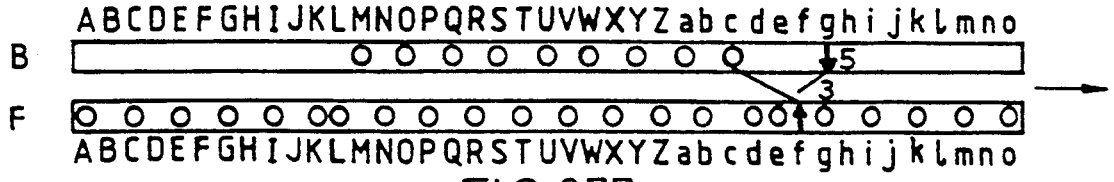
Figure 378:
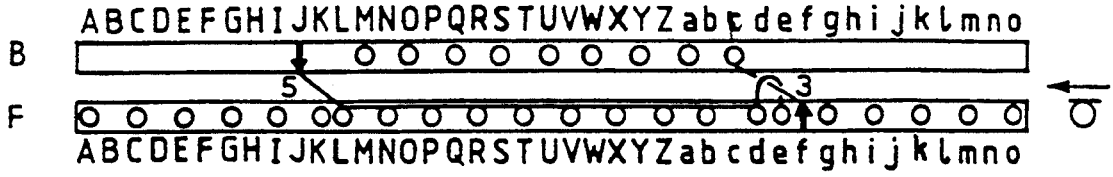
Figure 379:
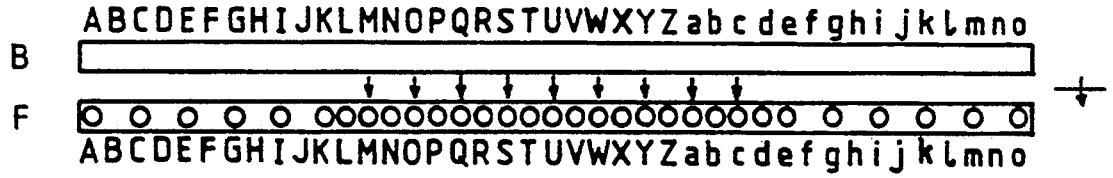
Figure 380:
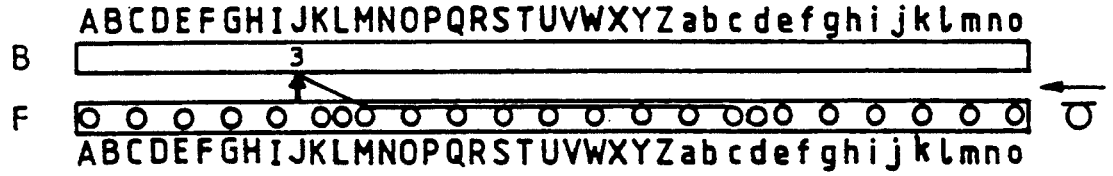
Figure 381:
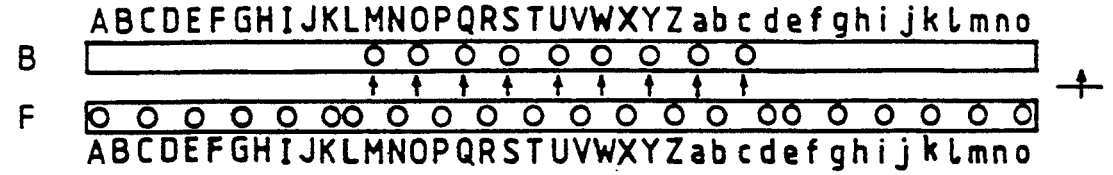
Figure 382:
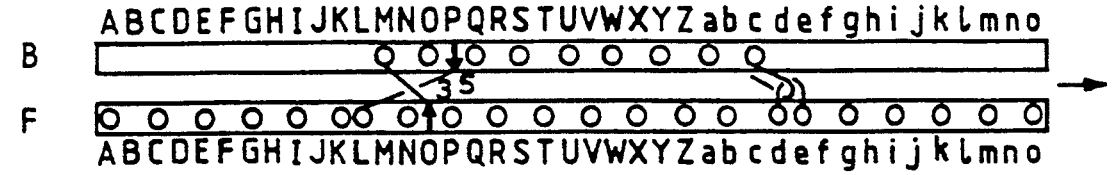
Figure 383:
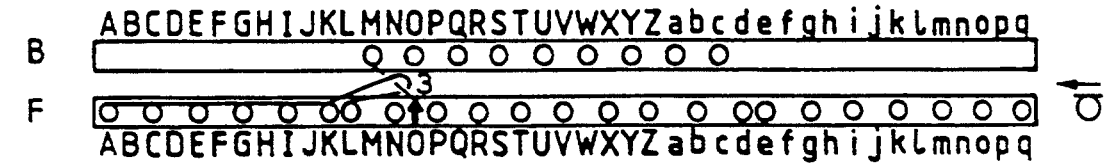
Figure 384:
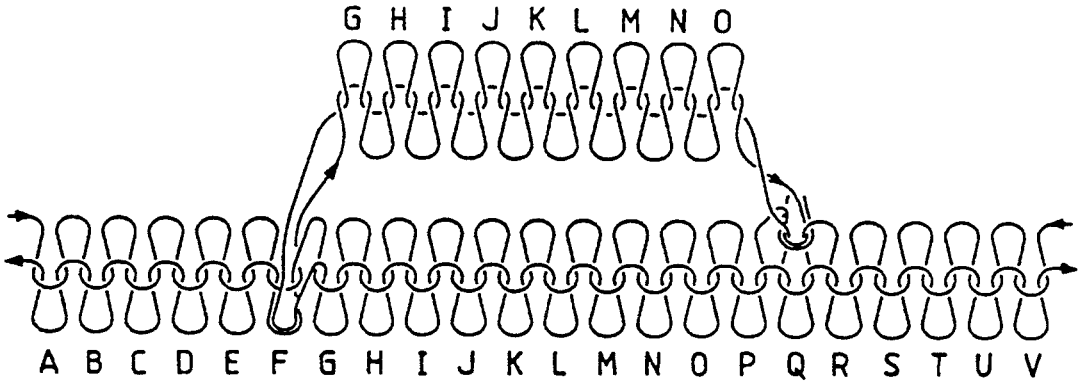
FIG. 384 is an organization chart of a knit composition corresponding to the knitted fabric shown in FIG. 2 composed by applying the eleventh embodiment of the invention.
Figure 385:
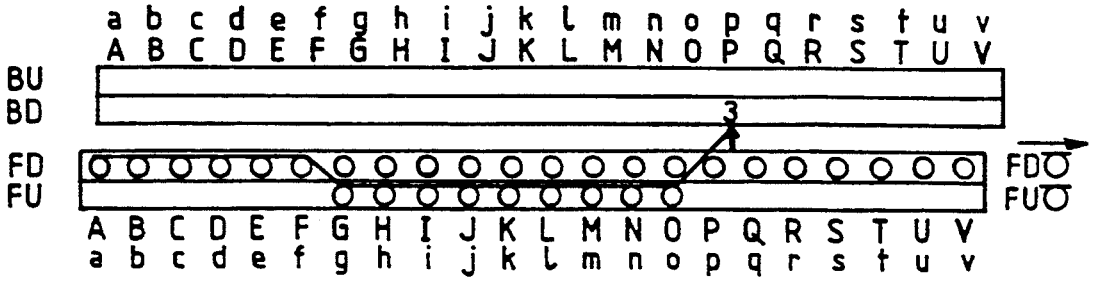
FIG. 385 through FIG. 392 are respectively explanatory of knit composing courses available for integrally forming a pocket with a body part according to the eleventh embodiment of the invention.

More particularly, as shown in FIG. 370, of those knitting needles A through o of a front needle bed F, those alternate knitting needles A, C, E, . . . k, m, and o jointly operate themselves in place of the needle bed FD disposed on the bottom side in the front position made available for the nineth embodiment, whereas those remaining alternate knitting needles including B, D, F, . . . h, l, and n jointly operate themselves in place of the needle bed FU disposed on the top side in the front position made available for the nineth embodiment. Furthermore, of those knitting needles A through o of a rear-side needle bed B, those alternate knitting needles including A, C, E, . . . k, m, and o jointly operate themselves in place of the needle bed BD disposed on the bottom side in the rear position made available for the nineth embodiment, whereas those remaining alternate knitting needles including B, D, F, . . . h, l, and n jointly operate themselves in place of the needle bed BU disposed on the top side in the rear position made available for the nineth embodiment.

Concretely, FIG. 370 corresponds to FIG. 354 made available for the nineth embodiment, and yet, those knitting courses shown in FIG. 371 through FIG. 385 respectively and sequentially correspond to those knitting courses shown in FIG. 355 through FIG. 369 made available for the nineth embodiment. Furthermore, like the pocket formed by the method according to the nineth embodiment, as shown in FIG. 353 both-side edges of the pocket 2 are integrally linked with the front body knit 7 by way of causing knitting yarns to intersectionally link with each other, and yet, the knit organization of the front body knit domain concealed in the knit of the pocket region is superficially formed, thus eventually providing a quality pocket abundant in bulkiness characteristic of the additional-type pocket.

The Eleventh Embodiment

Figure 386:
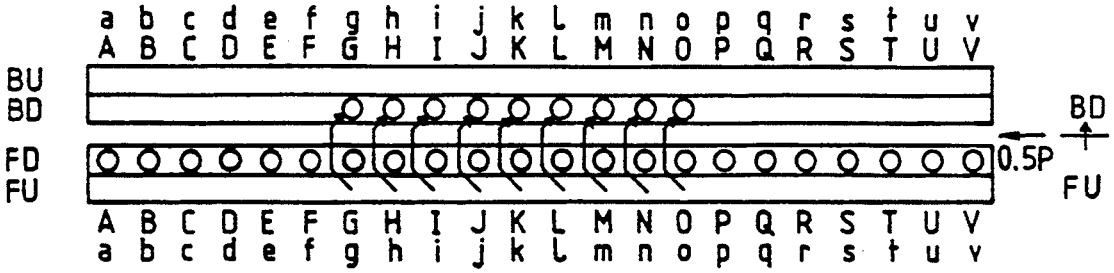

Like the first embodiment described earlier, the eleventh embodiment of the invention provides the method of composing a knit wear integrally provided with an additional type pocket by operating the conventionally called "4-piece needle-bed" type flat knitting machine which is furnished with four needle beds each storing a number of knitting needles on the top surface by permitting them to slidably move back and forth, where these needle beds are respectively disposed in opposition from each other in the "/ \" shape formation in file. The eleventh embodiment of the invention provides the method of composing a knit wear integrally provided with an additional type pocket, where, as shown in FIG. 386, the bottom and both-side edges of the pocket are respectively linked with the front body knit domain by means of tacking.

FIG. 354 through FIG. 369 respectively designate only the changeable portions of those knitting courses made available for the method of composing a knit wear integrated with an additional type pocket according to the first embodiment.

It should be understood however that the actual number of loops corresponding to a straight portion of a pocket composed by processing those knitting courses shown in FIG. 354 through FIG. 369 does not coincide with the actual number of those loops formed in those knitting courses shown in FIG. 32 through FIG. 45 made available for executing the method according to the first embodiment. This is solely because the "4-piece needle-bed" type flat knitting machine available for executing the eleventh embodiment of the invention provides the front needle beds and the rear needle beds by way of deviating their positions by a half pitch. Except for this deviation, the structure of the flat knitting machine available for executing the method related to the eleventh embodiment is identical to that of the flat knitting machine made available for executing the method according to the first embodiment of the invention.

Figure 387:
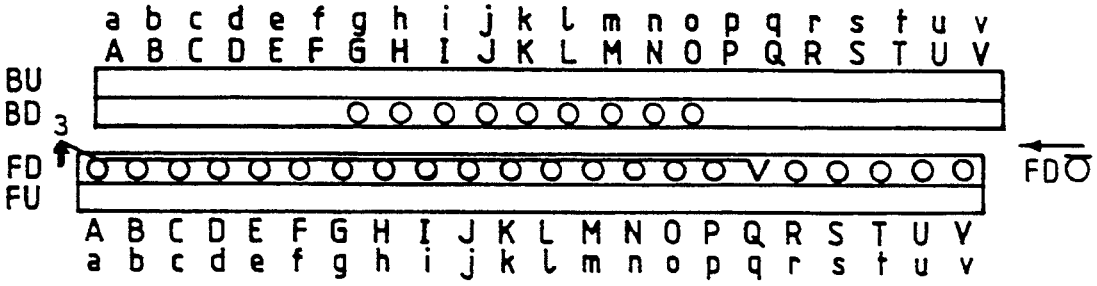
Figure 388:
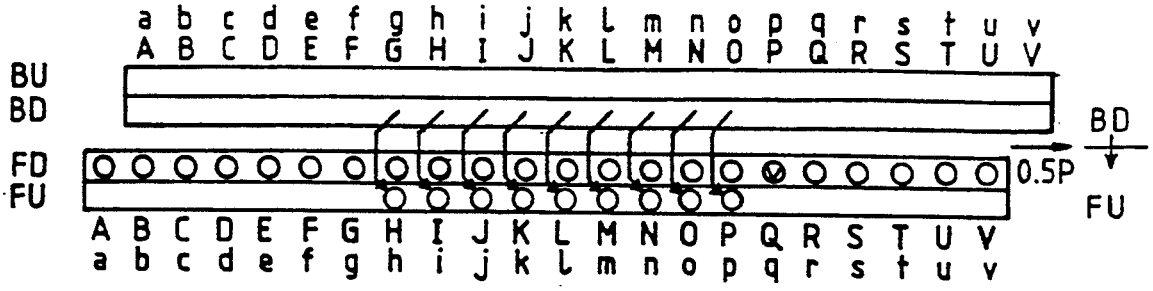

Concretely, when the knitting course shown in FIG. 387 is activated, a feeder 3 feeds knitting yarns to those knitting needles A through F of a needle bed FD and g through o of a needle bed FU to have those needles respectively form loops. Next, when the knitting course shown in FIG. 388 is activated, those needle beds BU and BD in the rear position are respectively shifted to the left by one-half pitch, and then, those loops engaged with the knitting needles q through o of the needle bed FU are respectively transferred to those knitting needles G through O of the needle bed BD.

Figure 389:
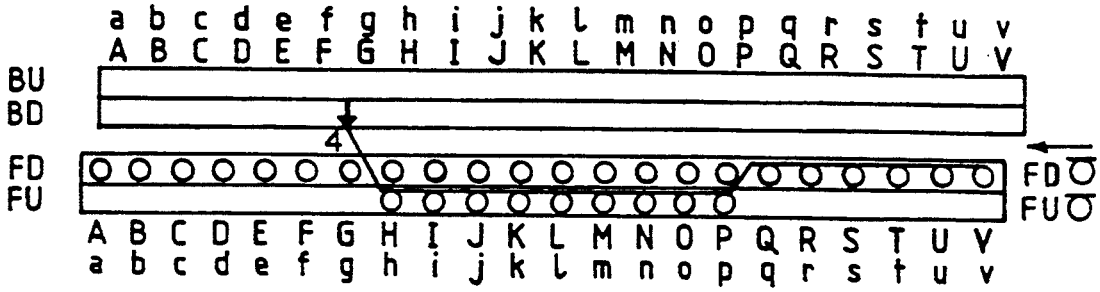
Figure 390:
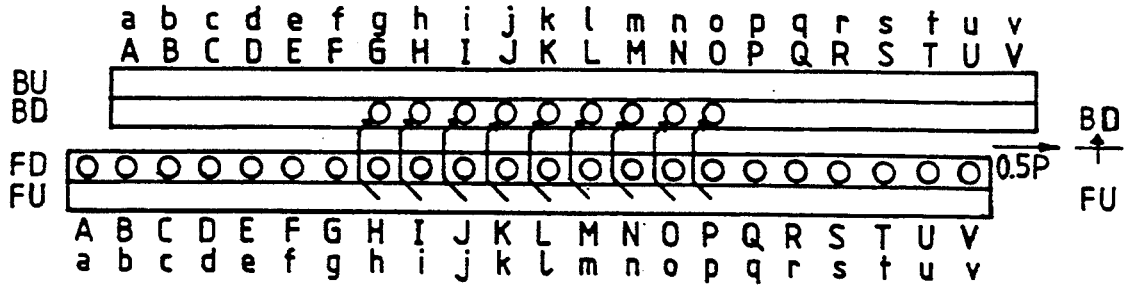

Next, when the knitting course shown in FIG. 389 is activated, those needle beds BU and BD in the rear position are respectively brought back to the right by one-half pitch, and then causes the feeder 3 to feed knitting yarns to those knitting needles P through A in the state being tacked with a knitting needle Q of the needle bed FD. Next, when the knitting course shown in FIG. 390 is activated, those needle beds BU and BD in the rear position are respectively shifted to the right by one-half pitch, and then, those loops engaged with the knitting needles G through O of the needle bed BD are respectively transferred to those knitting needles h through p of the needle bed FU.

Figure 391:
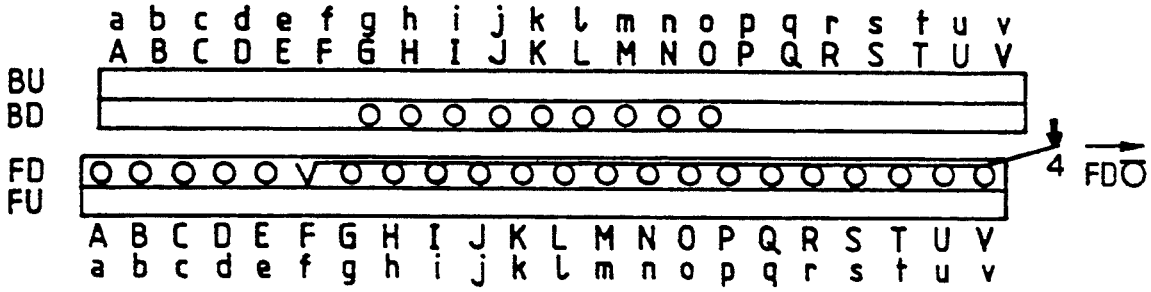
Figure 392:
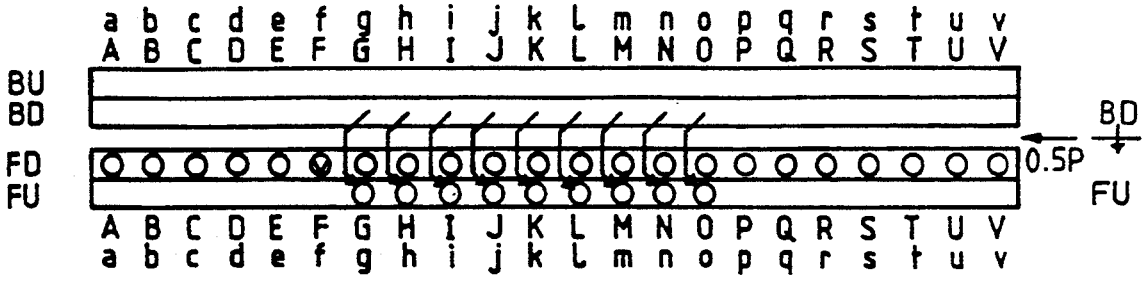

Next, when the knitting course shown in FIG. 391 is activated, another feeder 4 feeds knitting yarns to those knitting needles V through Q of the needle bed FD and those knitting needles p through h of the needle bed FU to have these needles respectively form loops. Next, when the knitting course shown in FIG. 392 is activated, those needle beds BU and BD in the rear position are respectively shifted to the right by one-half pitch, and then, those knitting needles h through p of the needle bed FU are respectively transferred to those loops engaged with the knitting needles G through O of the needle bed BD.

Figure 393:
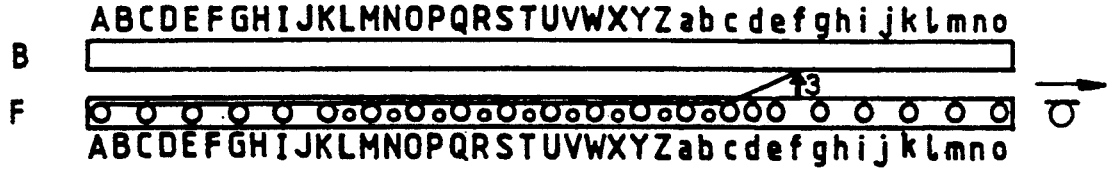
FIG. 393 through FIG. 400 are respectively explanatory of knit composing courses available for integrally forming a pocket with a body part according to the twelveth embodiment of the invention.
Figure 394:
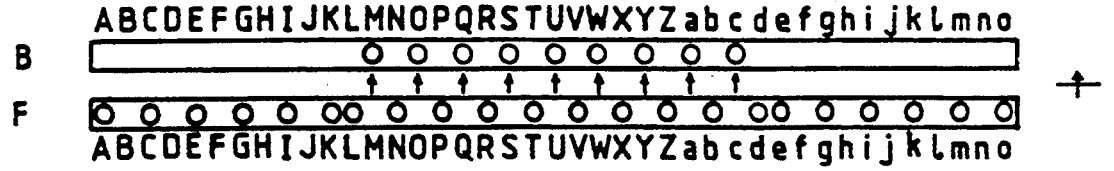

Next, when the knitting course shown in FIG. 393 is activated, those needle beds BU and BD in the rear position are respectively brought back to the left by one-half pitch, and then causes the feeder 4 to feed knitting yarns to those knitting needles G through V in the state of being tacked with a knitting needle F of the needle bed FD before causing those needles G through V to respectively form loops. Next, when the knitting course shown in FIG. 394 is activated, those needle beds BU and BD in the rear position are respectively shifted to the left by one-half pitch, and then causes those loops engaged with those knitting needles G through O of the needle bed BD to be transferred to those knitting needles g through o of the needle bed FU.

Henceforth, the flat knitting machine repeatedly executes operations for processing those knitting courses shown in FIG. 387 through FIG. 394 before eventually composing the straight portion of a pocket 2.

In consequence, as shown in FIG. 386, the both-side edges of the pocket 2 are integrally linked with the front body knit 7 by means of tacking.

The Twelveth Embodiment

As described earlier, the method according to the eleventh embodiment of the invention for composing a knit wear integrally provided with an additional type pocket makes use of the conventionally called "4-piece needle-bed" type flat knitting machine which is furnished with four needle beds in file each storing a number of knitting needles on the top surface by permitting these knitting needles to slidably move back and forth, where these needle beds are respectively disposed in opposition from each other in the "/ \" shape formation. On the other hand, the twelveth embodiment of the invention provides the method of composing a knit wear integrally provided with an additional-type pocket by operating a conventionally called "2-piece needle-bed" type flat knitting machine which is furnished with a pair of needle beds on the top surface each storing a number of knitting needles on the top surface by permitting these knitting needles to slidably move back and forth, where these knitting needles are also disposed in opposition from each other in the "/ \" shape formation. Concretely, using the 2-piece needle-bed type flat knitting machine, the twelveth embodiment of the invention provides the method of composing a knitted wear integrated with an additional type pocket having the bottom and both-side edges of the pocket integrally being linked with the front-body knit domain by means of knitting yarns and knit in the same way as was executed by the "4-piece needle-bed" flat knitting machine made available for the eleventh embodiment of the invention.

Figure 395:
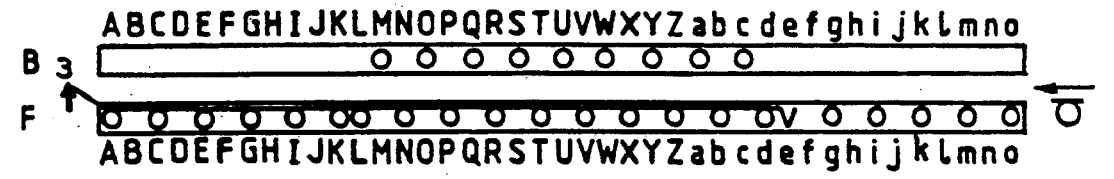
Figure 396:
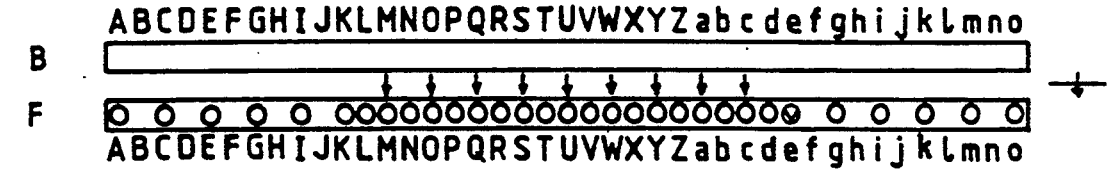
Figure 397:
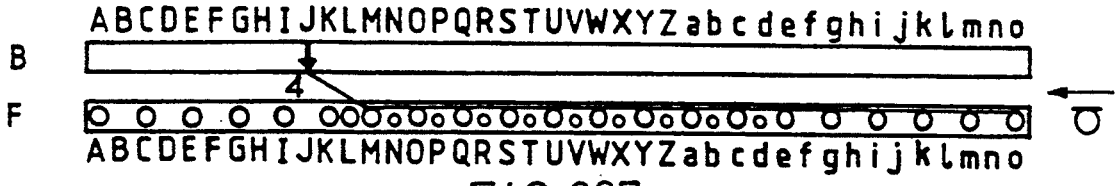
Figure 398:
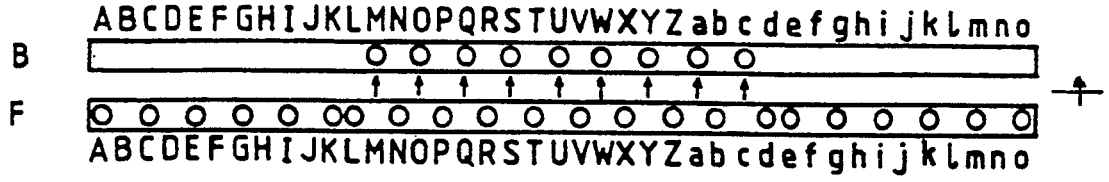
Figure 399:
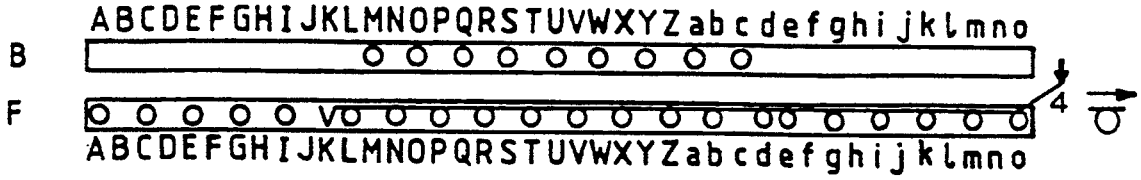
Figure 400:
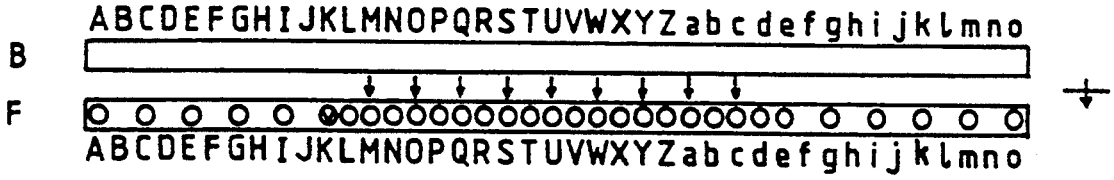

More particularly, as shown in FIG. 395, of those knitting needles A through o of a front needle bed F, those alternate knitting needles including A, C, E, . . . k, m, and o jointly operate themselves in place of the needle bed FD disposed on the bottom side in the front position made available for the eleventh embodiment, whereas those remaining alternate knitting needles B, D, F, . . . h, l, and n jointly operate themselves in place of the needle bed FU disposed on the top side in the front position made available for the eleventh embodiment. Likewise, of those knitting needles A through o of a needle bed B in the rear position, those alternate knitting needles including A, C, E, . . . k, m, and o jointly operate themselves in place of a need bed BD disposed on the bottom side in the rear position made available for the eleventh embodiment, whereas the remaining alternate knitting needles including B, D, F, . . . h, l, and n jointly operate themselves in place of a needle bed BU disposed on the top side in the rear position made available for the eleventh embodiment, respectively.

Concretely, FIG. 395 corresponds to FIG. 387 made available for the eleventh embodiment described above. Those knitting courses shown in FIG. 396 through FIG. 402 respectively and sequentially correspond to those knitting courses shown in FIG. 354 through FIG. 396 made available for the eleventh embodiment. Furthermore, like the eleventh embodiment, both-side edges of pocket 2 are integrally linked with the front-body knit 7 via tacking means as shown in FIG. 386, and yet, knit organization of the front-body knit domain concealed in the knit of a pocket region is superficially formed, thus eventually providing a quality pocket abundant in bulkiness characteristic of the additional type pocket.

The foregoing relates to a preferred exemplary embodiment of the invention, it being understood that other variants and embodiments thereof are possible within the spirit and scope of the invention, the latter being defined by the appended claims.

What is claimed is:

1. A method of simultaneously knitting a base fabric and a pocket forming fabric on said base fabric by using a flat knitting machine including a front needle bed and a rear needle bed, each of the needle beds has a plurality of knitting needles, said flat knitting machine includes a plurality of carriers, said pocket forming fabric has a left side and a right side, comprising:

knitting the base fabric with alternate knitting needles among the knitting needles of the front needle bed;

transferring a predetermined number of loops of the base fabric which are held by the alternate knitting needles of the front needle bed to the knitting needles of the rear needle bed, said predetermined number of loops are determined by the width of the pocket forming fabric;

casting-on the pocket forming fabric by holding the predetermined number of loops of the base fabric which are held by the knitting needles of the rear needle bed also by knitting needles of the front needle bed;

forming loops on the knitting needles of the rear needle bed which hold the predetermined number of loops of the base fabric;

transferring the formed loops held by the knitting needles of the rear needle bed to knitting needles of the front needle bed which hold no loops;

knitting the base fabric covered with the pocket forming fabric with the alternate knitting needles of the front needle bed;

transferring loops of the base fabric covered with the pocket forming fabric held by the knitting needles of the front needle bed to the knitting needles of the rear needle bed;

knitting the pocket forming fabric by the knitting needles of the front needle bed; and connecting the left side and the right side of said pocket forming fabric to the base fabric simultaneously with knitting the base fabric and knitting the pocket forming fabric.

2. A method of knitting a fabric provided with a pocket as in claim 1, further comprising:

binding off loops at an upper side of the pocket-forming fabric with a knitting yarn which is hooked by a knitting needle used for knitting the base fabric at an end of an upper side of the pocket-forming fabric.

3. A method of knitting a fabric provided with a pocket as in claim 1, further comprising:

intersecting a knitting yarn supplied to the base fabric overlapped by the pocket-forming fabric and a knitting yarn supplied to the base fabric not overlapped by the pocket-forming fabric at a side of the pocket-forming fabric.

4. A method of simultaneously knitting a base fabric and a pocket-forming fabric on said base fabric by using a flat knitting machine having a plurality of carriers and a plurality of knitting needles, said pocket-forming fabric having a left side and a right side, comprising:

casting on the pocket-forming fabric by widening a predetermined number of loops of the base fabric as determined by the width of a pocket-forming fabric, knitting the pocket-forming fabric into a front knitting construction, connecting the left side and the right side of said pocket-forming fabric to the base fabric simultaneously with knitting the base fabric and knitting the pocket forming-fabric, and knitting the base fabric covered with the pocket-forming fabric into a front knitting construction.

5. A method of simultaneously knitting a base fabric and a pocket-forming fabric on said base fabric by using a flat knitting machine including an upper front needle bed, an upper rear needle bed, a lower front needle bed and a lower rear needle bed, each of the needle beds has a plurality of knitting needles, said flat knitting machine includes a plurality of carriers, said pocket-forming fabric has a left side and a right side, comprising:

knitting the base fabric with knitting needles of one of the two front needle beds, casting-on the pocket forming fabric by holding a predetermined number of loops of the base fabric which are held by the knitting needles of said one of the two front knitting needle beds also by knitting needles of the lower rear needle bed, said predetermined number of loops are determined by the width of the pocket-forming fabric, forming loops on the knitting needles of the lower needle bed, transferring the loops held by the knitting needles of the lower rear needle bed to knitting needles of the upper front needle bed, to form the base fabric covered with the pocket-forming fabric, knitting the base fabric covered with the pocket-forming fabric with the knitting needles of the upper front needle bed into a front knitting construction, transferring loops of the base fabric covered with the pocket-forming fabric, including the loops held by the knitting needles of the upper front needle bed, to the knitting needles of the lower rear needle bed, knitting the pocket-forming fabric with the knitting needles of the lower front needle bed into a front knitting construction, repeating the above third, fourth, fifth, and sixth steps, and connecting the left side and the right side of said pocket-forming fabric to the base fabric simultaneously with knitting the base fabric and knitting the pocket-forming fabric.

6. A method of knitting a fabric provided with a pocket as in claim 4, further comprising:

binding off loops at an upper side of the pocket-forming fabric with a knitting yarn which is hooked by a knitting needle used for knitting the base fabric at an end of an upper side of the pocket-forming fabric.

7. A method of knitting a fabric provided with a pocket as in claim 5, further comprising:

binding off loops at an upper side of the pocket-forming fabric with a knitting yarn which is hooked by a knitting needle used for knitting the base fabric at an end of an upper side of the pocket-forming fabric.

8. A method of knitting a fabric provided with a pocket as in claim 4, further comprising:

intersecting a knitting yarn supplied to the base fabric overlapped with the pocket-forming fabric and a knitting yarn supplied to the base fabric not overlapped with the pocket-forming fabric at a side of the pocket-forming fabric.

9. A method of knitting a fabric provided with a pocket as in claim 5, comprising:

intersecting a knitting yarn supplied to the base fabric overlapped with the pocket-forming fabric and a knitting yarn supplied to the base fabric not overlapped with the pocket-forming fabric at a side of the pocket-forming fabric.

10. A method of knitting a fabric provided with a pocket as in claim 4, further comprising:

overlapping loops at the left side and the right side of the pocket-forming fabric with loops of the base fabric, forming new loops on the overlapped loops, and thereby connecting the pocket-forming fabric with the base fabric.

11. A method of knitting a fabric provided with a pocket as in claim 4, comprising:

overlapping loops at the left side and the right side of the pocket-forming fabric with loops of the base fabric, forming new loops on the overlapped loops, and thereby connecting the pocket-forming fabric with the base fabric.

* * * * *